US009856628B2

(12) United States Patent
Kitajima et al.

(10) Patent No.: US 9,856,628 B2
(45) Date of Patent: Jan. 2, 2018

(54) CONTROL SYSTEM FOR CONSTRUCTION MACHINE, CONSTRUCTION MACHINE, AND METHOD FOR CONTROLLING CONSTRUCTION MACHINE

(71) Applicant: Komatsu Ltd., Tokyo (JP)

(72) Inventors: Jin Kitajima, Naka-gun (JP); Kazuki Takehara, Hiratsuka (JP)

(73) Assignee: Komatsu Ltd., Tokyo (JP)

( * ) Notice: Subject to any disclaimer, the term of this patent is extended or adjusted under 35 U.S.C. 154(b) by 187 days.

(21) Appl. No.: 14/388,666

(22) PCT Filed: Jun. 2, 2014

(86) PCT No.: PCT/JP2014/064648
§ 371 (c)(1),
(2) Date: Sep. 26, 2014

(87) PCT Pub. No.: WO2015/186180
PCT Pub. Date: Dec. 10, 2015

(65) Prior Publication Data

US 2016/0251835 A1 Sep. 1, 2016

(51) Int. Cl.
*E02F 9/26* (2006.01)
*E02F 3/32* (2006.01)
(Continued)

(52) U.S. Cl.
CPC ..... *E02F 9/265* (2013.01); *E02F 3/32* (2013.01); *E02F 3/3663* (2013.01);
(Continued)

(58) Field of Classification Search
CPC ... E02F 3/43; E02F 3/431; E02F 3/435; E02F 9/261; E02F 9/262; E02F 9/264;
(Continued)

(56) References Cited

U.S. PATENT DOCUMENTS 4,633,383 A * 12/1986 Omachi ..... E02F 9/26 37/348
5,019,761 A * 5/1991 Kraft ..... G05B 19/427 318/568.1
(Continued)

FOREIGN PATENT DOCUMENTS

CN 103354855 A 10/2013
JP 4958567 B2 6/2012
(Continued)

OTHER PUBLICATIONS

International Search Report and Written Opinion dated Oct. 7, 2014, issued for PCT/JP2014/064648.
(Continued)

*Primary Examiner* — Thomas G Black
*Assistant Examiner* — Sara J Lewandroski
(74) *Attorney, Agent, or Firm* — Locke Lord LLP; Howard M. Gitten

(57) ABSTRACT

A control system controls a construction machine having a work machine including a tilting bucket. The control system includes: a first acquisition unit configured to acquire dimension data; a second acquisition unit configured to acquire external shape data of the bucket; a third acquisition unit configured to acquire target excavation landform data indicating a target excavation landform that is a two-dimensional target shape of an excavation object on a work machine operation plane perpendicular to a bucket axis; a fourth acquisition unit configured to acquire work machine angle data; a fifth acquisition unit configured to acquire tilt angle data indicating a turning angle of the bucket; and a calculation unit configured to obtain two-dimensional bucket data indicating an external shape of the bucket on the work machine operation plane on the basis of the dimension
(Continued)

data, the external shape data, the work machine angle data, and the tilt angle data.

6 Claims, 31 Drawing Sheets

(51) Int. Cl.
*E02F 3/43* (2006.01)
*E02F 3/36* (2006.01)
*E02F 9/22* (2006.01)

(52) U.S. Cl.
CPC ..... *E02F 3/3677* (2013.01); *E02F 3/435* (2013.01); *E02F 3/439* (2013.01); *E02F 9/2285* (2013.01); *E02F 9/2296* (2013.01); *E02F 9/262* (2013.01)

(58) Field of Classification Search
CPC . E02F 9/265; E02F 9/26; E02F 9/2045; E02F 9/24; E02F 9/2285; E02F 5/02; E02F 5/14; E02F 5/145; E02F 3/28; E02F 3/32; E02F 3/30; E02F 3/303; E02F 3/307; E02F 3/3663; E02F 3/3677
USPC ..... 701/50
See application file for complete search history.

(56) References Cited

U.S. PATENT DOCUMENTS 6,076,029 A * 6/2000 Watanabe ..... E02F 3/437 172/4
7,513,070 B2 * 4/2009 Ogura ..... G07C 3/08 172/2
7,606,648 B2 * 10/2009 Shepherd ..... E02F 9/26 180/89.12
7,810,260 B2 * 10/2010 Pope ..... E02F 3/3677 37/408
8,838,329 B2 * 9/2014 Seki ..... E02F 9/264 701/33.1
8,886,416 B2 * 11/2014 Fukano ..... E02F 9/2033 701/50
9,080,317 B2 7/2015 Matsuyama
2003/0001751 A1 * 1/2003 Ogura ..... E02F 9/2296 340/691.6
2003/0147727 A1 * 8/2003 Fujishima ..... E02F 3/435 414/200
2005/0027420 A1 * 2/2005 Fujishima ..... E02F 9/2045 701/50
2007/0010925 A1 * 1/2007 Yokoyama ..... E02F 9/261 701/50
2013/0302124 A1 * 11/2013 Matsuyama ..... E02F 3/435 414/687
2013/0315699 A1 * 11/2013 Matsuyama ..... E02F 3/435 414/687
2014/0064897 A1 * 3/2014 Montgomery ..... E02F 3/434 414/685
2014/0100744 A1 4/2014 Johnson et al.
2015/0081176 A1 * 3/2015 Paull ..... E02F 3/401 701/50
2015/0345114 A1 * 12/2015 Nomura ..... E02F 3/3677 37/379
2016/0215475 A1 * 7/2016 Meguriya ..... E02F 3/32

FOREIGN PATENT DOCUMENTS

JP 2012172431 A * 9/2012
JP 2012172431 A * 9/2012 ..... E02F 9/264
JP 2014-074319 A 4/2014
KR 1020030084048 A 9/2006
KR 20130113515 A 10/2013
WO WO-2012/127913 A1 9/2012
WO WO-2012/127914 A1 9/2012

OTHER PUBLICATIONS

Decision to Grant Patent, issued by Examiners Uk-Gi Kim and Yeong-Ho Kwon of the Korean Intellectual Property Office, dated Apr. 25, 2017, in corresponding Korean Patent Application No. 10-2015-7027172.

* cited by examiner

CONTROL SYSTEM FOR CONSTRUCTION MACHINE, CONSTRUCTION MACHINE, AND METHOD FOR CONTROLLING CONSTRUCTION MACHINE

FIELD

The present invention relates to a control system for a construction machine, a construction machine, and a method for controlling a construction machine.

BACKGROUND

A construction machine such as an excavator includes a work machine including a boom, an arm, and a bucket. For control of a construction machine, limited excavation control for moving a bucket on the basis of a target excavation landform that is a target shape of an excavation object is known as disclosed in Patent Literatures 1 and 2.

CITATION LIST

Patent Literatures

Patent Literature 1: WO 2012/127913 A
Patent Literature 2: WO 2012/127914 A

SUMMARY

Technical Problem

In construction machines, tilting buckets that can be tilted are known. When the tilt angle of a bucket changes as a result of tilting the bucket, the position of a blade edge of the bucket cannot be obtained accurately. As a result, excavation accuracy may be lowered and expected construction may not be carried out.

An aspect of the present invention aims at providing a control system for a construction machine, a construction machine, and a method for controlling a construction machine capable of prevent degradation in excavation accuracy even when a tilting bucket is used.

Solution to Problem

According to a first aspect of the present invention, a control system for a construction machine including a work machine including: a boom rotatable about a boom axis relative to a vehicle main body, an arm rotatable about an arm axis parallel to the boom axis relative to the boom, and a bucket rotatable about a bucket axis parallel to the arm axis and about a tilt axis perpendicular to the bucket axis relative to the arm, the control system comprises: a first acquisition unit configured to acquire dimension data including a dimension of the boom, a dimension of the arm, and a dimension of the bucket; a second acquisition unit configured to acquire external shape data of the bucket; a third acquisition unit configured to acquire target excavation landform data indicating a target excavation landform that is a two-dimensional target shape of an excavation object on a work machine operation plane perpendicular to the bucket axis; a fourth acquisition unit configured to acquire work machine angle data including a boom angle data indicating a turning angle of the boom about the boom axis, arm angle data indicating a turning angle of the arm about the arm axis, and a bucket angle data indicating a turning angle of the bucket about the bucket axis; a fifth acquisition unit configured to acquire tilt angle data indicating a turning angle of the bucket about the tilt axis; and a calculation unit configured to obtain two-dimensional bucket data indicating an external shape of the bucket on the work machine operation plane on the basis of the dimension data, the external shape data, the work machine angle data, and the tilt angle data.

In the first aspect of the present invention, it is preferable that the external shape data of the bucket includes first contour data of the bucket at one end in a width direction of the bucket and second contour data of the bucket at another end in the width direction of the bucket, and the calculation unit obtains the two-dimensional bucket data on the basis of the first contour data, a position of the work machine operation plane, and a position of a bucket blade edge.

In the first aspect of the present invention, it is preferable that the calculation unit obtains a relative position between the target excavation landform and the bucket on the basis of the two-dimensional bucket data, vehicle main body position data indicating a current position of the vehicle main body, and vehicle main body posture data indicating a posture of the vehicle main body.

In the first aspect of the present invention, it is preferable that the third acquisition unit acquires target construction information including the target excavation landform and indicating a three-dimensional designed landform that is three-dimensional target shape of the excavation object, the calculation unit obtains a closet point closet to a surface of the three-dimensional designed landform from a multiple measure points set on a front end portion of the bucket and an external surface of the bucket on the basis of the work machine angle data, the tilt angle data, the vehicle main body position data, the vehicle main body posture data, and the external shape data of the bucket, and the work machine operation plane passes through the closest point.

In the first aspect of the present invention, it is preferable that the control system for a construction machine further comprises a work machine control unit configured to control the work machine on the basis of the two-dimensional bucket data.

In the first aspect of the present invention, it is preferable that the two-dimensional bucket data includes bucket position data indicating a current position of the bucket on the work machine operation plane, and the work machine control unit determines a speed limit according to a distance between the target excavation landform and the bucket on the basis of the target excavation landform data and the bucket position data, and limits a speed of the boom to be equal to or lower than the speed limit in a direction in which the work machine moves toward the target excavation landform.

In the first aspect of the present invention, it is preferable that the two-dimensional bucket data includes bucket position data indicating a current position of the bucket on the work machine operation plane, and the control system further comprises a display unit configured to display the target excavation landform data and the bucket position data.

According to a second aspect of the present invention, a construction machine comprises: a lower running body; an upper swing body supported by the lower running body; a work machine including a boom, an arm, and a bucket, and supported by the upper swing body; and the control system.

According to a third aspect of the present invention, a method for controlling a construction machine including a work machine including: a boom rotatable about a boom axis relative to a vehicle main body, an arm rotatable about an arm axis parallel to the boom axis relative to the boom, and a bucket rotatable about a bucket axis parallel to the arm axis and about a tilt axis perpendicular to the bucket axis relative to the arm, the method comprises: acquiring dimension data including a dimension of the boom, a dimension of the arm, and a dimension of the bucket; acquiring external shape data of the bucket; acquiring work machine angle data including a boom angle data indicating a turning angle of the boom about the boom axis, arm angle data indicating a turning angle of the arm about the arm axis, and a bucket angle data indicating a turning angle of the bucket about the bucket axis; acquiring tilt angle data indicating a turning angle of the bucket about the tilt axis; specifying target excavation landform data indicating a target excavation landform that is a two-dimensional target shape of an excavation object on a work machine operation plane perpendicular to the bucket axis; obtaining two-dimensional bucket data indicating an external shape of the bucket on the work machine operation plane on the basis of the dimension data, the external shape data, the work machine angle data, and the tilt angle data; and controlling the work machine on the basis of the two-dimensional bucket data.

Advantageous Effects of Invention

According to an aspect of the present invention, degradation in excavation accuracy is prevented.

DESCRIPTION OF EMBODIMENTS

Embodiments according to the present invention will be described below with reference to the drawings; the present invention, however, is not limited thereto. Components in the embodiments described below can be combined as appropriate. Furthermore, some of the components may not be used.

In the description below, a global coordinate system and a local coordinate system are set, and positional relations of respective components will be described with reference to the coordinate systems. The global coordinate system is a coordinate system based on an origin Pr (see FIG. 4) fixed to the earth. The local coordinate system is a coordinate system based on an origin P0 (see FIG. 4) fixed to a vehicle main body 1 of a construction machine CM. The local coordinate system may be referred to as a vehicle main body coordinate.

In the description below, the global coordinate system will be expressed as an XgYgZg cartesian coordinate system. As will be described later, the reference position (origin) Pg of the global coordinate system is within a work area. One direction in a horizontal plane will be referred to as an Xg-axis direction, a direction perpendicular to the Xg-axis direction in the horizontal plane will be referred to as a Yg-axis direction, and a direction perpendicular to the Xg-axis direction and the Yg-axis direction will be referred to as a Zg-axis direction. In addition, rotation (inclination) directions about the Xg axis, the Yg axis, and the Zg axis will be referred to as a θXg direction, a θYg direction, and a θZg direction, respectively. The Xg axis is perpendicular to a YgZg plane. The Yg axis is perpendicular to an XgZg plane. The Zg axis is perpendicular to an XgYg plane. The XgYg plane is parallel to the horizontal plane. The Zg-axis direction is the vertical direction.

In the description below, the local coordinate system will be expressed as an XYZ cartesian coordinate system. As will be describe later, the reference position (origin) P0 of the local coordinate system is at the center of a swing body 3. One direction in a plane will be referred to as an X-axis direction, a direction perpendicular to the X-axis direction in the plane will be referred to as a Y-axis direction, and a direction perpendicular to the X-axis direction and the Y-axis direction will be referred to as a Z-axis direction. In addition, rotation (inclination) directions about the X axis, the Y axis, and the Z axis will be referred to as a θX direction, a θY direction, and a θZ direction, respectively. The X axis is perpendicular to a YZ plane. The Y axis is perpendicular to an XZ plane. The Z axis is perpendicular to an XY plane.

[Overall Structure of Excavator]

Figure 1:
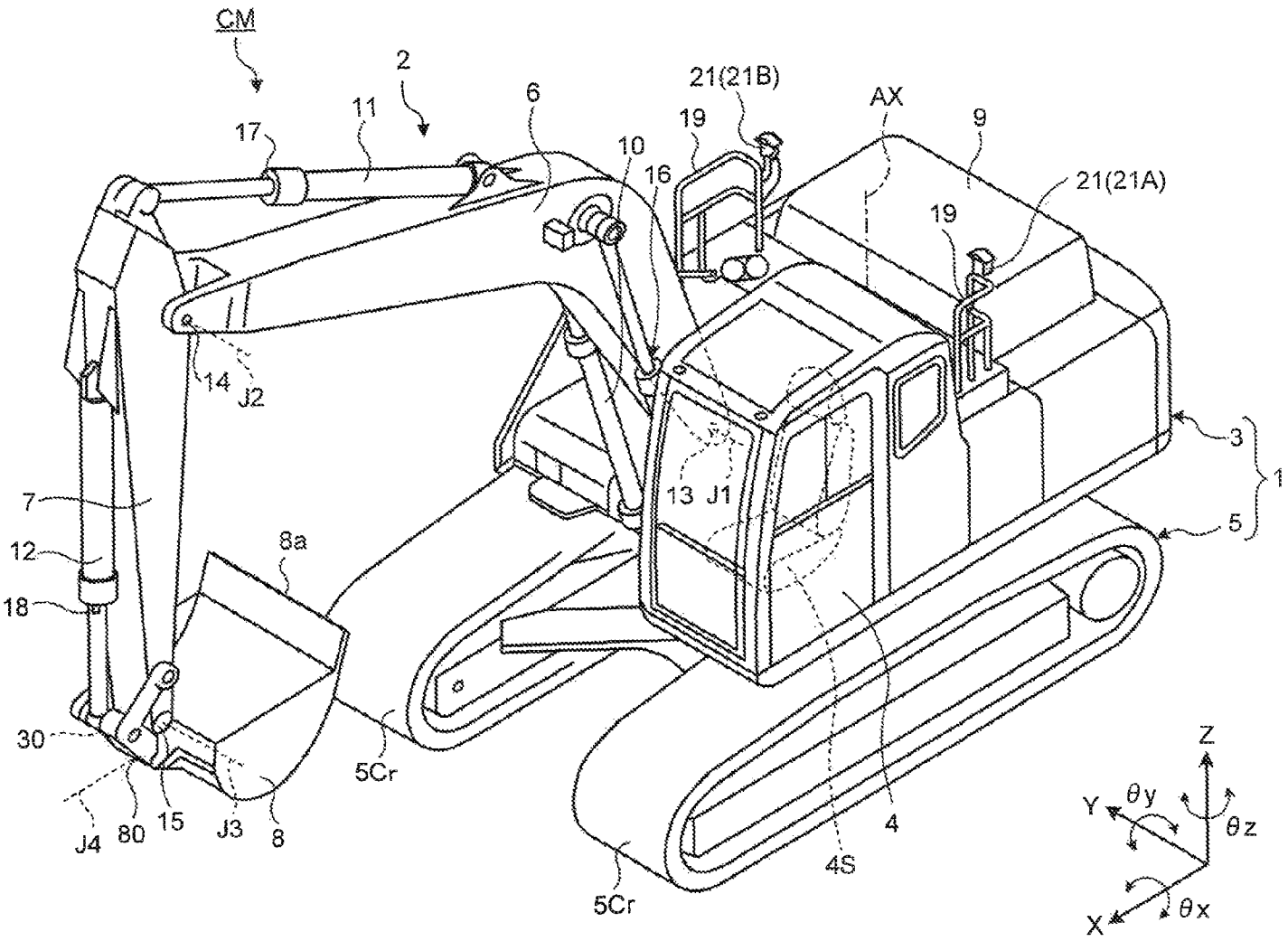
FIG. 1 is a perspective view illustrating an example of a construction machine.

FIG. 1 is a perspective view illustrating an example of the construction machine CM according to the present embodiment. In the present embodiment, an example in which the construction machine CM is an excavator CM including a hydraulically actuated work machine 2 will be described.

As illustrated in FIG. 1, the excavator CM includes the vehicle main body 1, and the work machine 2. As will be described later, the excavator CM has mounted thereon a control system 200 configured to execute excavation control.

The vehicle main body 1 includes the swing body 3, a cab 4, and a running device 5. The swing body 3 is arranged on the running device 5. The running device 5 supports the swing body 3. The swing body 3 may be referred to as an upper swing body 3. The running device 5 may be referred to as a lower running body 5. The swing body 3 can swing about a swing axis AX. In the cab 4, a driver seat 4S on which an operator sits is provided. The operator in the cab 4 operates the excavator CM. The running device 5 includes a pair of crawler tracks 5Cr. The excavator CM moves by the rotation of the crawler tracks 5Cr. Alternatively, the running device 5 may include wheels (tires).

In the present embodiment, positional relations of respective components will be described on the basis of the driver seat 4S. A front-back direction refers to a front-back direction based on the driver seat 4S. A left-right direction refers to a left-right direction based on the driver seat 4S. The left-right direction corresponds to the vehicle width direction. The direction in which the driver seat 4S faces front is the front direction, and the direction opposite to the front direction is the back direction. Lateral directions to the right and to the left when the driver seat 4S faces front are the right direction and the left direction, respectively. In the present embodiment, the front-back direction is the X-axis direction, and the left-right direction is the Y-axis direction. The direction in which the driver seat 4S faces front is the front direction (+X direction), and the direction opposite to the front direction is the back direction (−X direction). One direction of the vehicle width direction when the driver seat 4S faces front is the right direction (+Y direction), and the other direction of the vehicle width direction is the left direction (−Y direction).

The swing body 3 includes an engine compartment 9 accommodating an engine, and a counter weight provided behind the swing body 3. The swing body 3 is provided with a handrail 19 in front of the engine compartment 9. In the engine compartment 9, the engine, a hydraulic pump, etc. are arranged.

The work machine 2 is connected to the swing body 3. The work machine 2 includes a boom 6 connected to the swing body 3 with a boom pin 13, an arm 7 connected to the boom with an arm pin 14, a bucket 8 connected to the arm 7 with a bucket pin 15 and a tilt pin 80, a boom cylinder 10 that drives the boom 6, an arm cylinder 11 that drives the arm 7, and a bucket cylinder 12 and tilt cylinder 30 that drive the bucket 8. A base end portion (boom foot) of the boom 6 and the swing body 3 are connected. A front end portion (boom top) of the boom 6 and a base end portion (arm foot) of the arm 7 are connected. A front end portion (arm top) of the arm 7 and a base end portion of the bucket 8 are connected. The boom cylinder 10, the arm cylinder 11, the bucket cylinder 12, and the tilt cylinder 30 are hydraulic cylinders driven with hydraulic oil.

The work machine 2 includes a first stroke sensor 16 arranged at the boom cylinder 10 and configured to detect a stroke length of the boom cylinder 10, a second stroke sensor 17 arranged at the arm cylinder 11 and configured to detect a stroke length of the arm cylinder 11, and a third stroke sensor 18 arranged at the bucket cylinder 12 and configured to detect a stroke length of the bucket cylinder 12.

The boom 6 can rotate about a boom axis J1 that is a rotation axis relative to the swing body 3. The arm 7 can rotate about an arm axis J2 that is a rotation axis parallel to the boom axis J1 relative to the boom 6. The bucket 8 can rotate about a bucket axis J3 that is a rotation axis parallel to the boom axis J1 and the arm axis J2 relative to the arm 7. The bucket 8 can rotate about a tilt axis J4 that is a rotation axis perpendicular to the bucket axis J3 relative to the arm 7. The boom pin 13 has the boom axis J1. The arm pin 14 has the arm axis J2. The bucket pin 15 has the bucket axis J3. The tilt pin 80 has the tilt axis J4.

In the present embodiment, the boom axis J1, the arm axis J2, and the bucket axis J3 are parallel to the Y axis. The boom 6, the arm 7, and the bucket 8 can rotate in the 8Y direction. In the present embodiment, the XZ plane includes what is called a vertical rotation plane of the boom 6 and the arm 7.

In the description below, the stroke length of the boom cylinder 10 will be referred to as a boom cylinder length or a boom stroke as appropriate, the stroke length of the arm cylinder 11 will be referred to as an arm cylinder length or an arm stroke as appropriate, the stroke length of the bucket cylinder 12 will be referred to as a bucket cylinder length or a bucket stroke as appropriate, and the stroke length of the tilt cylinder 30 will be referred to as a tilt cylinder length as appropriate. In addition, in the description below, the boom cylinder length, the arm cylinder length, the bucket cylinder length, and the tilt cylinder length will be collectively referred to as cylinder length data L as appropriate.

[Bucket]

Figure 2:
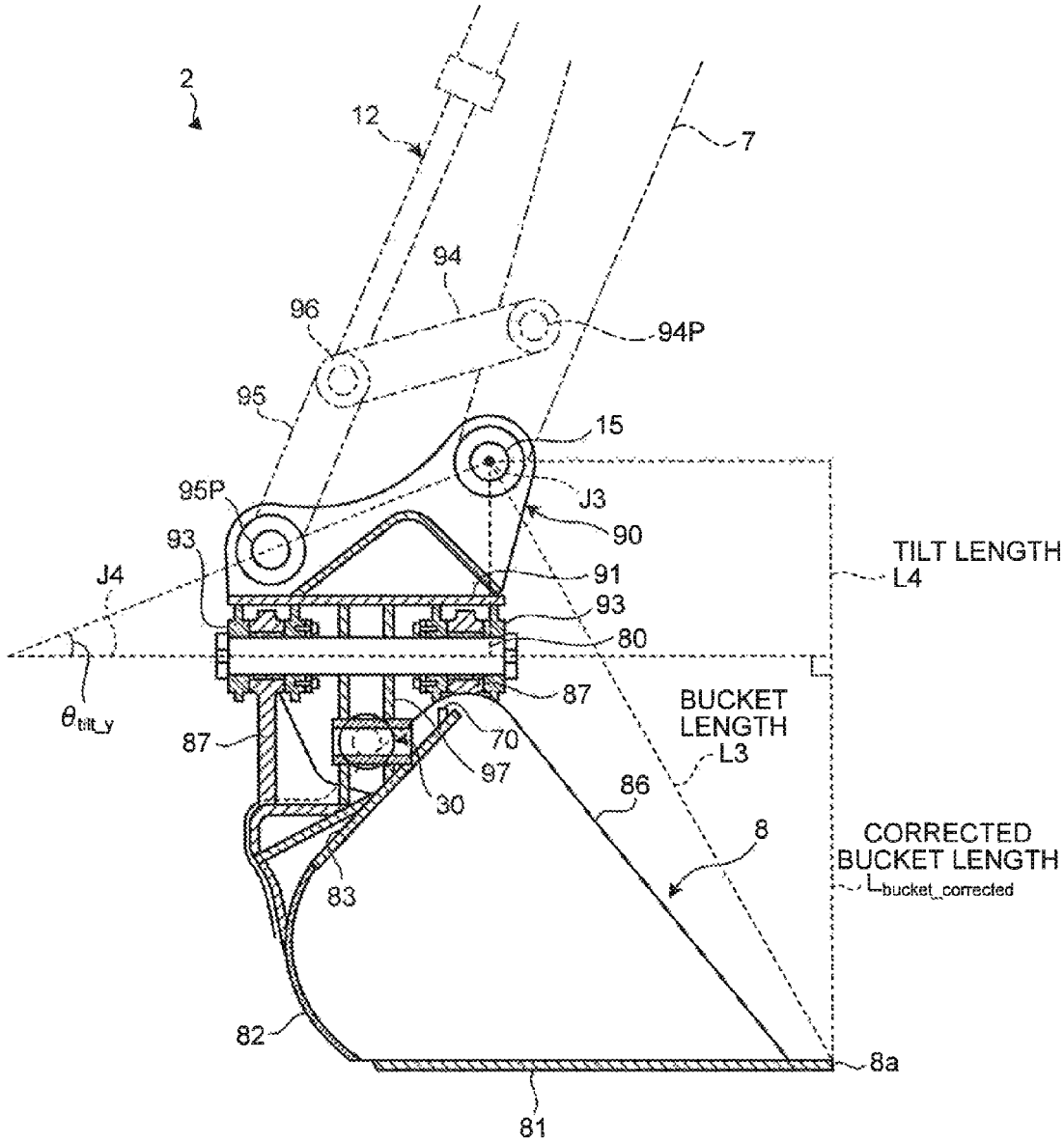
FIG. 2 is a sectional side view illustrating an example of a bucket.
Figure 3:
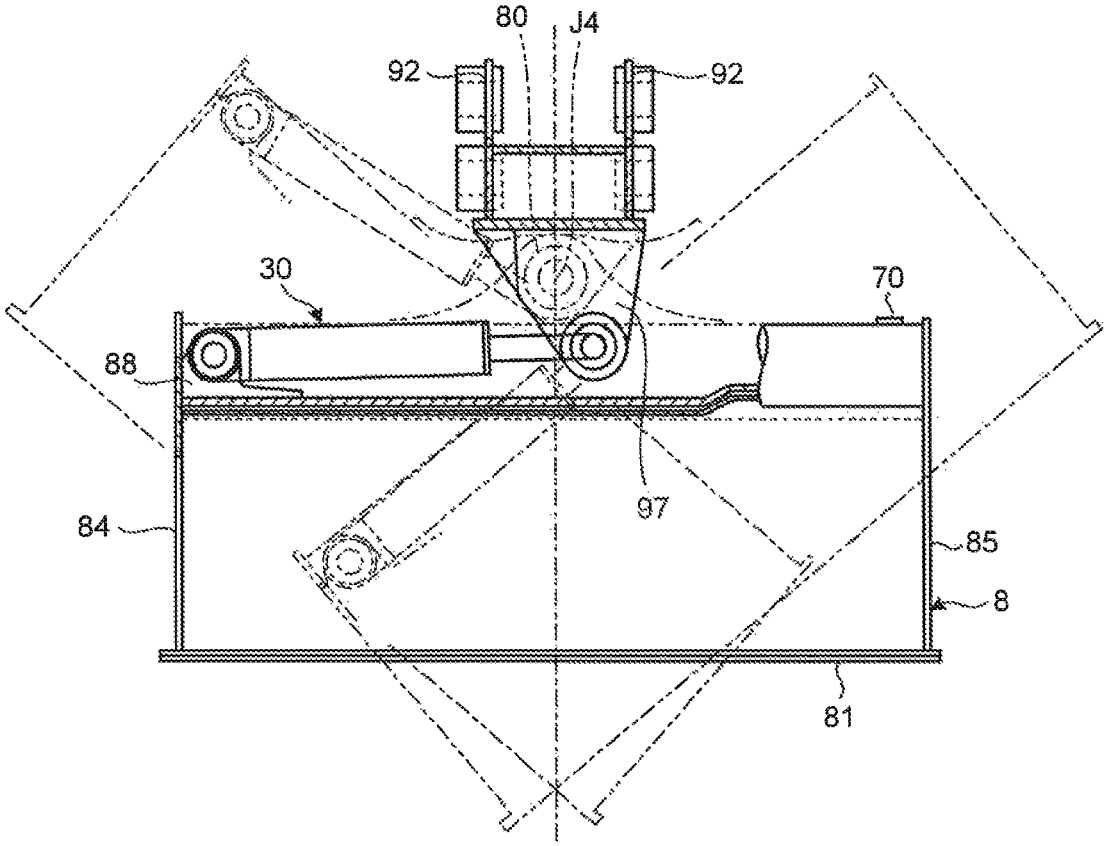
FIG. 3 is a front view illustrating an example of the bucket.

Next, the bucket 8 according to the present embodiment will be described. FIG. 2 is a sectional side view illustrating an example of the bucket 8 according to the present embodiment. FIG. 3 is a front view illustrating an example of the bucket 8 according to the present embodiment. In the present embodiment, the bucket 8 is a tilting bucket.

As illustrated in FIGS. 2 and 3, the work machine 2 includes the bucket 8 that can rotate about the bucket axis J3 and the tilt axis J4 perpendicular to the bucket axis J3 relative to the arm 7. The bucket 8 is supported by the arm 7 in a manner rotatable about the bucket pin 15 (bucket axis J3). The bucket 8 is supported by the arm 7 in a manner rotatable about the tilt pin 80 (tilt axis J4). The bucket axis J3 and the tilt axis J4 are perpendicular to each other. The bucket 8 is supported by the arm 7 in a manner rotatable about the bucket axis J3 and the tilt axis J4 perpendicular to the bucket axis J3.

The bucket 8 is connected to the front end portion of the arm 7 with a connecting member (underframe) 90. The bucket pin 15 couples the arm 7 and the connecting member 90. The tilt pin 80 couples the connecting member 90 and the bucket 8. The bucket 8 is rotatably connected to the arm 7 with the connecting member 90.

The bucket 8 has a bottom plate 81, a back plate 82, a top plate 83, a side plate 84, and a side plate 85. The bottom plate 81, the top plate 83, the side plate 84, and the side plate 85 define an opening 86 of the bucket 8.

The bucket 8 includes brackets 87 provided above the top plate 83. The brackets 87 are provided at front and back positions of the top plate 83. The brackets 87 are coupled to the connecting member 90 and tilt pin 80.

The connecting member 90 includes a plate member 91, brackets 92 provided on an upper surface of the plate member 91, and brackets 93 provided on a lower surface of the plate member 91. The brackets 92 are coupled to the arm 7 and a second link pin 95, which will be described later. The brackets 93 are provided above the brackets 87, and coupled to the tilt pin 80 and the brackets 87.

The bucket pin 15 couples the brackets 92 of the connecting member 90 and the front end portion of the arm 7. The tilt pin 80 couples the brackets 93 of the connecting member 90 and the brackets 87 of the bucket 8. This allows the connecting member 90 and the bucket 8 to rotate about the bucket axis J3 relative to the arm 7 and the bucket 8 to rotate about the tilt axis J4 relative to the connecting member 90.

The work machine 2 includes a first link member 94 rotatably connected to the arm 7 with a first link pin 94P, and a second link member 95 rotatably connected to the brackets 92 with the second link pin 95P. A base end portion of the first link member 94 is connected to the arm 7 with the first link pin 94P. A base end portion of the second link member 95 is connected to the brackets 92 with the second link pin 95P. A front end portion of the first link member 94 and a front end portion of the second link member 95 are coupled with a bucket cylinder top pin 96.

A front end portion of the bucket cylinder 12 is rotatably connected to a front end portion of the first link member 94 and a front end portion of the second link member 95 with the bucket cylinder top pin 96. When the bucket cylinder 12 operates to extend and contract, the connecting member 90 rotates together with the bucket 8 about the bucket axis J3.

The tilt cylinder 30 is connected to brackets 97 provided at the connecting member 90 and to brackets 88 provided at the bucket 8. A rod of the tilt cylinder 30 is connected to the brackets 97 with a pin. A body part of the tilt cylinder is connected to the brackets 88 with a pin. When the bucket cylinder 30 operates to extend and contract, the bucket 8 rotates about the tilt axis J4.

In this manner, the bucket 8 rotates about the bucket axis J3 by the operation of the bucket cylinder 12. The bucket 8 rotates about the tilt axis j4 by the operation of the tilt cylinder 30. In the present embodiment, as a result of the rotation of the bucket 8 about the bucket axis J3, the tilt pin 80 (tilt axis J4) rotates (inclines) together with the bucket 8.

In the present embodiment, the work machine 2 includes a tilt angle sensor 70 configured to detect tilt angle data indicating a turning angle δ of the bucket 8 about the tilt axis J4. The tilt angle sensor 70 detects a tilt angle (turning angle) of the bucket 8 relative to the horizontal plane of the global coordinate system. The tilt angle sensor 70 is what is called a two-axis angle sensor, and detects inclination angles with respect to two directions of the θXg direction and the θYg direction, which will be described later. The tilt angle sensor 70 is provided at at least part of the bucket 8. A tilt angle in the global coordinate system is converted to a tilt angle δ in the local coordinate system on the basis of a detection result from an inclination sensor 24.

Note that the bucket 8 is not limited to that in the present embodiment. A method of arbitrarily setting the inclination angles (tilt angles) of the bucket 8 may be used. Another axis may additionally be used for inclination angles.

[Structure of Excavator]

Figure 4:
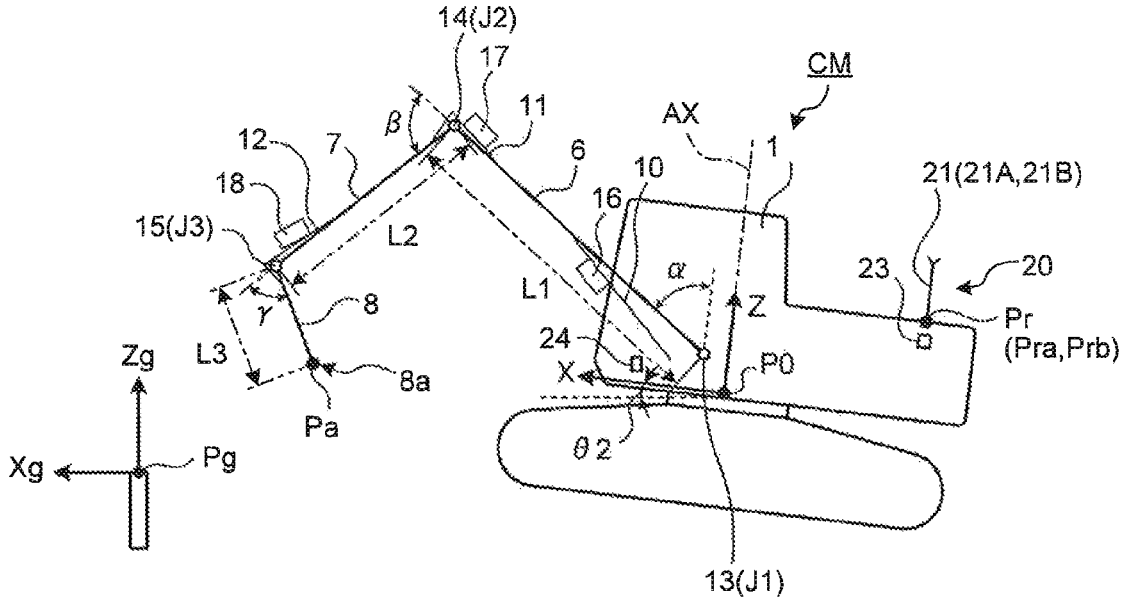
FIG. 4 is a side view schematically illustrating an example of the construction machine.
Figure 5:
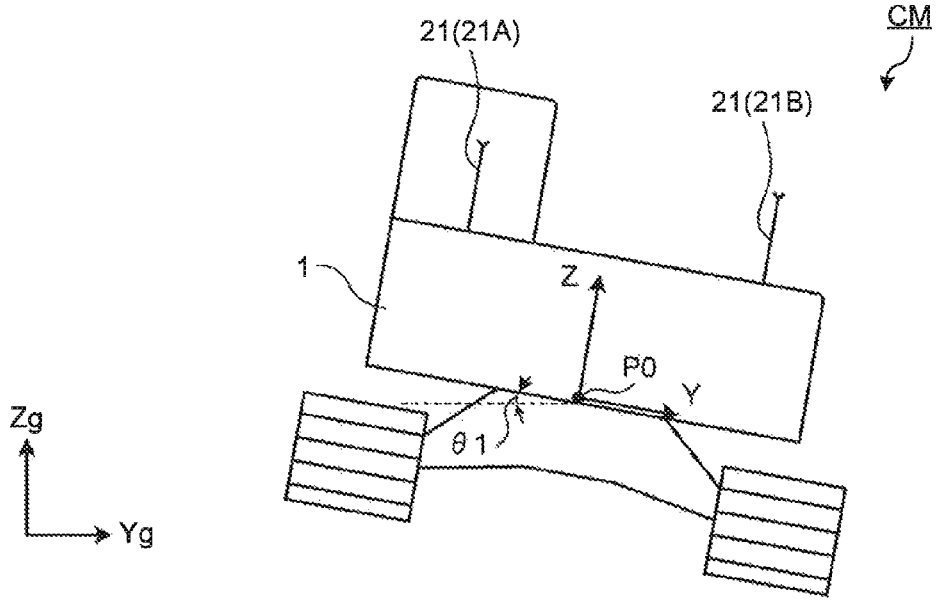
FIG. 5 is a rear view schematically illustrating an example of the construction machine.
Figure 6:
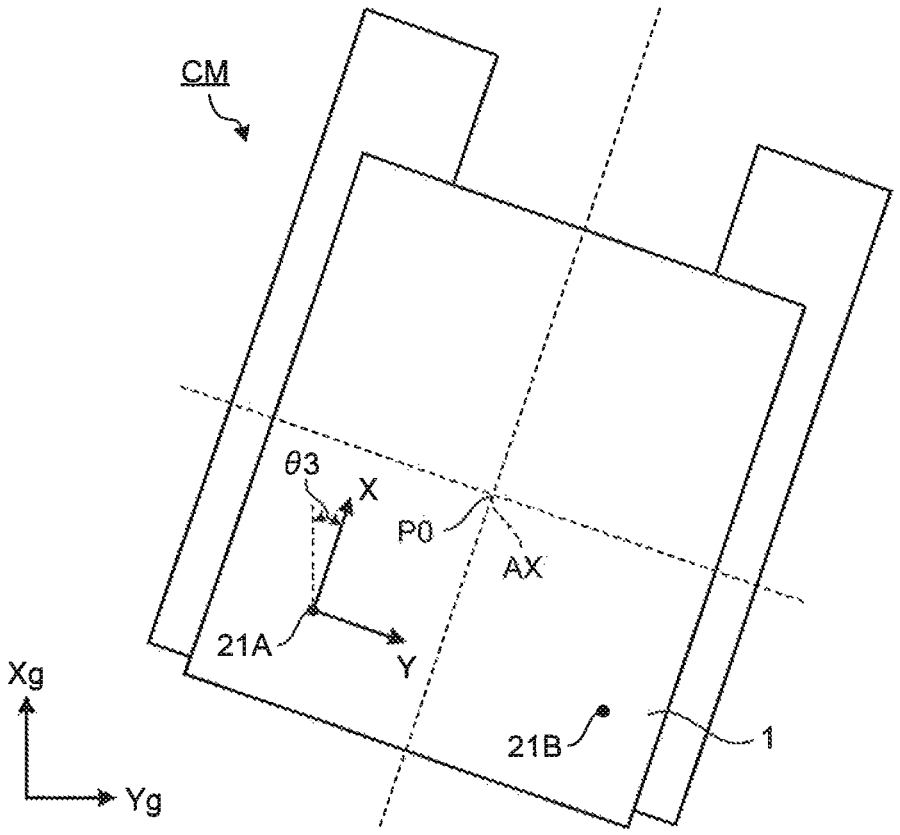
FIG. 6 is a plan view schematically illustrating an example of the construction machine.

FIG. 4 is a side view schematically illustrating the excavator CM according to the present embodiment. FIG. 5 is a rear view schematically illustrating the excavator CM according to the present embodiment. FIG. 6 is a plan view schematically illustrating the excavator CM according to the present embodiment.

In the present embodiment, a distance L1 between the boom axis J1 and the arm axis J2 will be referred to as a boom length L1. A distance L2 between the arm axis J2 and the bucket axis J3 will be referred to as an arm length L2. A distance L3 between the bucket axis J3 and a front end portion 8*a* of the bucket 8 will be referred to as a bucket length L3.

The front end portion of the bucket 8 includes a front end portion of a blade of the bucket 8. In the present embodiment, the front end portion of the blade of the bucket 8 is straight. Alternatively, the bucket 8 may have multiple pointed blades. In the description below, the front end portion 8*a* of the bucket 8 will be referred to as a blade edge 8*a*.

The excavator CM includes an angle detector 22 configured to detect angles of the work machine 2. The angle detector 22 detects work machine angle data including boom angle data indicating a turning angle α of the boom 6 about the boom axis J1, arm angle data indicating a turning angle β of the arm 7 about the arm axis J2, and bucket angle data indicating a turning angle γ of the bucket 8 about the bucket axis J3. In the present embodiment, the boom angle (turning angle) a includes the inclination angle of the boom 6 relative to an axis parallel to the z axis of the local coordinate system. The arm angle (turning angle) β includes the inclination angle of the arm 7 relative to the boom 6. The bucket angle (turning angle) γ includes the inclination angle of the bucket 8 relative to the arm 7.

In the present embodiment, the angle detector 22 includes the first stroke sensor 16 arranged at the boom cylinder 10, the second stroke sensor 17 arranged at the arm cylinder 11, and the third stroke sensor 18 arranged at the bucket cylinder 12. The boom cylinder length is obtained on the basis of the detection result of the first stroke sensor 16. The arm cylinder length is obtained on the basis of the detection result of the second stroke sensor 17. The bucket cylinder length is obtained by the detection result of the third stroke sensor 18. In the present embodiment, the detection of the boom cylinder length by the first stroke sensor 16 allows the boom angle α to be derived or calculated. The detection of the arm cylinder length by the second stroke sensor 17 allows the arm angle β to be derived or calculated. The detection of the bucket cylinder length by the third stroke sensor 18 allows the bucket angle γ to be derived or calculated.

The excavator CM includes a position detector 20 capable of detecting vehicle main body position data P indicating a current position of the vehicle main body 1 and vehicle main body posture data Q indicating a posture of the vehicle main body 1. The current position of the vehicle main body 1 includes current positions (Xg position, Yg position, and Zg position) of the vehicle main body 1 in the global coordinate system. The posture of the vehicle main body 1 includes positions of the swing body 3 in the θXg direction, the θYg direction, and the θZg direction. The posture of the vehicle main body 1 includes an inclination angle (roll angle) θ1 in the left-right direction of the swing body 3 relative to the horizontal plane (XgYg plane), an inclination angle (pitch angle) θ2 in the front-back direction of the swing body 3 relative to the horizontal plane, and an angle (yaw angle) θ3 between a reference direction (north, for example) of the global coordinate system and the direction in which the direction in which the swing body 3 (work machine 2) faces.

The position detector 20 includes an antenna 21, a position sensor 23, and the inclination sensor 24. The antenna 21 is an antenna for detecting a current position of the vehicle main body 1. The antenna 21 is an antenna for the GNSS (Global Navigation Satellite Systems). The antenna 21 is an antenna for the RTK-GNSS (Real Time Kinematic-Global Navigation Satellite Systems). The antenna 21 is provided at the swing body 3. In the present embodiment, the antenna 21 is provided at the handrail 19 of the swing body 3. Alternatively, the antenna 21 may be provided behind the engine compartment 9. For example, the antenna 21 may be provided at the counter weight of the swing body 3. The antenna 21 outputs a signal according to a received radio wave (GNSS radio wave) to the position sensor 23.

The position sensor 23 includes a three-dimensional position sensor and a global coordinate calculation unit, and detects an installation position Pr of the antenna 21 in the global coordinate system. The global coordinate system is a three-dimensional coordinate system based on the reference position Pg positioned in the work area. As illustrated in FIG. 4, in the present embodiment, the reference position Pg is a position of a tip of an alignment marker set in the work area.

In the present embodiment, the antenna 21 includes a first antenna 21A and a second antenna 21B provided at the swing body 3 with a distance therebetween in the Y-axis direction of the local coordinate system (the vehicle width direction of the swing body 3). The position sensor 23 detects an installation position Pra of the first antenna 21A and an installation position Prb of the second antenna 21B.

The position detector 20 acquires the vehicle main body position data P and the vehicle main body posture data Q in global coordinates by using the position sensor 23. The vehicle main body position data P is data indicating the reference position P0 positioned at the swing axis (swing center) AX of the swing body 3. Alternatively, the reference position data P may be data indicating the installation position Pr. The position detector 20 acquires the vehicle main body position data P including the reference position P0. In addition, the position detector 20 acquires the vehicle main body posture data Q on the basis of two installation positions Pra and Prb. The vehicle main body posture data Q is determined on the basis of an angle of a line determined by the installation position Pra and the installation position Prb with respect to the reference direction (north, for example of the global coordinate system. The vehicle main body posture data Q indicates a direction in which the swing body 3 (work machine 2) faces.

The inclination sensor 24 is provided at the swing body 3. The inclination sensor 24 includes an IMU (Inertial Measurement Unit). The inclination sensor 24 is arranged at a lower portion of the cab 4. In the swing body 3, a stiff frame is arranged at the lower portion of the cab 4. Alternatively, the inclination sensor 24 may be provided on a side (right side or left side) of the swing axis AX (reference position P2) of the swing body 3. The inclination sensor 24 is arranged at the frame. The position detector 20 acquires the vehicle main body posture data Q including the roll angle θ1 and the pitch angle θ2 by using the inclination sensor 24.

Figure 7:
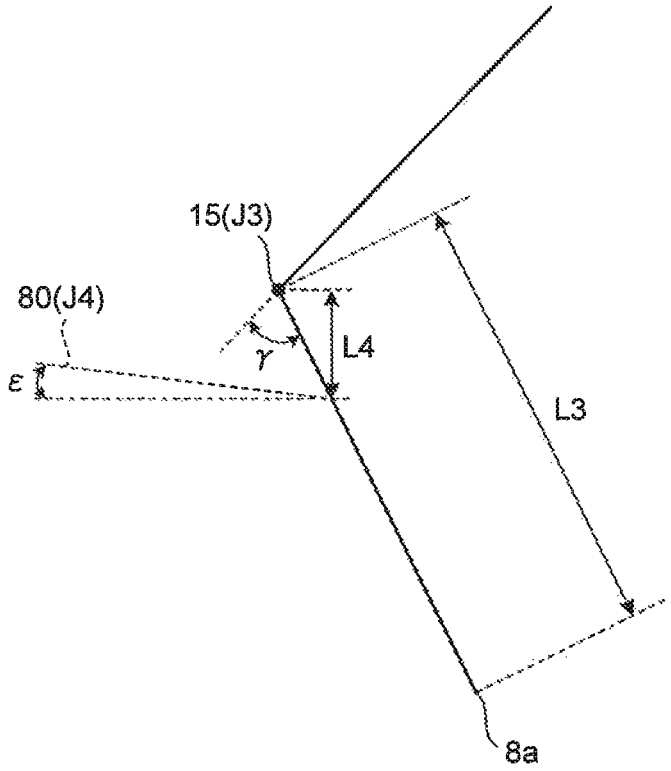
FIG. 7 is a side view schematically illustrating an example of the bucket.
Figure 8:
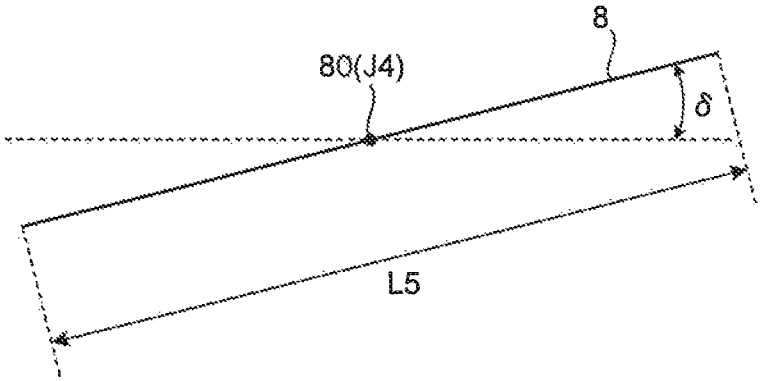
FIG. 8 is a front view schematically illustrating an example of the bucket.

FIG. 7 is a side view schematically illustrating the bucket 8 according to the present embodiment. FIG. 8 is a front view schematically illustrating the bucket 8 according to the present embodiment.

In the present embodiment, a distance L4 between the bucket axis J3 and the tilt axis J4 will be referred to as a tilt length L4. A distance L5 between the side plate 84 and the side plate 85 will be referred to as a width dimension L5 of the bucket 8. The tilt angle δ is an inclination angle of the bucket 8 with respect to the XY plane. The tilt angle data indicating the tilt angle δ is derived from the detection result of the tilt angle sensor 70. A tilt axis angle ϵ is an inclination angle of the tilt axis J4 (tilt pin 80) with respect to the XY plane. The tilt angle data indicating the tilt axis angle ϵ is derived from the detection result of the angle detector 22.

Although the tilt angle data is obtained from the detection result of the angle detector 22 in the present embodiment, the tilt angle of the bucket 8 can alternatively be obtained by calculation from the result of detecting the stroke length of the tilt cylinder 30 (tilt cylinder length), for example.

[Configuration of Control System]

Figure 9:
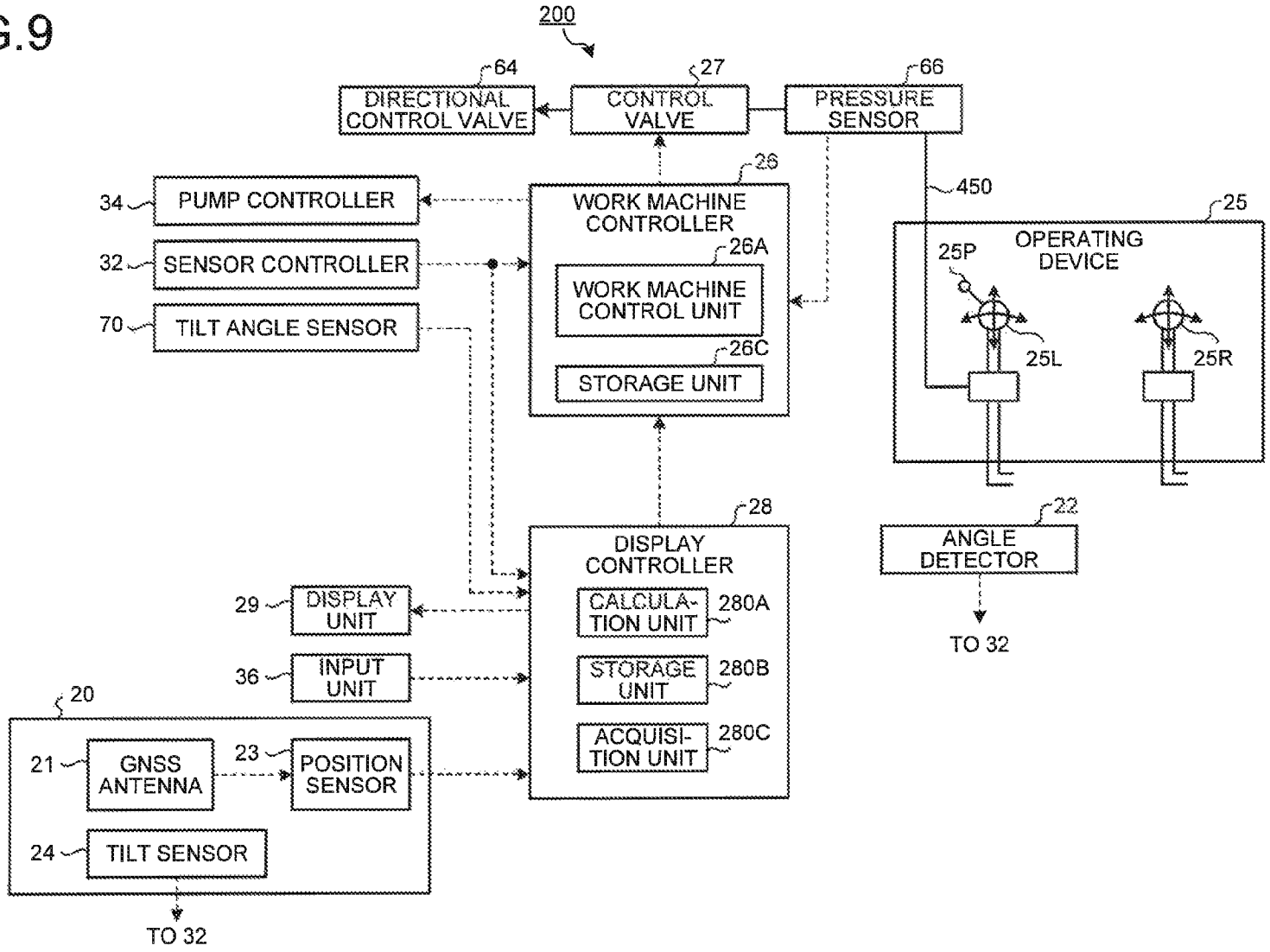
FIG. 9 is a block diagram illustrating an example of a control system.

Next, an outline of the control system 200 according to the present embodiment will be described. FIG. 9 is a block diagram illustrating a functional configuration of the control system according to the present embodiment.

The control system 200 controls an excavation process using the work machine 2. Control of an excavation process includes limited excavation control. As illustrated in FIG. 9, the control system 200 includes the position detector 20, the angle detector 22, the tilt angle sensor 70, an operating device 25, a work machine controller 26, a pressure sensor 66, a control valve 27, a directional control valve 64, a display controller 28, a display unit 29, an input unit 36, a sensor controller 32, a pump controller 34 and the IMU 24.

The display unit 29 displays predetermined information such as a target excavation landform of an excavation object under the control of the display controller 28. The input unit 36 is a touch panel or the like for making an input to the display unit and is operated for input by the operator. As a result of being operated by the operator, the input unit 36 generates an operation signal based on the operation and outputs the operation signal to the display controller 28.

The operating device 25 is arranged in the cab 4. The operating device 25 is operated by the operator. The operating device 25 receives operator's operation to drive the work machine 2. In the present embodiment, the operating device 25 is a pilot hydraulic operating device.

In the description below, oil supplied to the hydraulic cylinders (the boom cylinder 10, the arm cylinder 11, the bucket cylinder 12, and the tilt cylinder 30) to make the hydraulic cylinders operate will be referred to as hydraulic oil as appropriate. In the present embodiment, the amount of the hydraulic oil supplied to the hydraulic cylinders is adjusted by the directional control valve 64. The directional control valve 64 is made to operate by the supplied oil. In the description below, oil supplied to the directional control valve 64 to make the directional control valve 64 operate will be referred to as pilot oil as appropriate. In addition, the pressure of the pilot oil will be referred to as pilot oil pressure as appropriate.

The hydraulic oil and the pilot oil may be delivered by one hydraulic pump. For example, part of the hydraulic oil delivered by the hydraulic pump may be reduced in pressure by a pressure reducing valve, and the hydraulic oil reduced in pressure may be used as the pilot oil. Alternatively, a hydraulic pump (main hydraulic pump) for delivering the hydraulic oil and a hydraulic pump (pilot hydraulic pump) for delivering the pilot oil may be provided as separate hydraulic pumps.

The operating device 25 includes a first manipulation lever 25R, a second manipulation lever 25L, and a third manipulation lever 25P. The first manipulation lever 25R is arranged on the right side of the driver seat 4S, for example. The second manipulation lever 25L is arranged on the left side of the driver seat 4S, for example. The third manipulation lever 25P is arranged at the second manipulation lever 25L, for example. Alternatively, the third manipulation lever 25P may be arranged at the first manipulation lever 25R. With the first manipulation lever 25R and the second manipulation lever 25L, forward, backward, leftward, and rightward operations correspond to two-axis operations.

With the first manipulation lever 25R, the boom 6 and bucket 8 are operated. Manipulation of the first manipulation lever 25R in the front-back direction is associated with operation of the boom 6, and up operation and down operation of the boom 6 are executed according to the manipulation in the front-back direction. Manipulation of the first manipulation lever 25R in the left-right direction is associated with operation of the bucket 8, and excavation operation and release operation of the bucket 8 are executed according to the manipulation in the left-right direction.

With the second manipulation lever 25L, the arm 7 and the swing body 3 are operated. Manipulation of the second manipulation lever 25L in the front-back direction is associated with operation of the arm 7, and up operation and down operation of the arm 7 are executed according to the manipulation in the front-back direction. Manipulation of the second manipulation lever 25L in the left-right direction is associated with swinging of the swing body 3, and right swing operation and left swing operation of the swing body 3 are executed according to the manipulation in the left-right direction.

With the third manipulation lever 25P, the bucket 8 is operated. In the present embodiment, rotation of the bucket 8 about the bucket axis J3 is operated by the first manipulation lever 25R. Rotation (tilting) of the bucket 8 about the tilt axis J4 is operated by the third manipulation lever 25P.

In the present embodiment, the up operation of the boom 6 corresponds to dump operation. The down operation of the boom 6 corresponds to excavation operation. The down operation of the arm 7 corresponds to excavation operation. The up operation of the arm 7 corresponds to dump operation. The down operation of the bucket 8 corresponds to excavation operation. Alternatively, the down operation of the arm 7 may be referred to as bend operation. The up operation of the arm 7 may be referred to as extension operation.

Pilot oil delivered by the pilot hydraulic pump and reduced in pressure to the pilot oil pressure by the control valve is supplied to the operating device 25. The pilot oil pressure is adjusted on the basis of the amount of manipulation of the operating device 25, and the directional control valve 64 through which hydraulic oil to be supplied to the hydraulic cylinders (the boom cylinder 10, the arm cylinder 11, the bucket cylinder 12, and the tilt cylinder 40) flows is driven according to the pilot oil pressure. The pressure sensor 66 is arranged on a pilot hydraulic line 450. The pressure sensor 66 detects the pilot oil pressure. The detection result of the pressure sensor 66 is output to the work machine controller 26.

The first manipulation lever 25R is manipulated in the front-back direction to drive the boom 6. The directional control valve 64 through which the hydraulic oil to be supplied to the boom cylinder 10 to drive the boom 6 flows is driven according to the amount of manipulation (boom manipulation amount) of the first manipulation lever 25R in the front-back direction.

The first manipulation lever 25R is manipulated in the left-right direction to drive the bucket 8. The directional control valve 64 through which the hydraulic oil to be supplied to the bucket cylinder 12 to drive the bucket 8 flows is driven according to the amount of manipulation (bucket manipulation amount) of the first manipulation lever 25R in the left-right direction.

The second manipulation lever 25L is manipulated in the front-back direction to drive the arm 7. The directional control valve 64 through which the hydraulic oil to be supplied to the arm cylinder 11 to drive the arm 7 flows is driven according to the amount of manipulation (arm manipulation amount) of the second manipulation lever 25L in the front-back direction.

The second manipulation lever 25L is manipulated in the left-right direction to drive the swing body 3. The directional control valve 64 through which the hydraulic oil to be supplied to a hydraulic actuator to drive the swing body 3 flows is driven according to the amount of manipulation of the second manipulation lever 25L in the left-right direction.

The third manipulation lever 25P is manipulated to drive the bucket 8 (to rotate about the tilt axis J4). The directional control valve 64 through which the hydraulic oil to be supplied to the tilt cylinder 30 to tilt the bucket 8 flows is driven according to the amount of manipulation of the third manipulation lever 25P.

Alternatively, manipulation of the first manipulation lever 25R in the left-right direction may be associated with operation of the boom 6 and manipulation thereof in the front-back direction may be associated with operation of the bucket 8. Still alternatively, manipulation of the second manipulation lever 25L in the left-right direction may be associated with operation of the arm 7 and manipulation thereof in the front-back direction may be associated with the swing body 3.

The control valve 27 operates to adjust the amount of the hydraulic oil supplied to the hydraulic cylinders (the boom cylinder 10, the arm cylinder 11, the bucket cylinder 12, and the tilt cylinder 30). The control valve 27 operates on the basis of a control signal from the work machine controller 26.

The angle detector 22 detects the work machine angle data including the boom angle data indicating a turning angle $\alpha$ of the boom 6 about the boom axis J1, the arm angle data indicating a turning angle $\beta$ of the arm 7 about the arm axis J2, and the bucket angle data indicating a turning angle $\gamma$ of the bucket 8 about the bucket axis J3.

In the present embodiment, the angle detector 22 includes the first stroke sensor 16, the second stroke sensor 17, and the third stroke sensor 18. The detection result of the first stroke sensor 16, the detection result of the second stroke sensor 17, and the detection result of the third stroke sensor 18 are output to the sensor controller 32. The sensor controller 32 calculates the boom cylinder length on the basis of the detection result of the first stroke sensor 16. The first stroke sensor 16 outputs phase shift pulses generated with the revolving operation to the sensor controller 32. The sensor controller 32 calculates the boom cylinder length on the basis of the phase shift pulses output from the first stroke sensor 16. Similarly, the sensor controller 32 calculates the arm cylinder length on the basis of the detection result of the second stroke sensor 17. The sensor controller 32 calculates the bucket cylinder length on the basis of the detection result of the third stroke sensor 18.

The sensor controller 32 calculates the turning angle α of the boom 6 with respect to the vertical direction of the vehicle main body 1 from the boom cylinder length obtained on the basis of the detection result of the first stroke sensor 16. The sensor controller 32 calculates the turning angle β of the arm 7 with respect to the boom 6 from the arm cylinder length obtained on the basis of the detection result of the second stroke sensor 17. The sensor controller 32 calculates the turning angle γ of the blade edge 8*a* of the bucket 8 with respect to the arm 7 from the bucket cylinder length obtained on the basis of the detection result of the third stroke sensor 18.

Alternatively, the turning angle α of the boom 6, the turning angle β of the arm 7, and the turning angle γ of the bucket 8 may not be detected by the stroke sensors. The turning angle α of the boom 6 may be detected by an angle detector such as a rotary encoder. The angle detector detects a bend angle of the boom 6 with respect to the swing body 3 to detect the turning angle α. Similarly, the turning angle β of the arm 7 may be detected by an angle detector attached to the arm 7. The turning angle γ of the bucket 8 may be detected by an angle detector attached to the bucket 8.

The sensor controller 32 acquires the cylinder length data L and the work machine angle data from the first, second, and third stroke sensors 16, 17, and 18. The sensor controller 32 outputs the work machine turning angle data α to γ to the display controller 28 and to the work machine controller 26.

The display controller 28 acquires the vehicle main body position data P and the vehicle main body posture data Q from the position detector 20. The display controller 28 also acquires the tilt angle data indicating the tilt angle δ from the tilt angle sensor 70.

The display controller 28 includes a calculation unit 280A configured to perform a calculation process, a storage unit 280B storing data, and an acquisition unit 280C configured to acquire data.

The display controller 28 calculates target excavation landform data U on the basis of target construction information stored therein, the dimensions of the respective work machines, the vehicle main body position data P, the vehicle main body posture data Q, and the turning angle data α to γ of the respective work machines, and outputs the target excavation landform data U to the work machine controller 26.

The work machine controller 26 includes a work machine control unit 26A, and a storage unit 26C. The work machine controller 26 receives the target excavation landform data U from the display controller 28, and acquires the turning angle data α to γ of the respective work machines from the sensor controller 32. The work machine controller 26 generates a control command to the control valve 27 on the basis of the target excavation landform data U and the turning angle data α to γ of the work machine. The work machine controller 26 also issues an operation command to the pump controller 34 for using a tilt bucket.

The pump controller 34 issues a drive command to a hydraulic pump 41 for supplying hydraulic oil to the work machine 2. The pump controller 34 also issues commands to control valves 27D and 27E, which will be described later, to operate the tilt angle of the bucket 8.

[Stroke Sensor]

Figure 10:
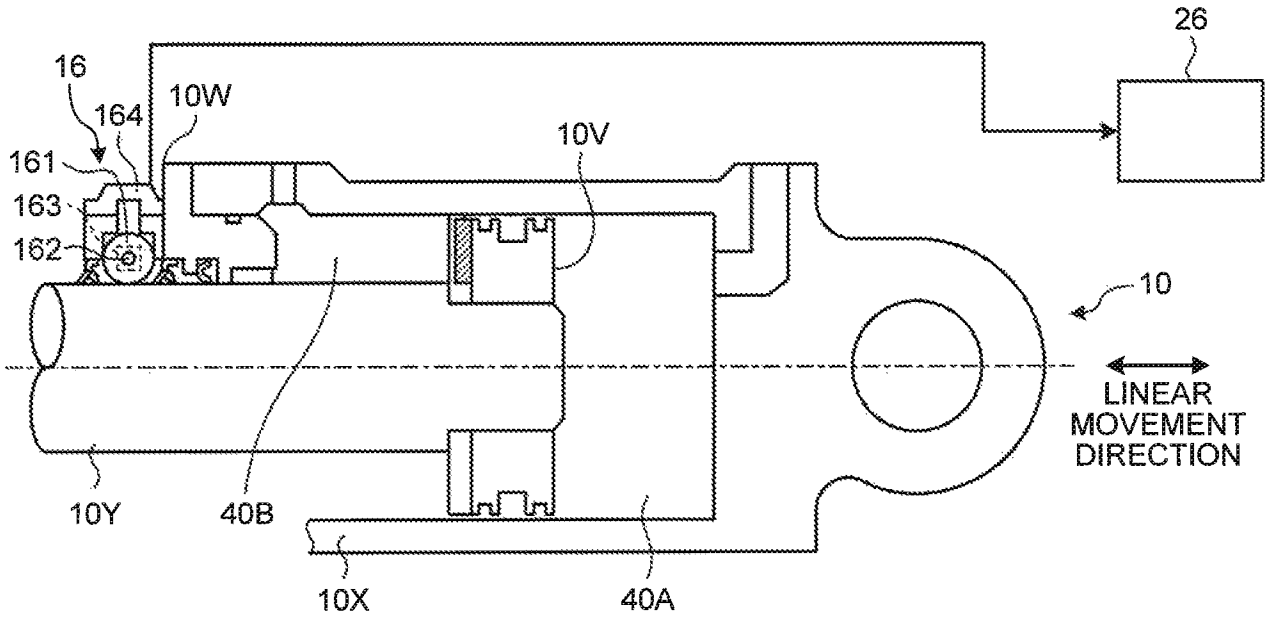
FIG. 10 is a diagram illustrating an example of a hydraulic cylinder.

Next, the stroke sensor 16 will be described with reference to FIGS. 10 and 11. In the description below, the stroke sensor 16 attached to the boom cylinder 10 will be described. This applies similarly to the stroke sensor 17 attached to the arm cylinder 11 and the like.

The stroke sensor 16 is attached to the boom cylinder 10. The stroke sensor 16 counts piston strokes. As illustrated in FIG. 10, the boom cylinder 10 includes a cylinder tube 10X and a cylinder rod 10Y movable relative to the cylinder tube 10X inside of the cylinder tube 10X. The cylinder tube 10X is provided with a piston 10V in a slidable manner. The cylinder rod 10Y is attached to the piston 10V. The cylinder rod 10Y is provided at a cylinder head 10W in a slidable manner. A chamber defined by the cylinder head 10W, the piston 10V, and a cylinder inner wall is a rod side oil chamber 40B. An oil chamber opposite to the rod side oil chamber 40B with the piston 10V therebetween is a cap side oil chamber 40A. Note that the cylinder head 10W is provided with a seal member sealing a gap between the cylinder head 10W and the cylinder rod 10Y to prevent dust and the like from entering the rod side oil chamber 40B.

When the hydraulic oil is supplied to the rod side oil chamber 40B and discharged from the cap side oil chamber 40A, the cylinder rod 10Y retracts. In addition, when the hydraulic oil is discharged from the rod side oil chamber 40B and supplied to the cap side oil chamber 40A, the cylinder rod 10Y extends. Thus, the cylinder rod 10Y moves linearly in the left-right direction in the drawings.

At a position outside of the rod side oil chamber 40B and in close contact with the cylinder head 10W, a case 164 that covers the stroke sensor 16 and accommodates the stroke sensor 16 therein is provided. The case 164 is fixed to the cylinder head 10W by being fastened to the cylinder head 10W by a bolt or the like.

The stroke sensor 16 includes a rotary roller 161, a rotation center shaft 162, and a rotation sensor unit 163. The rotary roller 161 has a surface in contact with the surface of the cylinder rod 10Y and is provided in a manner rotatable with the linear movement of the cylinder rod 10Y. Thus, the rotary roller 161 converts the linear movement of the cylinder rod 10Y into rotation. The rotation center shaft 162 is arranged perpendicular to the linear movement direction of the cylinder rod 10Y.

The rotation sensor unit 163 is configured to detect the rotation amount (turning angle) of the rotary roller 161 as an electrical signal. The signal indicating the rotation amount (turning angle) of the rotary roller 161 detected by the rotation sensor unit 163 is transmitted to the sensor controller 32 via an electrical signal line and converted to a position (stroke position) of the cylinder rod 10Y in the boom cylinder 10 by the work machine controller 26.

Figure 11:
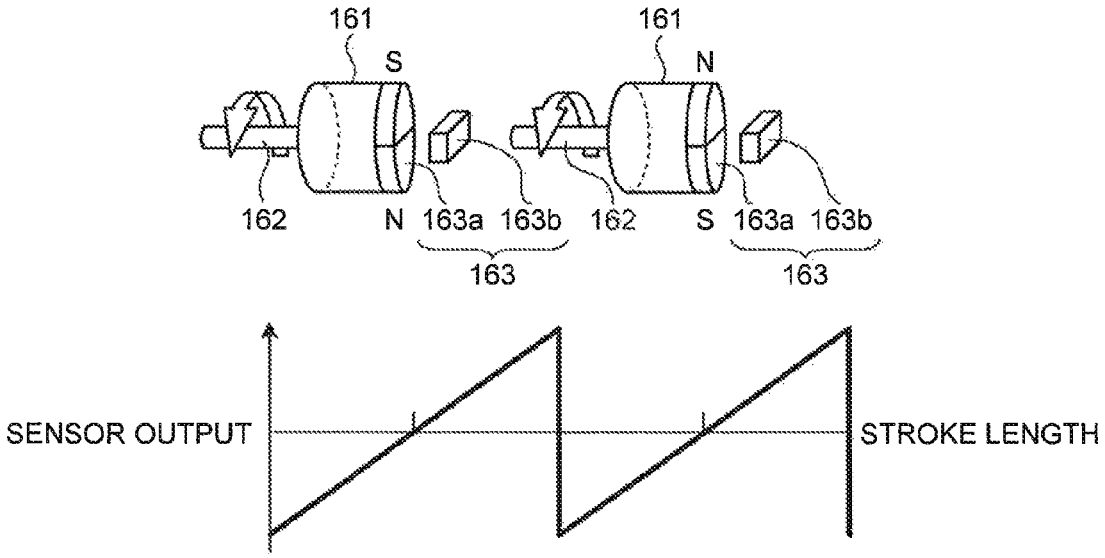
FIG. 11 is a diagram illustrating an example of a stroke sensor.

As illustrated in FIG. 11, the rotation sensor unit 163 includes a magnet 163*a* and a Hall IC 163*b*. The magnet 163*a* that is a detection medium is attached to the rotary roller 161 in a manner integrally rotatable with the rotary roller 161. The magnet 163*a* rotates with the rotation of the rotary roller 161 about the rotation center shaft 162. The magnet 163*a* is configured to switch between the north pole and the south pole according to the turning angle of the rotary roller 161. The magnet 163*a* is configured so that the magnetic force (magnetic flux density) detected by the Hall IC 163*b* changes periodically, where one rotation of the rotary roller 161 corresponds to one period.

The Hall IC 163*b* is a magnetic sensor configured to detect the magnetic force (magnetic flux density) generated by the magnet 163*a* as an electrical signal. The Hall IC 163*b* is provided at a position at a predetermined distance in the axial direction of the rotation center shaft 162 from the magnet 163*a*.

The electrical signal detected by the Hall IC 163*b* is transmitted to the work machine controller 26, and the electrical signal from the Hall IC 163*b* is converted to the rotation amount of the rotary roller 161, that is, a shift amount (stroke length) of the cylinder rod 10Y or the boom cylinder 10 by the work machine controller 26.

Here, the relation between the turning angle of the rotary roller 161 and the electrical signal (voltage) detected by the Hall IC 163*b* will be described with reference to FIG. 11. When the rotary roller 161 and the magnet 163*a* rotates with the rotation, the magnetic force (magnetic flux density) passing through the Hall IC 163*b* changes periodically with the turning angle and the electrical signal (voltage) that is a sensor output changes periodically. The turning angle of the rotary roller 161 can be measured from the magnitude of the voltage output from the Hall IC 163*b*.

In addition, the rotation speed of the rotary roller 161 can be measured by counting the number of repeated periods of the electrical signal (voltage) output from the Hall IC 163*b*. The shift amount (stroke length) of the cylinder rod 10Y of the boom cylinder 10 is then detected on the basis of the turning angle of the rotary roller 161 and the rotation speed of the rotary roller 161.

The stroke sensor 16 can also detect the moving speed (cylinder speed) of the cylinder rod 10Y on the basis of the turning angle of the rotary roller 161 and the turning speed of the rotary roller 161.

[Hydraulic System]

Next, an example of a hydraulic system 300 according to the present embodiment will be described. The control system 200 includes the hydraulic system 300 and the work machine controller 26. The boom cylinder 10, the arm cylinder 11, the bucket cylinder 12, and the tilt cylinder 30 are hydraulic cylinders. The hydraulic cylinders are operated by the hydraulic system 300.

Figure 13:
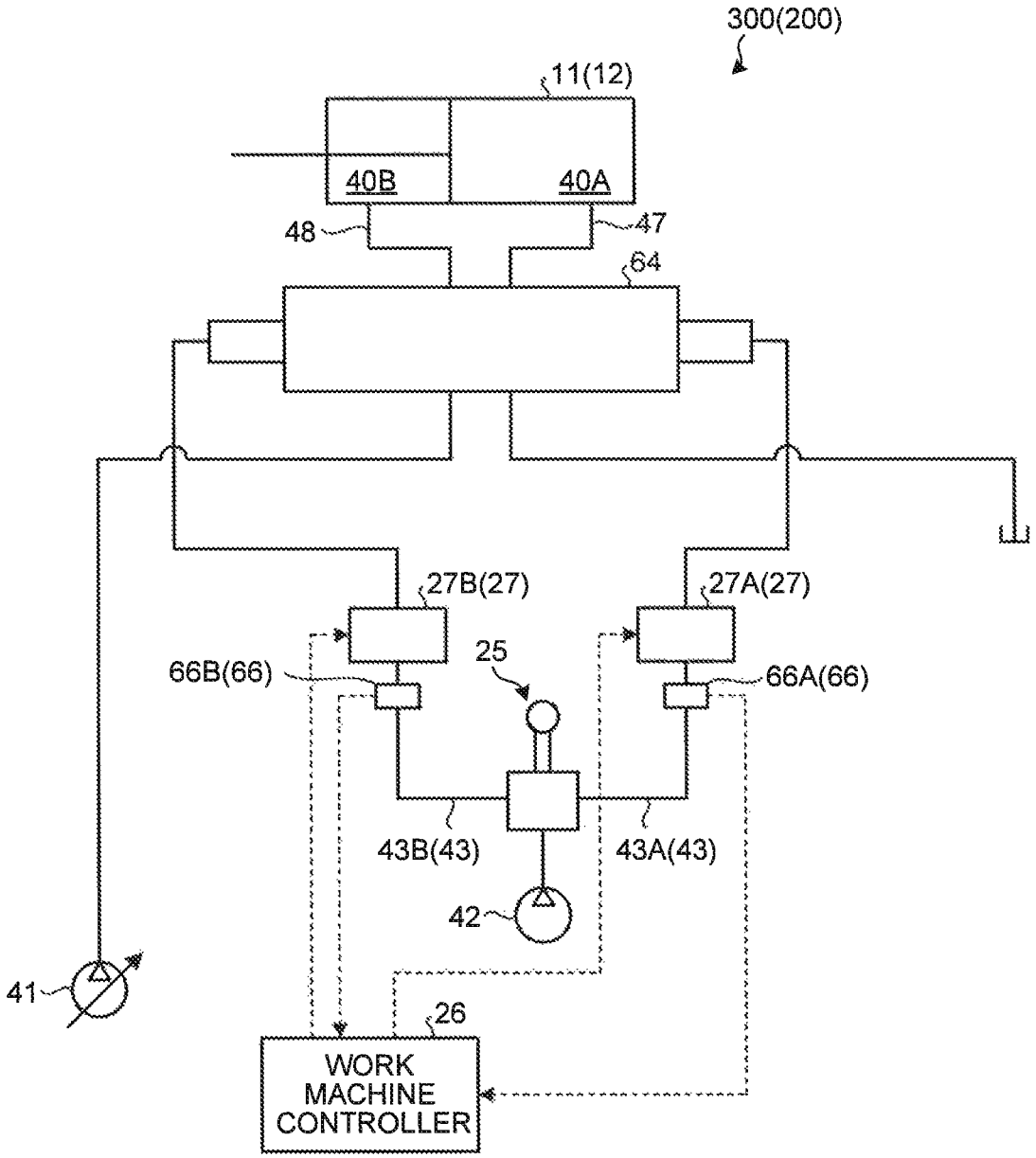
FIG. 13 is a diagram illustrating an example of a hydraulic system.

FIG. 13 is a diagram schematically illustrating the hydraulic system 300 including the arm cylinder 11. Note that the same applies to the bucket cylinder 12. The hydraulic system 300 includes a discharge displacement main hydraulic pump 41 to supply hydraulic oil to the arm cylinder 11 via the directional control valve 64, a pilot hydraulic pump 42 to supply pilot oil, the operating device 25 to adjust the pilot oil pressure of the pilot oil to the directional control valve 64, oil passages 43 (43A, 43B) through which pilot oil flows, control valves 27 (27A, 27B) arranged in the oil passage 43, pressure sensors 66 (66A, 66B) arranged in the oil passage 43, and the work machine controller 26 to control the control valves 27. The oil passage 43 is the same as the pilot hydraulic line 450 in FIG. 9.

The directional control valve 64 controls the direction in which hydraulic oil flows. Hydraulic oil supplied from the main hydraulic pump 41 is supplied to the arm cylinder 11 via the directional control valve 64. The directional control valve 64 is of a spool type that switches the direction in which hydraulic oil flows by moving a rod-like spool. As a result of movement of the spool in the axial direction, supply of hydraulic oil is switched between supply to the cap side oil chamber 40A (oil passage 47) of the arm cylinder 11 and supply to the rod side oil chamber 40B (oil passage 48). In addition, as a result of the movement of the spool in the axial direction, the amount (supply amount per unit time) of hydraulic oil supplied to the arm cylinder 11 is adjusted. As a result of the adjustment of the amount of hydraulic oil supplied to the arm cylinder 11, the cylinder speed is adjusted.

Driving of the directional control valve 64 is adjusted by the operating device 25. In the present embodiment, the operating device 25 is a pilot hydraulic operating device. Pilot oil delivered from the pilot hydraulic pump 42 is supplied to the operating device 25. Alternatively, pilot oil delivered from the main hydraulic pump 41 and reduced in pressure by a pressure reducing valve may be supplied to the operating device 25. The operating device 25 includes a pilot oil pressure regulating valve. The pilot oil pressure is adjusted on the basis of the manipulation amount of the operating device 25. The pilot oil pressure drives the directional control valve 64. As a result of adjusting the pilot oil pressure by the operating device 25, the movement amount in the axial direction and the moving speed of the spool are adjusted.

Two oil passages 43 through which pilot oil flows are provided for one directional control valve 64. Pilot oil to be supplied to one space (first pressure receiving chamber) of the spool of the directional control valve 64 flows through one oil passage 43A of the two oil passages 43A and 43B. Pilot oil to be supplied to the other space (second pressure receiving chamber) of the directional control valve 64 flows through the other oil passage 43B.

The pressure sensors 66 are arranged in the oil passages 43. The pressure sensors 66 detects the pilot oil pressure. The pressure sensors 66 includes the pressure sensor 66A configured to detect the pilot oil pressure in the oil passage 43A, and the pressure sensor 66B configured to detect the pilot oil pressure in the oil passage 43B. The detection results of the pressure sensors 66 are output to the work machine controller 26.

The control valves 27 are electromagnetic proportional control valves and can adjust the pilot oil pressure on the basis of a control signal from the work machine controller 26. The control valves 27 include the control valve 27A capable of adjusting the pilot oil pressure in the oil passage 43A and the control valve 27B capable of adjusting the pilot oil pressure in the oil passage 43B.

For adjusting the pilot oil pressure by manipulation of the operating device 25, the control valves 27 are fully opened. When the manipulation lever of the operating device 25 is moved toward one side of the neutral position, the pilot oil pressure corresponding to the amount of manipulation of the manipulation lever is applied to the first pressure receiving chamber of the spool of the directional control valve 64. When the manipulation lever of the operating device 25 is moved toward the other side of the neutral position, the pilot oil pressure corresponding to the amount of manipulation of the manipulation lever is applied to the second pressure receiving chamber of the spool of the directional control valve 64.

The spool of the directional control valve 64 moves by a distance corresponding to the pilot oil pressure adjusted by the operating device 25. For example, as a result of the pilot oil pressure being applied to the first pressure receiving chamber, hydraulic oil from the main hydraulic pump 41 is supplied to the cap side oil chamber 40A of the arm cylinder 11, and the arm cylinder 11 extends. As a result of the pilot oil pressure being applied to the second pressure receiving chamber, hydraulic oil from the main hydraulic pump 41 is supplied to the rod side oil chamber 40B of the arm cylinder 11, and the arm cylinder 11 retracts. The amount of hydraulic oil per unit time supplied to the arm cylinder 11 via the directional control valve 64 from the main hydraulic pump 41 is adjusted on the basis of the movement amount of the spool of the directional control valve 64. As a result of adjusting the supply amount of hydraulic oil per unit time, the cylinder speed is adjusted.

The work machine controller 26 can adjust the pilot oil pressure by controlling the control valves 27. For example, in the limited excavation control (interventional control), the work machine controller 26 drives the control valves 27. For example, as a result of driving the control valve 27A by the work machine controller 26, the spool of the directional control valve 64 moves by a distance corresponding to the pilot oil pressure adjusted by the control valve 27A. As a result, hydraulic oil from the main hydraulic pump 41 is supplied to the cap side oil chamber 40A of the arm cylinder 11, and the arm cylinder 11 extends. As a result of driving the control valve 27B by the work machine controller 26, the spool of the directional control valve 64 moves by a direction corresponding to the pilot oil pressure adjusted by the control valve 27B. As a result, hydraulic oil from the main hydraulic pump 41 is supplied to the rod side oil chamber 40B of the arm cylinder 11, and the arm cylinder 11 retracts. The amount of hydraulic oil per unit time supplied to the arm cylinder 11 from the main hydraulic pump 41 via the directional control valve 64 is adjusted on the basis of the movement amount of the spool of the directional control valve 64. As a result of adjusting the supply amount of hydraulic oil per unit time, the cylinder speed is adjusted.

Figure 14:
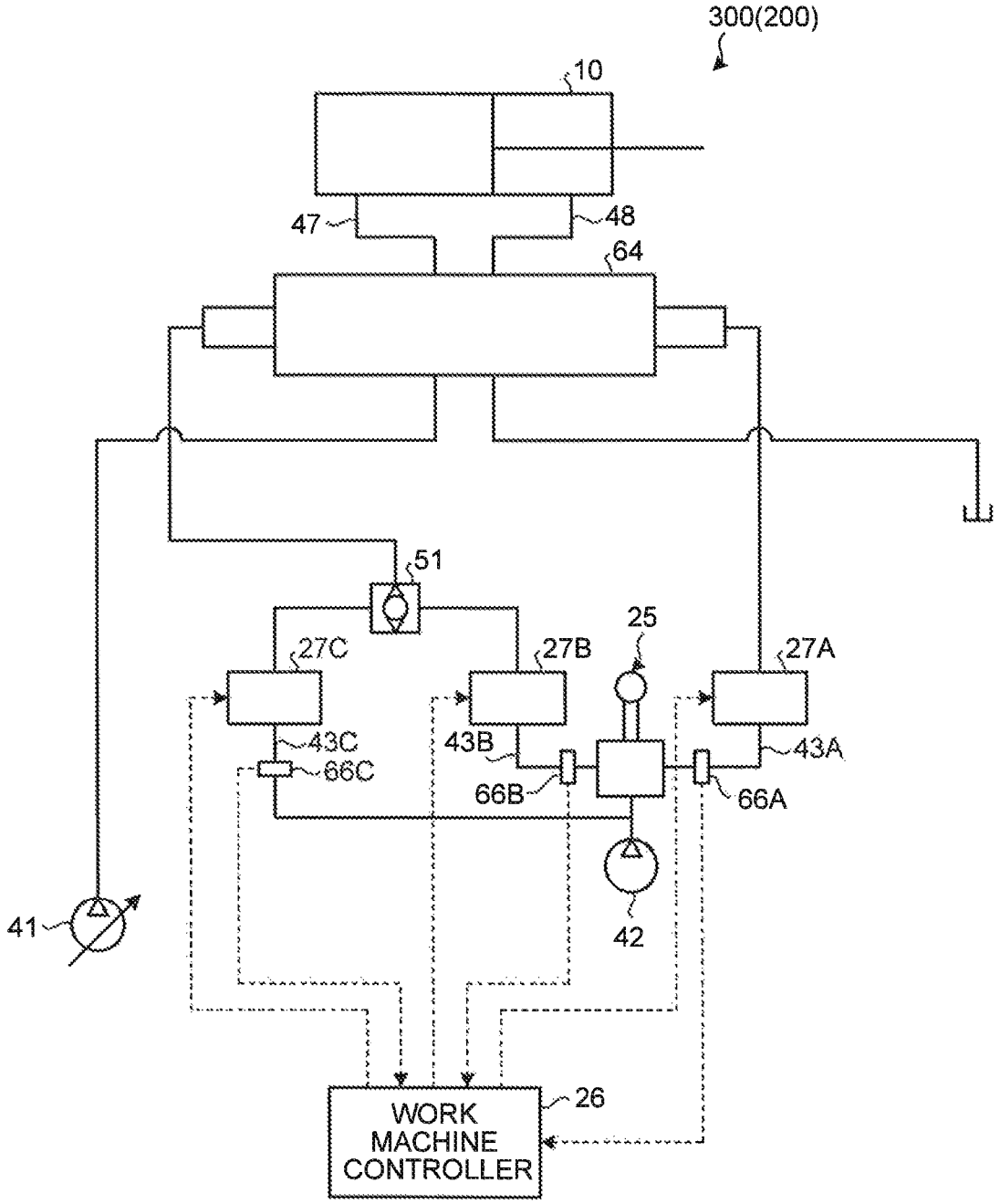
FIG. 14 is a diagram illustrating an example of the hydraulic system.

FIG. 14 is a diagram schematically illustrating an example of the hydraulic system including the boom cylinder 10. As a result of manipulation of the operating device 25, the boom 6 executes two types of operation, which are down operation and up operation. As described with reference to FIG. 13, as a result of manipulation of the operating device 25, the pilot oil pressure corresponding to the amount of manipulation of the operating device 25 is applied to the directional control valve 64. The spool of the directional control valve 64 moves according to the pilot oil pressure. The amount of hydraulic oil per unit time supplied to the boom cylinder 10 from the main hydraulic pump 41 via the directional control valve 64 is adjusted on the basis of the moving amount of the spool.

The work machine controller 26 can also adjust the pilot oil pressure applied to the second pressure receiving chamber by driving the control valve 27A. The work machine controller 26 can adjust the pilot oil pressure applied to the first pressure receiving chamber by driving the control valve 27B. In the example illustrated in FIG. 14, as a result of pilot oil being supplied to the directional control valve 64 via the control valve 27, down operation of the boom 6 is executed. As a result of pilot oil being supplied to the directional control valve 64 via the control valve 27B, up operation of the boom 6 is executed.

In the present embodiment, for the interventional control, a control valve 27C configured to operate on the basis of a control signal for interventional control output from the work machine controller 26 is provided in an oil passage 43C. Pilot oil delivered from the pilot hydraulic pump 42 flows through the oil passage 43C. The oil passage 43C is connected to the oil passage 43B via a shuttle valve 51. The shuttle valve 51 selects and outputs an input from an oil passage with a larger supplied pressure among the connected oil passages.

The oil passage 43C is provided with the control valve 27C and a pressure sensor 66C configured to detect the pilot oil pressure in the oil passage 43C. The control valve 27C is controlled on the basis of a control signal output from the work machine controller 26 for executing the interventional control.

When the interventional control is not to be executed, the work machine controller 26 does not output a control signal to the control valve 27C so that the directional control valve 64 is driven on the basis of the pilot oil pressure adjusted by manipulation of the operating device 25. For example, the work machine controller 26 fully opens the control valve 27B and closes the oil passage 43C with the control valve 27C so that the directional control valve 64 is driven on the basis of the pilot oil pressure adjusted by manipulation of the operating device 25.

When the interventional control is to be executed, the work machine controller 26 controls the control valves 27 so that the directional control valve 64 is driven on the basis of the pilot oil pressure adjusted by the control valve 27C. For example, when the interventional control to limit movement of the boom 6 is to be executed, the work machine controller 26 controls the control valve 27C so that the pilot oil pressure adjusted by the control valve 27C is higher than the pilot oil pressure adjusted by the operating device 25. The pilot pressure supplied through the oil passage 43C becomes higher than the pilot pressure supplied through the oil passage 43B. As a result, the pilot oil from the control valve 27C is supplied to the directional control valve 64 via the shuttle valve 51.

As a result of the pilot oil being supplied to the directional control valve 64 via at least one of the oil passage 43B and the oil passage 43C, hydraulic oil is supplied to the cap side oil chamber 40A via the oil passage 47. As a result, the boom 6 executes up operation.

When up operation of the boom 6 is executed at a high speed by the operation device 25 so that the bucket 8 will not enter the target excavation landform, the interventional control is not executed. As a result of manipulating the operating device 25 so that up operation of the boom 6 is executed at a high speed and adjusting the pilot oil pressure on the basis of the manipulation amount, the pilot oil pressure adjusted by the manipulation of the operating device 25 becomes higher than the pilot oil pressure adjusted by the control valve 27C. As a result, pilot oil at the pilot oil pressure adjusted by the manipulation of the operating device 25 is supplied to the directional control valve 64 via the shuttle valve 51.

Figure 15:
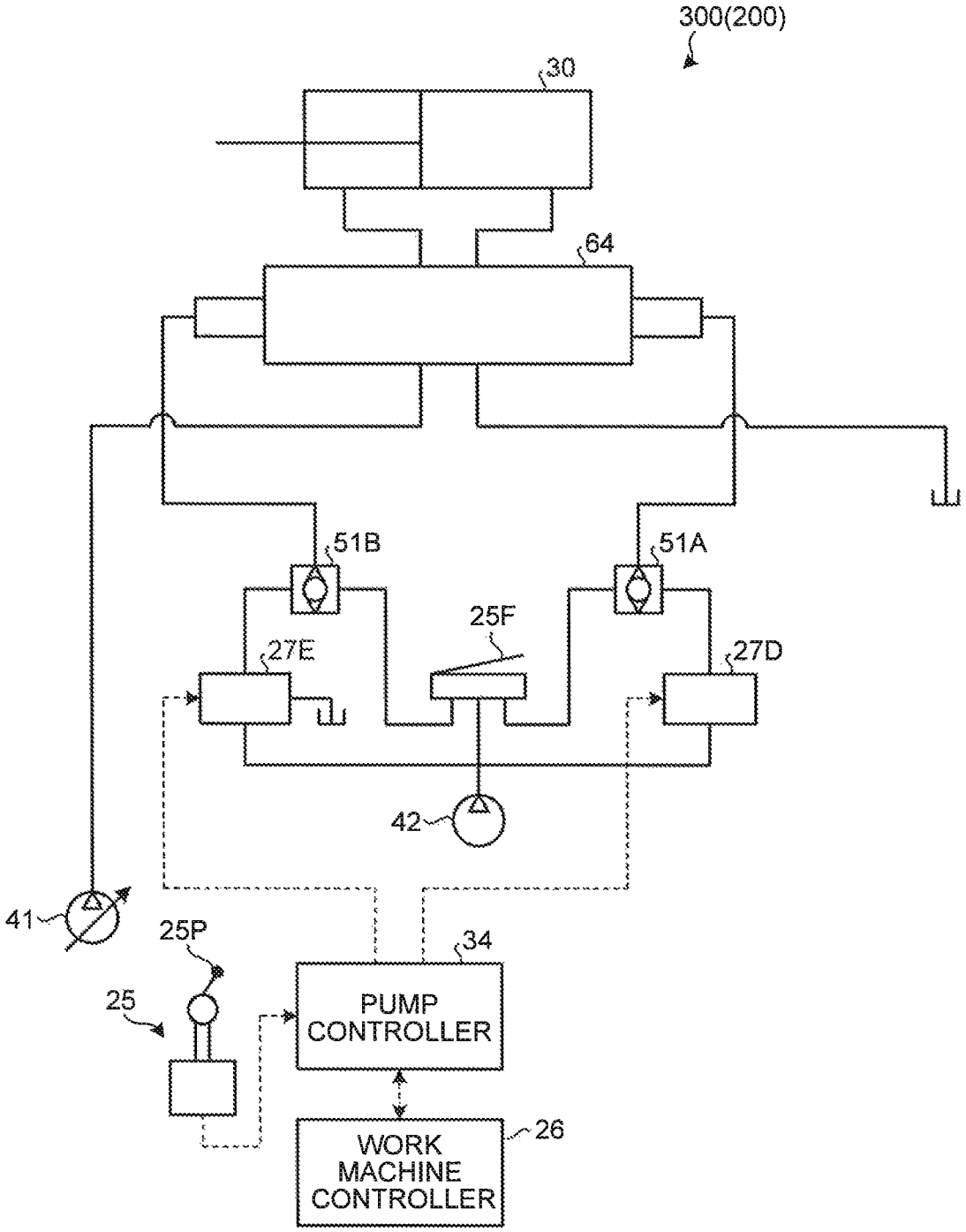
FIG. 15 is a diagram illustrating an example of the hydraulic system.

FIG. 15 is a diagram schematically illustrating an example of the hydraulic system 300 including the tilt cylinder 30. The hydraulic system 300 includes a directional control valve 64 to adjust the amount of hydraulic oil supplied to the tilt cylinder 30, the control valve 27D and the control valve 27E to adjust the pressure of pilot oil supplied to the directional control valve 64, a manipulation pedal 25F, and the pump controller 34. The pump controller 34 outputs a command signal to a swash plate of the main hydraulic pump 41 to control the amount of hydraulic oil supplied to the hydraulic cylinders. The control valves 27 are controlled by a control signal generated by the pump controller 34 on the basis of an operation signal from the operating device 25 (third manipulation lever 25P).

In the present embodiment, the operation signal generated by the manipulation of the third manipulation lever 25P is output to the pump controller 34. Alternatively, the operation signal generated by the manipulation of the third manipulation lever 25P may be output to the work machine controller 26. The control valves 27 may be controlled by the pump controller 34 or may be controlled by the work machine controller 26.

In the present embodiment, the operating device 25 includes the manipulation pedal 25F for adjusting the pilot pressure applied to the directional control valve 64. The manipulation pedal 25F is arranged in the cab 4 and manipulated by the operator. The manipulation pedal 25F is connected to the pilot hydraulic pump 42. The manipulation pedal 25F is also connected to an oil passage through which pilot oil delivered from the control valve 27D flows via a shuttle valve 51A. The manipulation pedal 25F is also connected to an oil passage through which pilot oil delivered from the control valve 27E flows via a shuttle valve 51B.

As a result of manipulation of the manipulation pedal 25F, the pressure in the oil passage between the manipulation pedal 25F and the shuttle valve 51A and the pressure in the oil passage between the manipulation pedal 25F and the shuttle valve 51B are adjusted.

As a result of manipulation of the third manipulation lever 25P, an operation signal (command signal) on the basis of the manipulation of the third manipulation lever 25P is output to the pump controller 34 (or the work machine controller 26). The pump controller 34 outputs a control signal to at least one of the control valve 27D and the control valve 27E on the basis of the operation signal output from the third manipulation lever 25P. The control valve 27D that has acquired the control signal is driven and opens/closes the oil passage. The control valve 27E that has acquired the control signal is driven and opens/closes the oil passage.

As a result of manipulation of at least one of the manipulation pedal 25F and the third manipulation lever 25P, when the pilot oil pressure adjusted by the control valve 27D is higher than the pilot oil pressure adjusted by the manipulation pedal 25F, the pilot oil at the pilot oil pressure selected by the shuttle valve 51A and adjusted by the control valve 27D is supplied to the directional control valve 64. When the pilot oil pressure adjusted by the manipulation pedal 25F is higher than the pilot oil pressure adjusted by the control valve 27D, the pilot oil at the pilot oil pressure adjusted by the manipulation pedal 25F is supplied to the directional control valve 64.

As a result of manipulation of at least one of the manipulation pedal 25F and the third manipulation lever 25P, when the pilot oil pressure adjusted by the control valve 27E is higher than the pilot oil pressure adjusted by the manipulation pedal 25F, the pilot oil at the pilot oil pressure selected by the shuttle valve 51B and adjusted by the control valve 27E is supplied to the directional control valve 64. When the pilot oil pressure adjusted by the manipulation pedal 25F is higher than the pilot oil pressure adjusted by the control valve 27E, the pilot oil at the pilot oil pressure adjusted by the manipulation pedal 25F is supplied to the directional control valve 64.

[Restricted Excavation Control]

Figure 12:
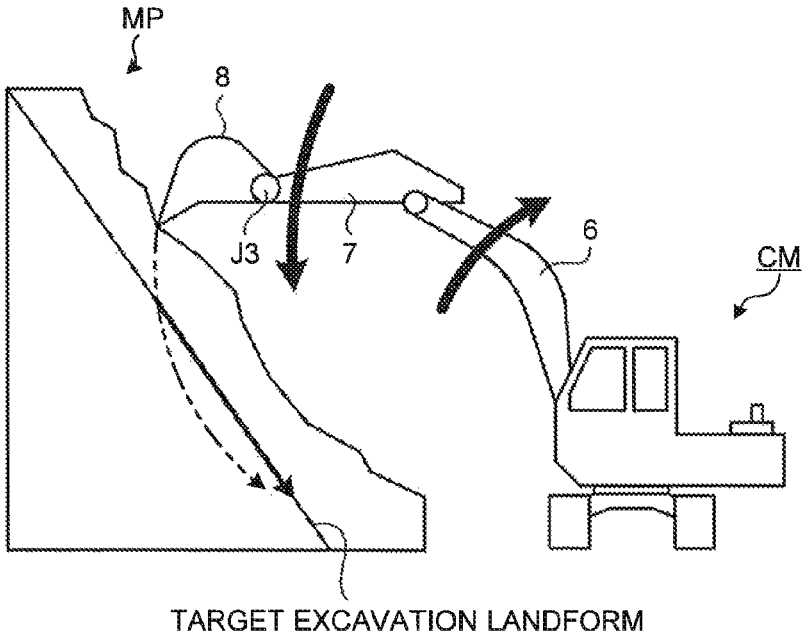
FIG. 12 is a diagram for explaining an example of limited excavation control.

FIG. 12 is a diagram schematically illustrating an example of operation of the work machine 2 when the limited excavation control is executed. In the present embodiment, the limited excavation control is executed so that the bucket 8 will not enter the target excavation landform representing a two-dimensional target shape of the excavation object on a work machine operation plane MP perpendicular to the bucket axis J3.

In excavation using the bucket 8, the hydraulic system 300 operates so that the boom 6 is raised for the excavation operation of the arm 7 and the bucket 8. In excavation, the interventional control including operation of the boom 6 is executed so that the bucket 8 will not enter the target excavation landform.

[Control Method]

Figure 16:
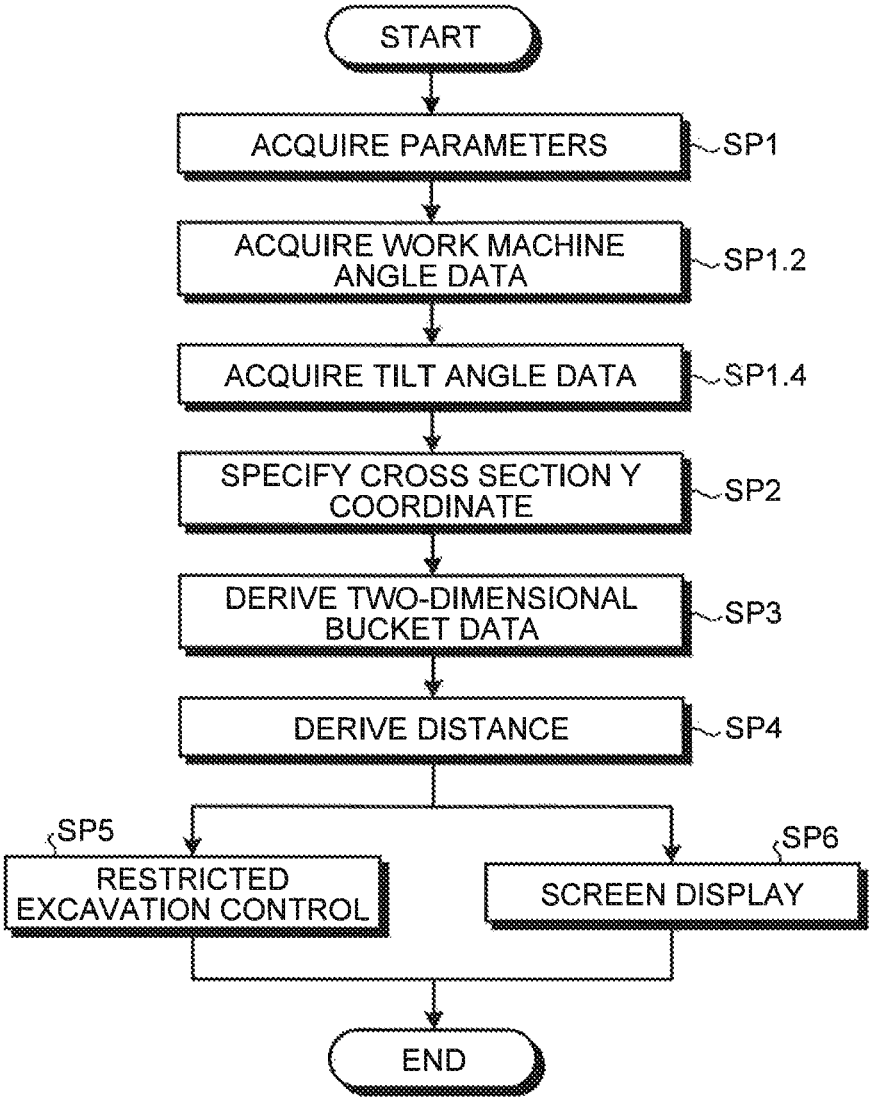
FIG. 16 is flowchart illustrating an example of a method for controlling a construction machine.

An example of a method for controlling the excavator CM according to the present embodiment will be described with reference to the flowchart of FIG. 16. The display controller 28 acquires various parameters used for excavation control (step SP1). The parameters are acquired by an acquisition unit 28C of the display controller 28.

Figure 17A:
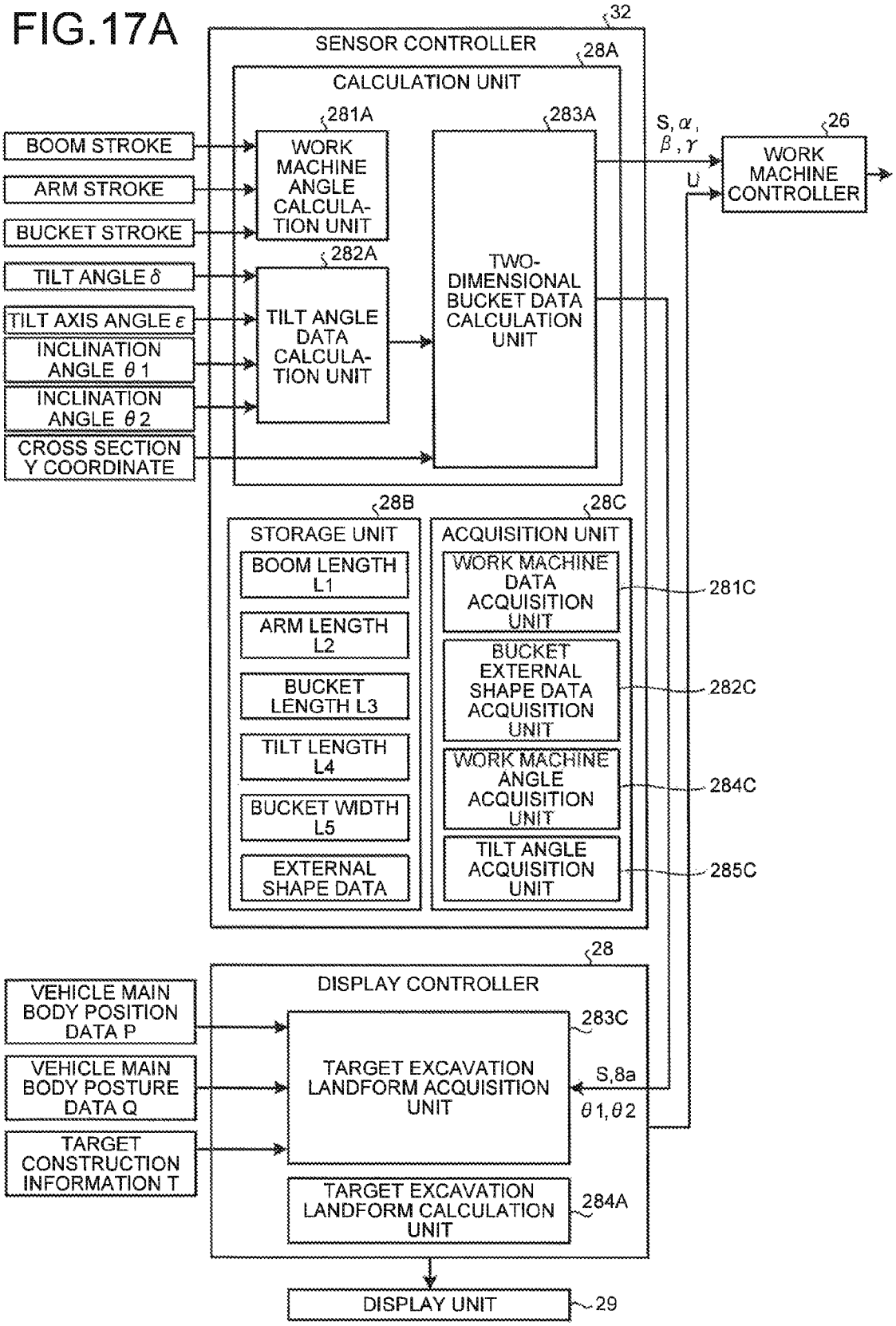
FIG. 17A is a functional block diagram illustrating an example of a control system.

FIG. 17A is a functional block diagram illustrating an example of the display controller 28, the work machine controller 26, and the sensor controller 32 according to the present embodiment. The sensor controller 32 includes a calculation unit 28A, a storage unit 28B, and the acquisition unit 28C. The calculation unit 28A includes a work machine angle calculation unit 281A, a tilt angle data calculation unit 282A, and a two-dimensional bucket data calculation unit 283A. The acquisition unit 28C includes a work machine data acquisition unit 281C, a bucket external shape data acquisition unit 282C, a work machine angle acquisition unit 284C, and a tilt angle acquisition unit 285C.

Figure 17B:
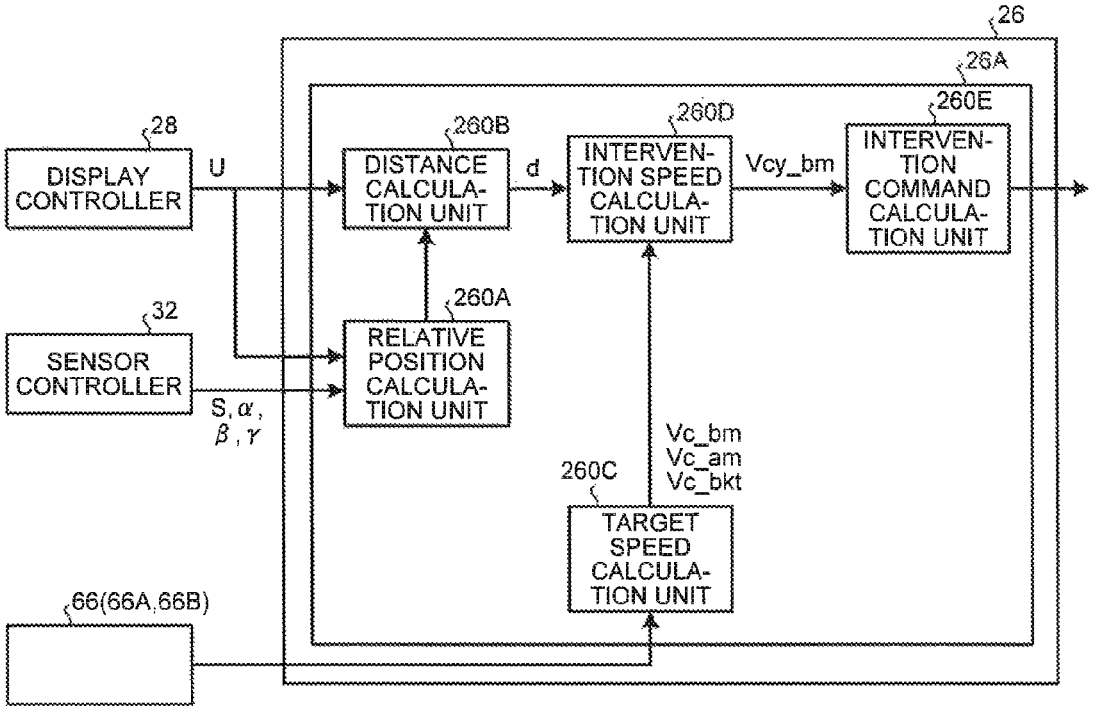
FIG. 17B is a functional block diagram illustrating an example of the control system.

FIG. 17B is a functional block diagram illustrating an example of the work machine control unit 26A of the work machine controller 26 according to the present embodiment. As illustrated in FIG. 17B, the work machine control unit 26A of the work machine controller 26 includes a relative position calculation unit 260A, a distance calculation unit 260B, a target speed calculation unit 260C, an intervention speed calculation unit 260D, and an intervention command calculation unit 260E. The work machine control unit 26A controls the speed of the boom 6 so that the relative speed at which the bucket 8 approaches the target excavation landform is lowered according to the distance d between the target excavation landform and the bucket 8 (blade edge 8*a*) on the basis of the target excavation landform data U indicating the target excavation landform that is a target shape of the excavation object and the bucket position data indicating the position of the bucket 8 (blade edge 8*a*). In the work machine controller 26, calculation is executed in the local coordinate system.

As illustrated in FIG. 17A, the display controller 283C includes a target excavation landform acquisition unit 283C and a target excavation landform calculation unit 284A.

The acquisition unit 28C includes the work machine data acquisition unit (first acquisition unit) 281C, the bucket external shape data acquisition unit (second acquisition unit) 282C, the work machine angle acquisition unit (fourth acquisition unit) 284C configured to acquire the work machine angle data, and the tilt angle acquisition unit (fifth acquisition unit) 285C configured to acquire the tilt angle data. The target excavation landform acquisition unit (third acquisition unit) 283C is included in the display controller 28.

The calculation unit 28A includes the work machine angle calculation unit 281A configured to calculate the work machine angle, and the two-dimensional bucket data calculation unit 283A configured to calculate two-dimensional bucket data. The relative position calculation unit 260A configured to calculate relative positions of the target excavation landform and the bucket 8 is included in the work machine controller 26 (work machine control unit 26A). The target excavation landform calculation unit 284A is included in the display controller 28.

The work machine angle calculation unit 281A acquires the boom cylinder length from the first stroke sensor 16 and calculates the boom angle α. The work machine angle calculation unit 281A acquires the arm cylinder length from the second stroke sensor 17, and calculates the arm angle β. The work machine angle calculation unit 281A acquires the bucket cylinder length from the third stroke sensor 18, and calculates the bucket angle γ. The work machine angle acquisition unit 284C acquires the work machine angle data including the boom angle data, the arm angle data, and the bucket angle data (step SP1.2).

The acquisition unit 28C (work machine angle acquisition unit 284C) of the sensor controller 32 acquires the work machine angle data including the boom angle data indicating the boom angle α, the arm angle data indicating the arm angle β, and the bucket angle data indicating the bucket angle γ on the basis of the detection result of the angle detector 22. The acquisition unit 28C (tilt angle acquisition unit 285C) also acquires the tilt angle data including the tilt angle δ' indicating the turning angle of the bucket about the tilt axis, which will be described later, on the basis of the detection result of the tilt angle sensor 70. The acquisition unit 28C (tilt angle acquisition unit 285C) also acquires the tilt axis angle data including the tilt axis angle ϵ' indicating the turning angle of the bucket about the tilt axis on the basis of the detection result of the angle detector 22. In driving of the work machine 2, the angle detector 22 and the tilt angle sensor 70 monitors the boom angle α, the arm angle β, the bucket angle γ, the tilt angle δ, and the tilt axis angle ϵ. The acquisition unit 28C acquires the angle data in real time in driving of the work machine 2.

Alternatively, the boom angle α, the arm angle β, and the bucket angle γ may not be detected by the stroke sensors. The boom angle α may be detected by an inclination angle sensor attached to the boom 6. The arm angle β may be detected by an inclination angle sensor attached to the arm 7. The bucket angle γ may be detected by an inclination angle sensor attached to the bucket 8. When the angle detector 22 includes inclination angle sensors, the work machine angle data acquired by the angle detector 22 is output to the sensor controller 32.

The tilt angle sensor 70 detects the tilt angle data indicating the tilt angle δ of the bucket 8 about the tilt axis J4. The tilt angle data acquired by the tilt angle sensor 70 is output to the sensor controller 32 via the display controller 28. The tilt angle acquisition unit 285C acquires the tilt angle data indicating the turning angle of the bucket about the tilt axis (step SP1.4).

With the rotation of the bucket 8 about the bucket axis J3, the tilt pin 80 (tilt axis J4) also rotates (inclines) in the θY direction. The tilt angle acquisition unit 285C acquires the tilt axis angle data indicating the inclination angle ϵ of the tilt axis J4 with respect to the XY plane on the basis of the detection result of the angle detector 22.

The storage unit 28B of the sensor controller 32 stores work machine data. The work machine data includes dimension data of the work machine 2 and external shape data of the bucket 8.

The dimension data of the work machine 2 includes dimension data of the boom 6, dimension data of the arm 7, and dimension data of the bucket 8. The dimension data of the work machine 2 includes the boom length L1, the arm length L2, the bucket length L3, and the tilt length L4. The boom length L1, the arm length L2, the bucket length L3, and the tilt length L4 are dimensions in the XZ plane (in the vertical rotation plane).

The work machine data acquisition unit 281C acquires the dimension data of the work machine 2 including the dimension data of the boom 6, the dimension data of the arm 7, and the dimension data of the bucket 8 from the storage unit 28B.

The external shape data of the bucket 8 includes contour data of the external surface of the bucket 8. The external shape data of the bucket 8 is data for determining the dimension and the shape of the bucket 8. The external shape data of the bucket 8 includes front end portion position data indicating the position of the front end portion 8*a* of the bucket 8. The external shape data of the bucket 8 includes coordinate data of multiple positions on the external surface of the bucket 8 based on the front end portion 8*a*, for example.

The external shape data of the bucket 8 includes the dimension L5 of the bucket 8 in the width direction. When the bucket 8 is not tilted, the width dimension L5 of the bucket 8 is a dimension of the bucket 8 in the Y-axis direction in the local coordinate system. When the bucket 8 is tilted, the width dimension L5 of the bucket 8 and the dimension of the bucket 8 in the Y-axis direction in the local coordinate system differ from each other.

The bucket external shape data acquisition unit 282C acquires the external shape data from the storage unit 28B.

In the present embodiment, note that both of the work machine dimension data including the boom length L1, the arm length L2, the bucket length L3, the tilt length L4, and the bucket width L5 and the bucket external shape data including the external shape of the bucket 8 are stored in the storage unit 28B.

The work machine angle calculation unit 281A calculates the work machine angle data that is the turning angles of the respective work machines from the cylinder strokes of the boom 6, the arm 7, and the bucket 8.

The tilt angle calculation unit 282A acquires δ' that is the tilt angle data indicating the turning angle of the bucket 8 about the tilt axis and the tilt axis angle ϵ' from the tilt angle δ, the tilt axis angle ϵ, and the inclination angles θ1 and θ2.

The two-dimensional bucket data calculation unit 283A generates two-dimensional bucket data S indicating the external shape of the bucket 8 in the work machine operation plane MP and the blade edge position Pa of the blade edge 8*a* of the bucket 8 on the basis of the work machine angle data the work machine dimension data, the external shape data of the bucket 8, a Y coordinate of a cross section and the tilt angle data.

The target excavation landform acquisition unit 283C acquires the vehicle main body position data P and the vehicle main body posture data Q from the target construction information T indicating three-dimensional designed landform that is a three-dimensional target shape of the excavation object and the position detector 20. The target excavation landform calculation unit 284A generates target excavation landform data U indicating the target excavation landform that is a two-dimensional target shape of the excavation object on the work machine operation plane MP perpendicular to the bucket axis J3 from the data acquired by the target excavation landform acquisition unit 283C, the inclination angles θ1 and θ2 acquired by the two-dimensional bucket data calculation unit 283A, the two-dimensional bucket data S indicating the external shape of the bucket 8 and the blade edge 8*a* of the bucket 8.

The relative position calculation unit 260A calculates a relative position on a bucket 8 at the shortest distance to the target excavation landform on a contour point Ni of the bucket 8, which will be described later, on the basis of the turning angle data α to γ of the work machines input by the sensor controller 32, the two-dimensional bucket data S, and the target excavation landform data U input by the display controller 28, and outputs the relative position to the distance calculation unit 260B. The distance calculation unit 260B calculates the shortest distance d between the target excavation landform and the bucket 8 on the basis of the target excavation landform and the relative position of the bucket 8.

The target speed calculation unit 260C inputs the pressures from the pilot pressure sensors 66A and 66B based on the lever manipulation of the work machine levers, which will be described later. The target speed calculation unit 260C derives target speeds Vc_bm, Vc_am, and Vc_bk of the respective work machines by using a table defining the relation of the target speeds of the respective work machines to the pressures stored in the storage unit 27C by the pressure sensors 66A and 66B, and outputs the target speeds to the intervention speed calculation unit 260D.

The intervention speed calculation unit 260D calculates a speed limit according to the distance d between the target excavation landform and the relative position of the bucket 8 on the basis of the target speeds of the respective work machines, the target excavation landform data U and the distance d of the bucket 8. The speed limit is output as a speed of intervention in the boom work machine to the intervention command calculation unit 260E.

The intervention command calculation unit 260E determines as an intervention command to the boom cylinder 10 associated with the speed limit to extend. The intervention command calculation unit 260E outputs the intervention command to open the control valve 27C so that the pilot oil pressure to the control valve 27C is generated. According to the command from the work machine controller 28, the boom 6 is driven so that the speed of the work machine 2 in the direction toward the target excavation landform becomes the speed limit. As a result, excavation limiting control on the blade edge 8*a* is executed, and the speed of the bucket 8 toward the target excavation landform is adjusted.

In addition, the display controller 28 displays the target excavation landform on the display unit 29 on the basis of the target excavation landform data U. The display controller 28 also displays the target excavation landform data U and the two-dimensional bucket data S on the display unit 29. The display unit 29 is a monitor, for example, and displays various information data of the excavator CM. In the present embodiment, the display unit 29 includes an HMI (Human Machine Interface) that is a guidance monitor for computer-aided construction.

The display controller 28 can calculate a position in local coordinates as viewed in the global coordinate system on the basis of the detection result of the position detector 20. The local coordinate system is a three-dimensional coordinate system based on an excavator 100. In the present embodiment, the reference position P0 of the local coordinate system is a reference position P0 at the swing center AX of the swing body 3, for example. The target excavation landform data output to the work machine controller 26 is converted to local coordinates, for example, but the other calculation in the display controller 28 is executed using the global coordinate system. An input from the sensor controller 32 is also converted to the global coordinate system in the display controller 28.

Furthermore, the acquisition unit 28C acquires the work machine dimension data including the boom length L1, the arm length L2, the bucket length L3, the tilt length L4, and the width dimension L5 of the bucket 8 from the work machine data stored in the storage unit 28B. Alternatively, the work machine data including the dimension data of the work machine 2 may be supplied to the acquisition unit 28C (work machine data acquisition unit 281C) via the input unit 36.

The acquisition unit 28C (bucket external shape data acquisition unit 282C) also acquires the external shape data of the bucket 8. The external shape data of the bucket 8 may be stored in the storage unit 28B, or may be acquired by the acquisition unit 28C (bucket external shape data acquisition unit 282C) via the input unit 36.

The acquisition unit 28C also acquires the vehicle main body position data P and the vehicle main body posture data Q on the basis of the positional detection result of the position detector 20. The acquisition unit 28C acquires the data in real time in driving of the excavator CM.

The acquisition unit 28C (target excavation landform acquisition unit 283C) also acquires the target construction information (three-dimensional designed landform data) T indicating a three-dimensional designed landform that is a three-dimensional target shape of the excavation object in the work area. The target construction information T includes target excavation landform data (two-dimensional designed landform data) indicating the target excavation landform that is a two-dimensional target shape of the excavation object. In the present embodiment, the target construction information T is stored in the storage unit 28B of the display controller 28. The target construction information T includes coordinate data and angle data necessary for generating the target excavation landform data U. The target construction information T may be supplied to the display controller 28 via a radio communication device or may be supplied to the display controller 28 from an external memory or the like, for example.

As described above, in the present embodiment, the tilt angle sensor 70 detects the tilt angle in the global coordinate system. In the display controller 28, the tilt angle in the global coordinate system is converted to the tilt angle δ in the local coordinate system on the basis of the vehicle main body posture data Q. Alternatively, the tilt angle δ may be obtained by a method of obtaining posture information of the IMU and retraction information of the tilt cylinder 30 in the same manner as the work machines, and calculating the inclination angle.

Subsequently, in the present embodiment, the target excavation landform data U indicating the target excavation landform that is a two-dimensional target shape of the excavation object on the work machine operation plane MP perpendicular to the bucket axis J3 is specified (step SP2). The specification of the target excavation landform data U includes specifying a cross section of the target construction information T parallel to the XZ plane. The specification of the target excavation landform data U includes specifying the position (Y coordinate) in the Y-axis direction where a cross section of the target construction information T is to be taken. The target construction information T at the cross section having the Y coordinate and parallel to the XZ plane is the specified target excavation landform data U.

Figure 18:
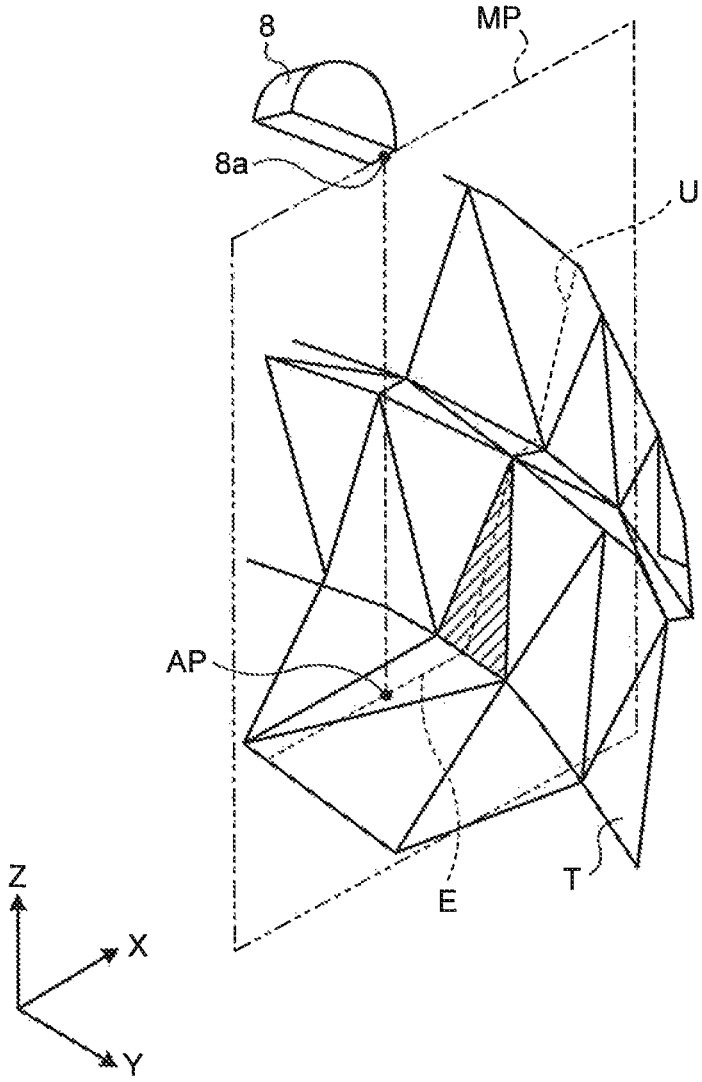
FIG. 18 is a diagram for explaining an example of limited excavation control.

As illustrated in FIG. 18, the target construction information T is expressed by multiple triangular polygons. In the target construction information T, work machine operation plane MP perpendicular to the bucket axis J3 is specified. The work machine operation plane MP is an operation plane (vertical rotation plane) of the work machine 2 defined by the front-back direction of the swing body 3. In the present embodiment, the work machine operation plane Mp is an operation plane of the arm 6. The work machine operation plane MP is parallel to the XZ plane.

The position (Y coordinate of the work machine operation plane MP) of the blade edge 8*a* of the bucket 8 may be specified by the operator. For example, the operator may input data relating to the specified Y coordinate to the input unit 36. The specified Y coordinate is acquired by the acquisition unit 28C. The acquisition unit 28C obtains the cross section of the target construction information T having the Y coordinate on the work machine operation plane MP. As a result, the target excavation landform calculation unit 283C acquires the target excavation landform data U at the specified Y coordinate.

Alternatively, a Y coordinate of a point on the surface of the target construction information at the shortest distance to the bucket 8 may be specified as the Y coordinate of the work machine operation plane MP.

For example, the display controller 28 obtains an intersection line E between the work machine operation plane MP and the target construction information as a candidate line as illustrated in FIG. 18 on the basis of the target construction information T and the specified work machine operation plane MP.

The display controller 28 defines a point immediately below the blade edge 8*a* on the candidate line of the target excavation landform as a reference point AP of the target excavation landform. The display controller 28 determines one or more inflection points previous or next to the reference point AP of the target excavation and lines previous and next thereto as the target excavation landform of the excavation object. The display controller 28 generates the target excavation landform data U on the work machine operation plane MP.

Subsequently, the calculation unit 28A (two-dimensional bucket data calculation unit 283A) of the sensor controller 32 obtains two-dimensional bucket data S indicating the external shape of the bucket 8 on the work machine operation plane MP on the basis of the parameters (data) acquired in step SP1 (step SP3).

Figure 19:
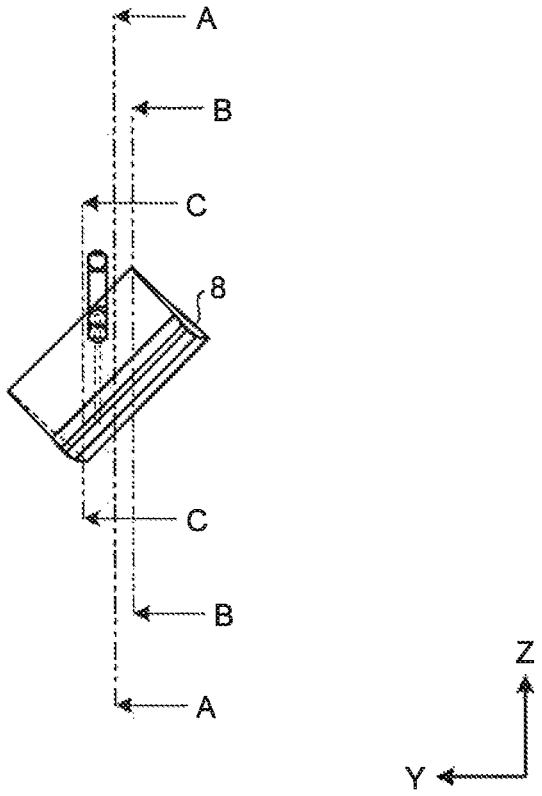
FIG. 19 is a diagram schematically illustrating an example of the bucket.
Figure 20:
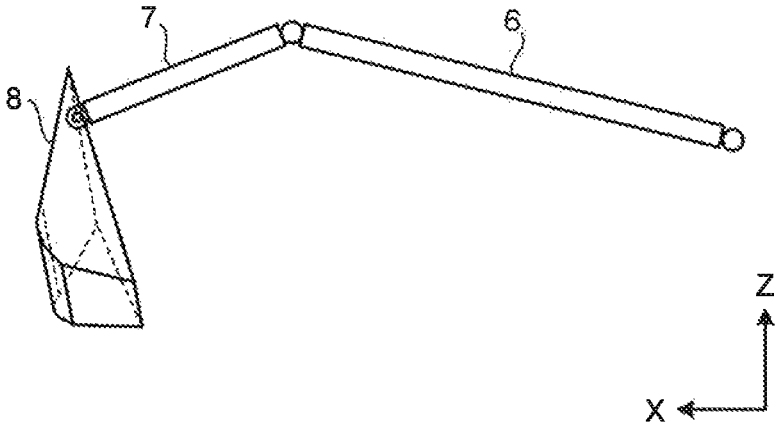
FIG. 20 is a diagram schematically illustrating an example of the bucket.
Figure 21:
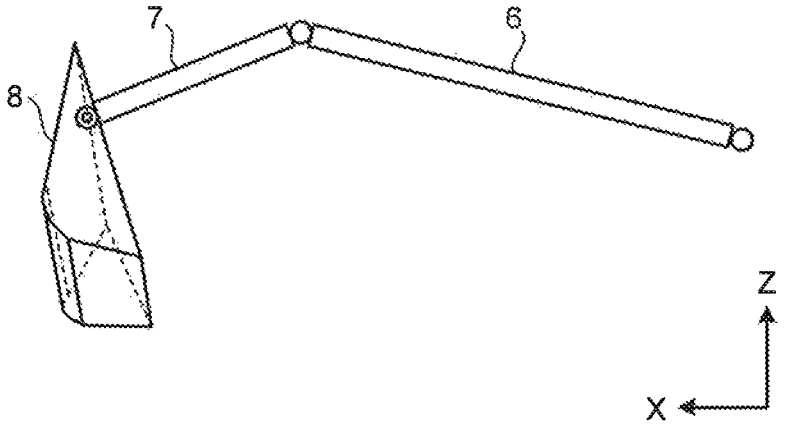
FIG. 21 is a diagram schematically illustrating an example of the bucket.
Figure 22:
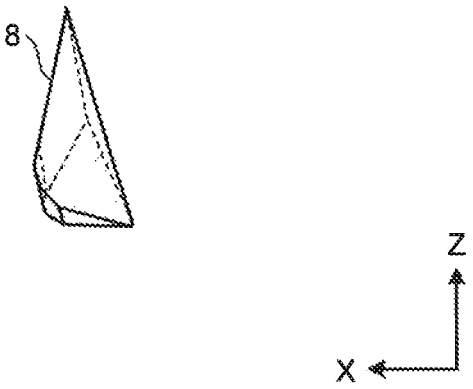
FIG. 22 is a diagram schematically illustrating an example of the bucket.

FIG. 19 is a rearward view schematically illustrating an example of the bucket 8 in a tilted state. FIG. 20 is a side view taken with a cross-section along line A-A in FIG. 19. FIG. 21 is a side view taken with a cross section along line B-B in FIG. 19. FIG. 22 is a side view taken with a cross section along line C-C in FIG. 19.

In the present embodiment, since the bucket 8 is tilted, the external shape (contour) of the bucket 8 in the XZ plane changes with the tilt angle S. Furthermore, as illustrated in FIGS. 20, 21, and 22, when Y coordinates of cross sections parallel to the XZ plane are different, the external shapes (contours) of the bucket 8 in the respective cross sections are different. Furthermore, with the tilt of the bucket 8, the distance between the target excavation landform and the bucket 8 changes.

With a bucket (what is called a standard bucket) without the tilt mechanism, the external shapes (contours) of the bucket in cross sections parallel to the XZ plane at different Y coordinates are substantially the same. With the tilting bucket, however, the external shape of the bucket 8 in a cross section parallel to the XZ plane changes with Y coordinate depending on the tilt (tilt angle δ) of the bucket 8. Thus, the distance between the target excavation landform and the bucket 8 and the external shape of the bucket 8 change with the tilt of the bucket 8, and at least part of the bucket 8 may enter the target excavation landform. For this reason, if the shape (cross-sectional shape in the XZ plane) of the bucket 8 for executing limited excavation control is not identified, the limited excavation control may not be executed accurately.

In the present embodiment, the sensor controller 32 (two-dimensional bucket calculation unit 283A) obtains two-dimensional bucket data S indicating the external shape of a cross section of the bucket 8 along the work machine operation plane MP to be controlled. The work machine control unit 26A of the work machine controller 26 derives the distance d between the target excavation landform and the bucket 8 on the basis of the two-dimensional bucket data S and the two-dimensional designed landform data U along the work machine operation plane MP (step SP4), and executes limited excavation control of the work machine 2 (step SP5). Furthermore, as will be described later, the sensor controller 32 displays the target excavation landform and the like on the display unit 29 (step SP6). As a result, the control object is identified on the basis of the work machine operation plane MP, and the limited excavation control is executed with high accuracy.

Figure 23:
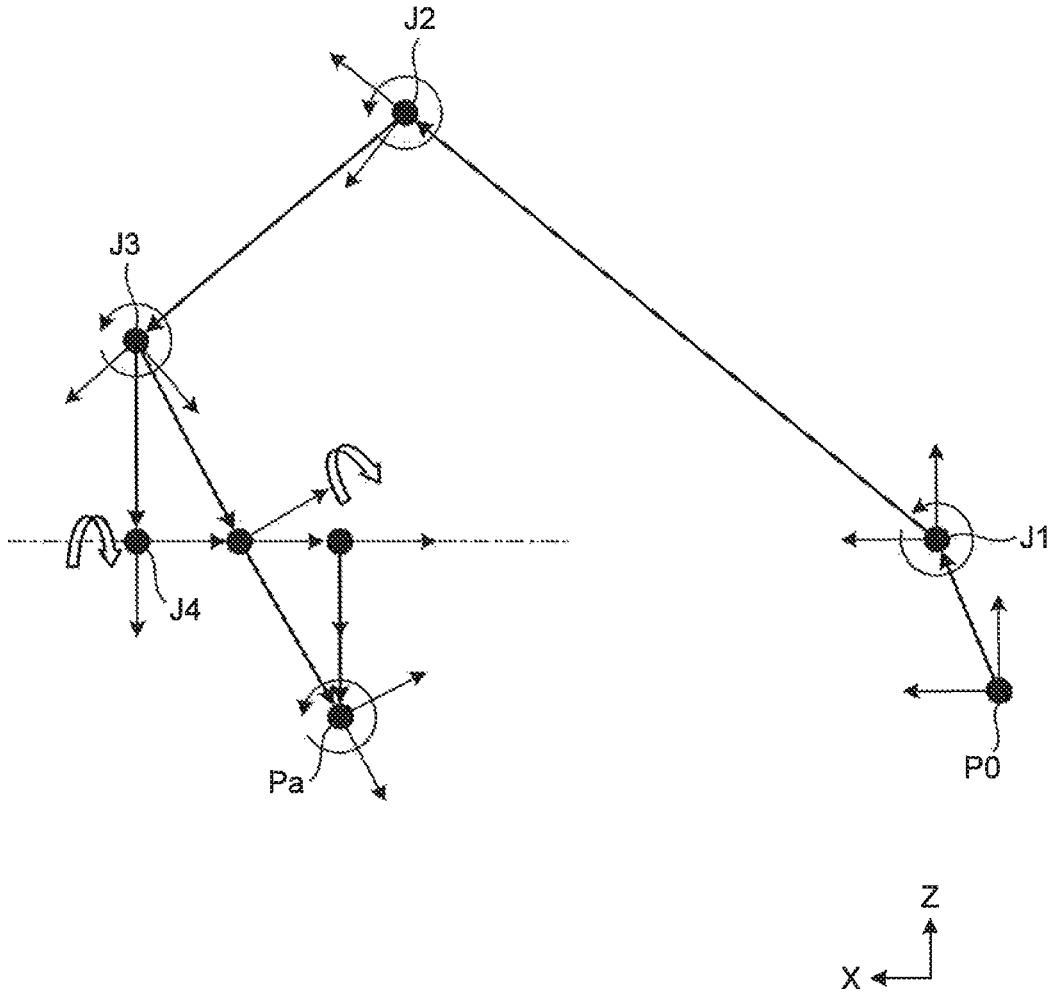
FIG. 23 is a diagram schematically illustrating an example of a work machine.

An example of deriving the two-dimensional bucket data S will be described below. FIG. 23 is a diagram schematically illustrating the work machine 2 according to the present embodiment. The origin of the local coordinate system is the reference position P0 at the swing center of the swing body 3. The position of the front end portion 8*a* of the bucket 8 in the local coordinate system is Pa.

The work machine 2 includes a first joint rotatable about the boom axis J1, a second joint rotatable about the arm axis J2, and a third joint rotatable about the bucket axis J3, and a fourth joint rotatable about the tilt axis J4. As described above, as a result of rotation of the bucket 8 about the bucket axis J3, the tilt axis J4 inclines in the θY direction. Operations of the respective joints can be expressed by the following Expressions (1) to (6). Expression (1) is an equation for coordinate transformation of the origin (reference position) P0 and the boom foot. Expression (2) is an equation for coordinate transformation of the boom foot and the boom top. Expression (3) is an equation for coordinate transformation of the boom top and the arm top. Expression (4) is an equation for coordinate transformation of the arm top and one end of the tilt axis J4. Expression (5) is an equation for coordinate transformation of one end and the other end of the tilt axis J4. Expression (6) is an equation for coordinate transformation of the other end of the tilt axis J4 and the bucket 8.

$$T_{local}^{boom\text{-}foot} = \begin{pmatrix} 1 & 0 & 0 & x_{boom\text{-}foot} \\ 0 & 1 & 0 & y_{boom\text{-}foot} \\ 0 & 0 & 1 & z_{boom\text{-}foot} \\ 0 & 0 & 0 & 1 \end{pmatrix} \tag{1}$$

$$T_{boom\text{-}foot}^{boom\text{-}top} = \begin{pmatrix} \cos\theta_{boom} & 0 & \sin\theta_{boom} & 0 \\ 0 & 1 & 0 & 0 \\ -\sin\theta_{boom} & 0 & \cos\theta_{boom} & 0 \\ 0 & 0 & 0 & 1 \end{pmatrix} \begin{pmatrix} 1 & 0 & 0 & 0 \\ 0 & 1 & 0 & 0 \\ 0 & 0 & 1 & L_{boom} \\ 0 & 0 & 0 & 1 \end{pmatrix} \tag{2}$$

$$T_{boom\text{-}top}^{arm\text{-}top} = \begin{pmatrix} \cos\theta_{arm} & 0 & \sin\theta_{arm} & 0 \\ 0 & 1 & 0 & 0 \\ -\sin\theta_{arm} & 0 & \cos\theta_{arm} & 0 \\ 0 & 0 & 0 & 1 \end{pmatrix} \begin{pmatrix} 1 & 0 & 0 & 0 \\ 0 & 1 & 0 & 0 \\ 0 & 0 & 1 & L_{arm} \\ 0 & 0 & 0 & 1 \end{pmatrix} \tag{3}$$

-continued $$T_{arm\text{-}top}^{tilt_A} = \begin{pmatrix} \cos(\theta_{bucket}+\theta_{tilt_y}) & 0 & \sin(\theta_{bucket}+\theta_{tilt_y}) & 0 \\ 0 & 1 & 0 & 0 \\ -\sin(\theta_{bucket}+\theta_{tilt_y}) & 0 & \cos(\theta_{bucket}+\theta_{tilt_y}) & 0 \\ 0 & 0 & 0 & 1 \end{pmatrix} \begin{pmatrix} 1 & 0 & 0 & 0 \\ 0 & 1 & 0 & 0 \\ 0 & 0 & 1 & L_{tilt} \\ 0 & 0 & 0 & 1 \end{pmatrix} \quad (4)$$

$$T_{tilt_A}^{tilt_B} = \begin{pmatrix} 1 & 0 & 0 & 0 \\ 0 & \cos\theta_{tilt_x} & -\sin\theta_{tilt_x} & 0 \\ 0 & \sin\theta_{tilt_x} & \cos\theta_{tilt_x} & 0 \\ 0 & 0 & 0 & 1 \end{pmatrix} \begin{pmatrix} 1 & 0 & 0 & -L_{tilt_x} \\ 0 & 1 & 0 & 0 \\ 0 & 0 & 1 & 0 \\ 0 & 0 & 0 & 1 \end{pmatrix} \quad (5)$$

$$T_{tilt_B}^{bucket} = \begin{pmatrix} 1 & 0 & 0 & 0 \\ 0 & 1 & 0 & 0 \\ 0 & 0 & 1 & L_{bucket_corrected} \\ 0 & 0 & 0 & 1 \end{pmatrix} \begin{pmatrix} \cos(-\theta_{tilt_y}) & 0 & \sin(-\theta_{tilt_y}) & 0 \\ 0 & 1 & 0 & 0 \\ -\sin(-\theta_{tilt_y}) & 0 & \cos(-\theta_{tilt_y}) & 0 \\ 0 & 0 & 0 & 1 \end{pmatrix} \quad (6)$$

In Expressions (1) to (6), xboom-foot, yboom-foot, and zboom-foot represent coordinates of the boom foot in the local coordinate system. Lboom corresponds to the boom length L1. Larm corresponds to the arm length L2. Lbucket_corrected represent a corrected bucket length illustrated in FIG. 2. Ltilt corresponds to the tilt length L4. θboom corresponds to the boom angle α. θarm corresponds to the arm angle β. θbucket corresponds to the bucket angle γ. θtilt_x corresponds to the tilt angle δ. θtilt_y is an angle illustrated in FIG. 2.

Thus, coordinates (xarm-top, yarm-top, zarm-top) of the arm top with respect to the origin in the local coordinate system are derived by the following Expression (7).

$$\begin{pmatrix} x_{arm\text{-}top} \\ y_{arm\text{-}top} \\ z_{arm\text{-}top} \\ 1 \end{pmatrix} = T_{local}^{arm\text{-}top} \begin{pmatrix} 0 \\ 0 \\ 0 \\ 1 \end{pmatrix} \quad (7)$$

where $$T_{local}^{arm\text{-}top} = T_{local}^{boom\text{-}foot}\ T_{boom\text{-}foot}^{boom\text{-}top}\ T_{boom\text{-}top}^{arm\text{-}top}$$

Figure 24:
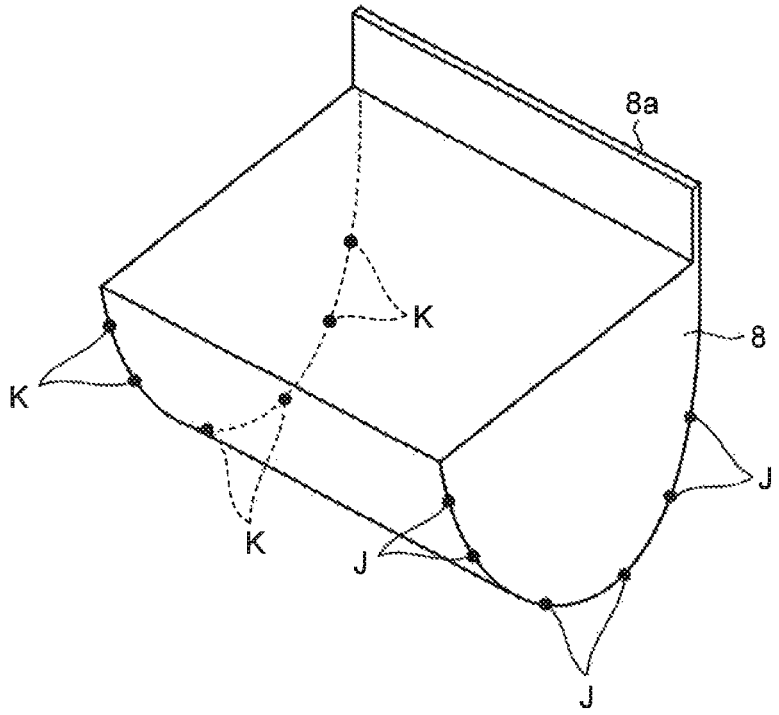
FIG. 24 is a diagram schematically illustrating an example of the bucket.

The external shape data of the bucket 8 includes coordinate data of the blade edge 8*a* of the bucket 8 and multiple positions (points) on the external surface of the bucket 8. In the present embodiment, as illustrated in FIG. 24, the external shape data of the bucket 8 includes first contour data of the external surface of the bucket 8 at one end in the width direction of the bucket 8 and second contour data of the external surface of the bucket 8 at the other end. The first contour data includes coordinates of six contour points J at one end of the bucket 8. The second contour data includes coordinates of six contour points K at the other end of the bucket 8. The coordinates of the contour points J and the coordinates of the contour points K are coordinate data based on the coordinates of the front end portion 8*a*. The positional relations of the coordinates of the front end portion 8*a*, the coordinates of the contour points J, and the coordinates of the contour points K are known from the external shape data of the bucket 8. Thus, the coordinates of the respective contour points J and the respective contour points K with respect to the origin can be obtained by obtaining the positional relation between the origin of the local coordinate system and the coordinates of the front end portion 8*a*.

When the external shape data of the bucket 8 (coordinates of the contour) is represented by (xbucket-outline, ybucket-outline, zbucket-outline), the coordinates of the contour points of the bucket 8 with respect to the origin can be derived by the following Expression (8).

$$\begin{pmatrix} x_n \\ y_n \\ z_n \\ 1 \end{pmatrix} = T_{local}^{tooth} \begin{pmatrix} x_{bucket\text{-}outline} \\ y_{bucket\text{-}outline} \\ z_{bucket\text{-}outline} \\ 1 \end{pmatrix} \quad (8)$$

where $$T_{local}^{tooth} = T_{local}^{boom\text{-}foot}\ T_{boom\text{-}foot}^{boom\text{-}top}\ T_{boom\text{-}top}^{arm\text{-}top}\ T_{arm\text{-}top}^{tilt_A}\ T_{tilt_A}^{tilt_B}\ T_{tilt_B}^{bucket}$$

In the present embodiment, the number of contour points J and the contour points K is twelve in total. When the coordinates of the contour points J and the contour points K in the external shape data of the bucket 8 are represented by (x1, y1, z1), (x2, y2, z2), . . . , (x12, y12, z12), the coordinates (x1', y1', z1'), (x2', y2', z2'), . . . , (x12', y12', z12') of the contour points J and the contour points of the bucket 8 K with respect to the origin can be derived by the following Expression (9).

$$\begin{pmatrix} x_1' & x_2' & \cdots & x_{12}' \\ y_1' & y_2' & \cdots & y_{12}' \\ z_1' & z_2' & \cdots & z_{12}' \\ 1 & 1 & \cdots & 1 \end{pmatrix} = T_{local}^{bucket} \begin{pmatrix} x_1 & x_2 & \cdots & x_{12} \\ y_1 & y_2 & \cdots & y_{12} \\ z_1 & z_2 & \cdots & z_{12} \\ 1 & 1 & \cdots & 1 \end{pmatrix} \quad (9)$$

After obtaining the coordinates of the multiple contour points J and contour points K, on the basis of the work machine angle data, the work machine dimension data, the external shape data of the bucket 8, and the tilt angle data, the calculation unit 28A obtains the two-dimensional bucket data S indicating the external shape of the bucket 8 on the work machine operation plane MP.

Figure 25:
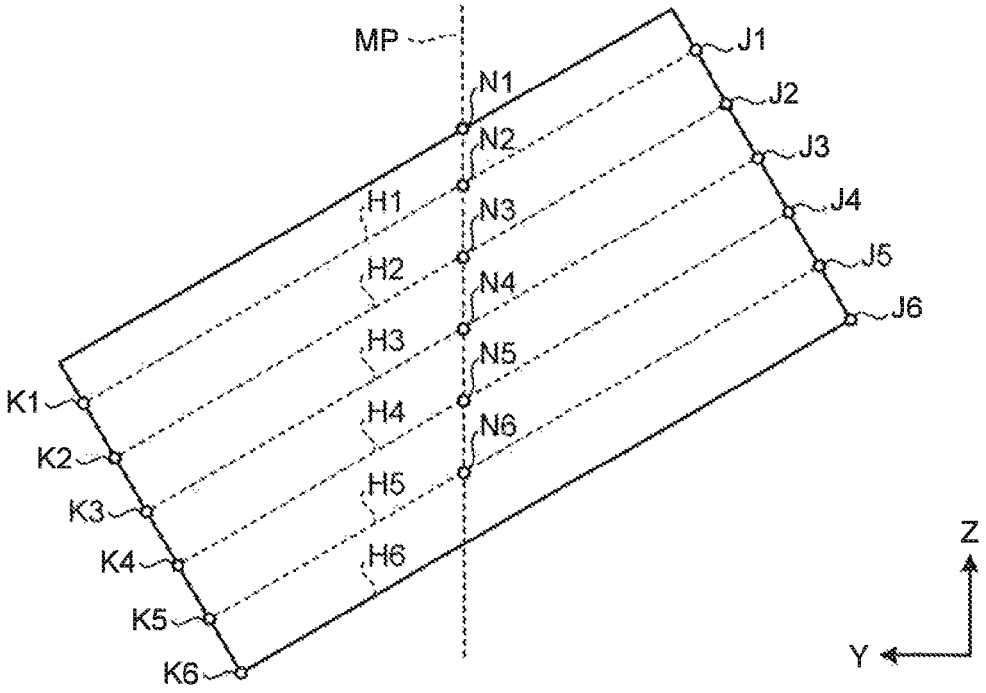
FIG. 25 is a schematic diagram for explaining an example of a method for controlling a construction machine.

FIG. 25 is a diagram schematically illustrating the relation of the contour points J, the contour points K and the work machine operation plane MP. As described above, as a result of obtaining the coordinates of multiple contour points Ji (i=1, 2, 3, 4, 5, 6) and multiple contour points Ki (i=1, 2, 3, 4, 5, 6) in the local coordinate system, lines Hi (i=1, 2, 3, 4, 5, 6) connecting the contour points Li and the contour points Ki are obtained. In addition, the position (Y coordinate) of the work machine operation plane MP in the direction parallel to the bucket axis J3 is specified in step SP2. Thus, the calculation unit 28A (two-dimensional bucket data calculation unit 283A) can obtain the two-dimensional bucket data S indicating the external shape of the bucket 8 on the work machine operation plane MP on the basis of intersections Ni (i=1, 2, 3, 4, 5, 6) between the work machine operation plane MP and the lines Hi. In this manner, in the present embodiment, the calculation unit 28A can obtain the two-dimensional bucket data S including multiple contour points (intersections) Ni on the basis of first contour point data including coordinate data of multiple contour points Ji in the local coordinate system, second contour point data including coordinate data of multiple contour points Ki in the local coordinate system, and the position of the work machine operation plane MP in the Y-axis direction parallel to the bucket axis J3.

Note that the method for deriving the contour points Ji and the contour points Ki in the local coordinate system described above is an example. The coordinates of the contour points Ji and the contour points Ki in the local coordinate system when the work machine 2 is driven can be obtained and the two-dimensional bucket data S can be obtained on the basis of the work machine angle data including the boom angle α, the arm angle β, and the bucket angle γ, the dimension data of the work machine 2 including the boom length L1, the arm length L2, the bucket length L3, and the tilt length L4, the external shape data of the bucket 8 including the width dimension L5 of the bucket 8, coordinate data of the contour points Ji and the contour points Ki, and the tilt angle data indicating the tilt angle δ. The changes in the coordinates of the contour points J and K with the change in the tilt axis angle ϵ can be uniquely obtained on the basis of the bucket angle γ and the tilt length L4.

For example, the coordinates of the blade edge 8*a* in the local coordinate system of the bucket 8 without the tilt mechanism can be derived from the dimension of the work machine 2 (the dimension of the boom 6, the dimension of the arm 7, and the dimension of the bucket 8), and the work machine angles (the turning angle α, the turning angle β, and the turning angle γ). After obtaining the coordinates of the blade edge 8 of the bucket 8 or the coordinates of the arm top, the contour points Ji, the contour points Ki, and the two-dimensional bucket data S may be obtained on the basis of the tilt length L4, the width dimension L5, the tilt angle δ, and the external shape data of the bucket 8 based on the obtained coordinates.

The two-dimensional bucket data S indicates the current position of the bucket 8 in the local coordinate system. Specifically, the two-dimensional bucket data S includes bucket position data indicating the current position of the bucket 8 on the work machine operation plane MP. The two-dimensional bucket data S is output from the display controller 28 to the work machine controller 26. The work machine control unit 26A of the work machine controller 26 controls the work machine 2 on the basis of the two-dimensional bucket data S.

Figure 26:
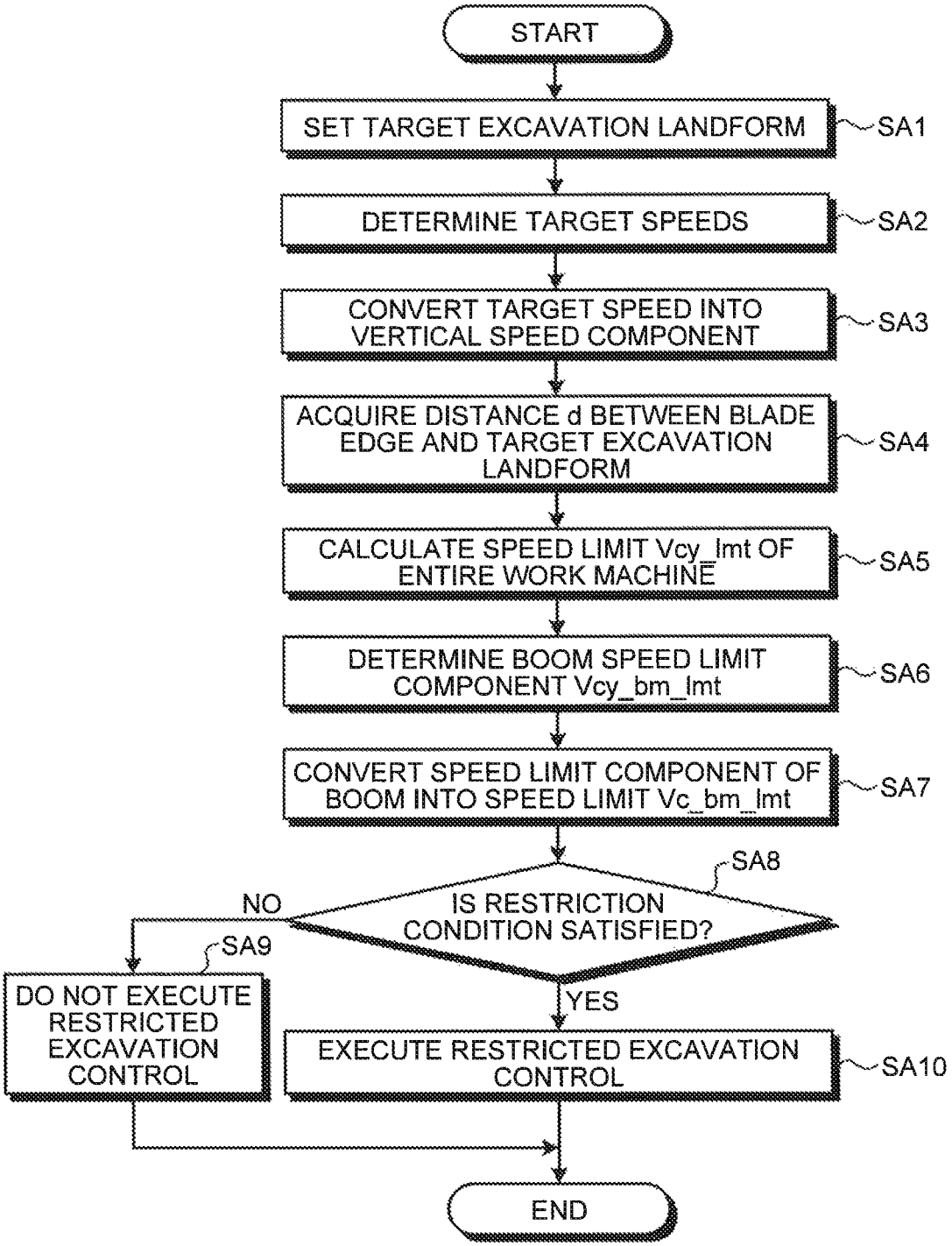
FIG. 26 is a flowchart illustrating an example of limited excavation control.

An example of the limited excavation control according to the present embodiment will be described below with reference to the flowchart of FIG. 26, and schematic diagrams of FIGS. 27 to 34. FIG. 26 is a flowchart illustrating an example of the limited excavation control according to the present embodiment.

As described above, the target excavation landform is set (step SA1). After setting the target excavation landform, the work machine controller 26 determines target speeds VC of the work machine 2 (step SA2). The target speeds Vc of the work machine 2 include a boom target speed Vc_bm, an arm target speed Vc_am, and a bucket target speed Vc_bkt. The boom target speed Vc_bm is a speed of the blade edge 8*a* when only the boom cylinder 10 is driven. The arm target speed Vc_am is a speed of the blade edge 8*a* when only the arm cylinder 11 is driven. The bucket target speed Vc_bkt is a speed of the blade edge 8*a* when only the bucket cylinder 12 is driven. The boom target speed Vc_bm is calculated on the basis of the boom manipulation amount. The arm target speed Vc_am is calculated on the basis of the arm manipulation amount. The bucket target speed Vc_bkt is calculated on the basis of the bucket manipulation amount.

Target speed information defining the relation between the pilot oil pressure acquired from the pressure sensor 66A or 66B associated with the boom manipulation amount and the boom target speed Vc_bm is stored in the storage unit of the work machine controller 26. The work machine controller 26 determines the boom target speed Vc_bm associates with the boom manipulation amount on the basis of the target speed information. The target speed information is a graph describing the magnitude of the boom target speed associated with the boom manipulation amount, for example. The target speed information may be in a form of a table or a mathematical expression. The target speed information includes information defining the relation between the pilot oil pressure acquired from the pressure sensor 66A or 66B associated with the arm manipulation amount and the arm target speed Vc_am. The target speed information includes information defining the relation between the pilot oil pressure acquired from the pressure sensor 66A or 66B associated with the bucket manipulation amount and the bucket target speed Vc_bkt. The work machine controller 26 determines the arm target speed Vc_am associated with the arm manipulation amount on the basis of the target speed information. The work machine controller 26 determines the bucket target speed Vc_bkt associated with the bucket manipulation amount on the basis of the target speed information.

Figure 27:
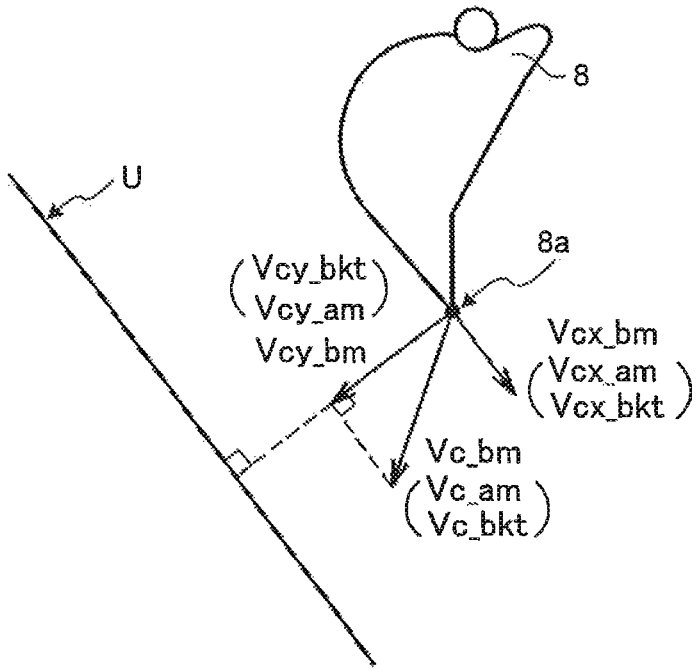
FIG. 27 is a diagram for explaining an example of limited excavation control.

As illustrated in FIG. 27, the work machine controller 26 converts the boom target speed Vc_bm into a speed component (vertical speed component) Vcy_bm in the direction perpendicular to the surface of the target excavation landform and a speed component (horizontal speed component) Vcx_bm in the direction parallel to the surface of the target excavation landform (step SA3).

The work machine controller 26 obtains a tilt of the vertical axis (the swing axis AX of the swing body 3) of the local coordinate system with respect to the vertical axis of the global coordinate system and a tilt of the direction perpendicular to the surface of the target excavation landform with respect to the vertical axis of the global coordinate system from the reference position data P, the target excavation landform, etc. The work machine controller 26 obtains the angle β2 representing the tilt between the vertical axis of the local coordinate system and the direction perpendicular to the surface of the target excavation landform from the obtained tilts.

Figure 28:
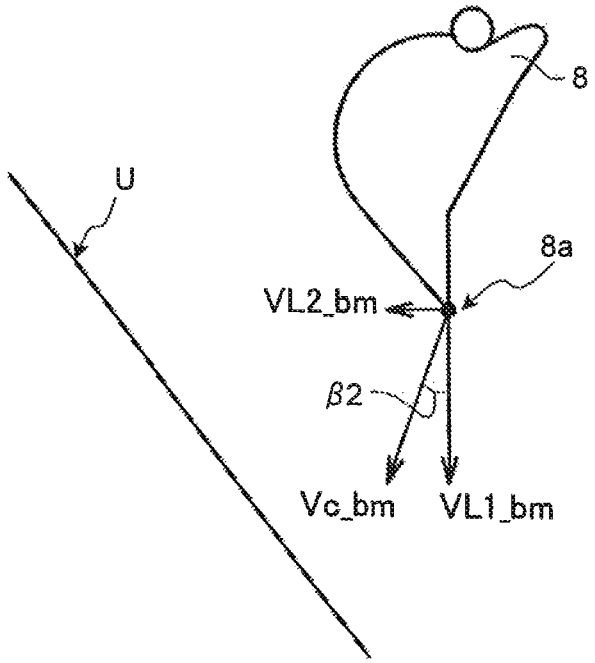
FIG. 28 is a diagram for explaining an example of limited excavation control.

As illustrated in FIG. 28, the work machine controller 26 converts the boom target speed Vc_bm into a speed component VL1_*bm* in the vertical axis direction of the local coordinate system and a speed component VL2_*bm* in the horizontal axis direction thereof from the angle β2 between the vertical axis of the local coordinate system and the boom target speed Vc_bm by using the trigometric function.

Figure 29:
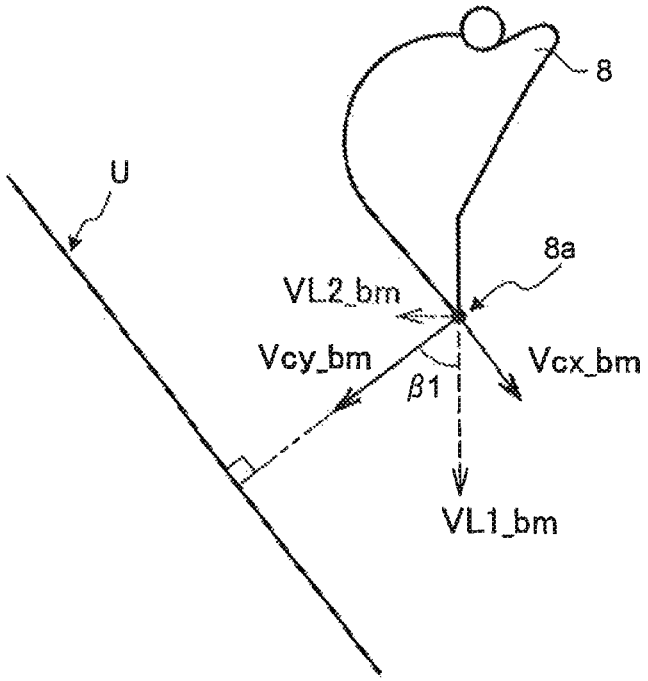
FIG. 29 is a diagram for explaining an example of limited excavation control.

As illustrated in FIG. 29, work machine controller 26 converts the speed component VL1_*bm* in the vertical axis direction of the local coordinate system and the speed component VL2_*bm* in the horizontal axis direction thereof into a vertical speed component Vcy_bm and an horizontal speed component Vcx_bm with respect to the target excavation landform on the basis of the tilt β1 between the vertical axis of the local coordinate system and the direction perpendicular to the surface of the target excavation landform by using the trigometric function. Similarly, the work machine controller 26 converts the arm target speed Vc_am into a vertical speed component Vcy_am in the vertical axis direction of the local coordinate system and a horizontal speed component Vcx_am. The work machine controller 26 converts the bucket target speed Vc_bkt into a vertical speed component Vcy_bkt in the vertical axis direction of the local coordinate system and a horizontal speed component Vcx_bkt.

Figure 30:
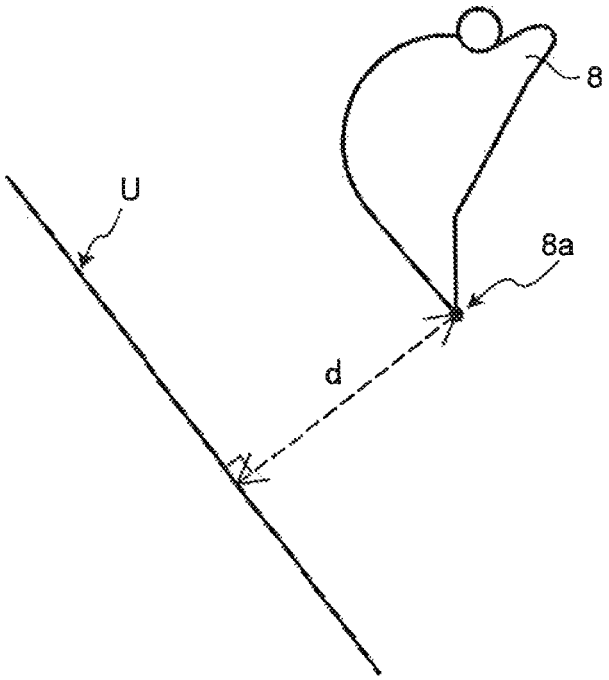
FIG. 30 is a diagram for explaining an example of limited excavation control.

As illustrated in FIG. 30, the work machine controller 26 acquires a distance d between the blade edge 8*a* of the bucket 8 and the target excavation landform (step SA4). The work machine controller 26 calculates the shortest distance d between the blade edge 8*a* of the bucket 8 and the surface of the target excavation landform from position information of the blade edge 8*a*, the target excavation landform, etc. In the present embodiment, the limited excavation control is executed on the basis of the shortest distance d between the blade edge 8*a* of the bucket 8 and the surface of the target excavation landform.

The work machine controller 26 calculates a speed limit Vcy_lmt of the entire work machine 2 on the basis of the distance d between the blade edge 8*a* of the bucket 8 and the surface of the target excavation landform (step SA5). The speed limit Vcy_lmt of the entire work machine 2 is a moving speed of the blade edge 8*a* of the bucket 8 permissible in the direction in which the blade edge 8*a* approaches the target excavation landform. Speed limit information defining the relation between the distance d and the speed limit Vcy_lmt is stored in a memory of the work machine controller 26.

Figure 31:
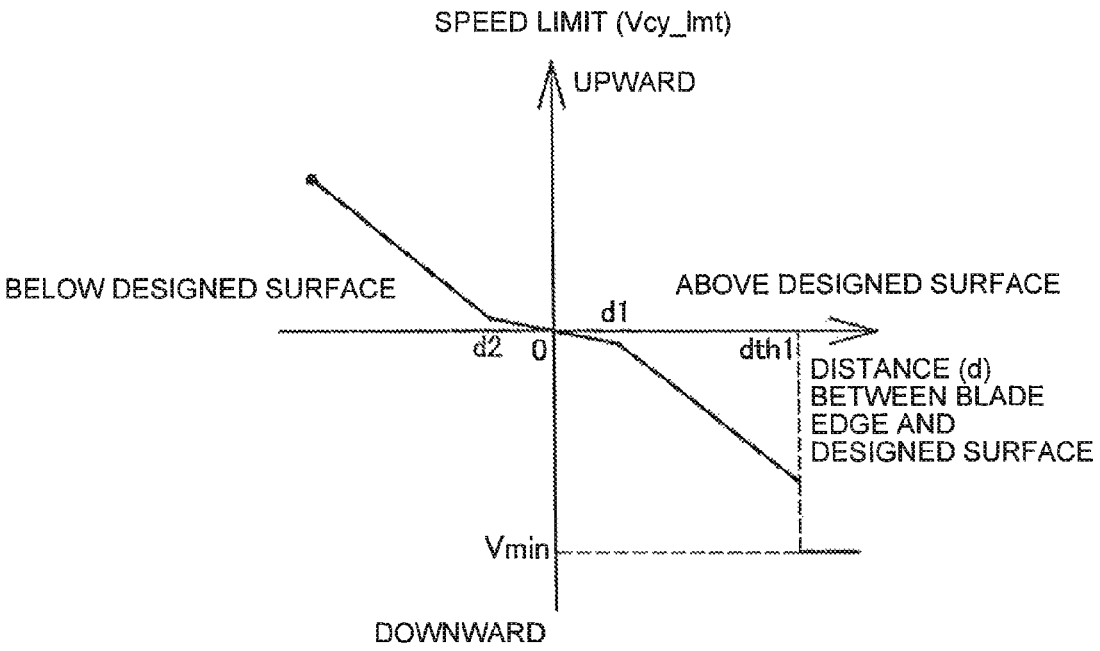
FIG. 31 is a graph for explaining an example of limited excavation control.

FIG. 31 illustrates an example of the speed limit information according to the present embodiment. In the present embodiment, the distance d has a positive value when the blade edge 8*a* is outside of the surface of the target excavation landform, that is, on the side of the work machine of the excavator 100, and the distance d has a negative value when the blade edge 8*a* is inside of the surface of the target excavation landform, that is, on the inner side of the excavation object than the target excavation landform. As illustrated in FIG. 30, the distance d has a positive value when the blade edge 8*a* is located above the surface of the target excavation landform. The distance d has a negative value when the blade edge 8*a* is located under the surface of the target excavation landform. Furthermore, the distance d has a positive value when the blade edge 8*a* is at a position where the blade edge 8*a* does not enter the target excavation landform. The distance d has a negative value when the blade edge 8*a* is at a position where the blade edge 8*a* enters the target excavation landform. The distance d is 0 when the blade edge 8*a* is on the target excavation landform, that is, when the blade edge 8*a* is in contact with the target excavation landform.

In the present embodiment, the speed at which the blade edge 8*a* moves from the inner side toward the outer side of the target excavation landform has a positive value, and the speed at which the blade edge 8*a* moves from the outer side toward the inner side of the target excavation landform has a negative value. That is, the speed at which the blade edge 8*a* moves upward of the target excavation landform has a positive value, and the speed at which blade edge 8*a* moves downward of the target excavation landform has a negative value.

In the speed limit information, the slope of the speed limit Vcy_lmt when the distance d is between d1 and d2 is smaller than that when the distance d is equal to or larger than d1 or equal to or smaller than d2. d1 is larger than 0. d2 is smaller than 0. For operation near the surface of the target excavation landform, the slope when the distance d is between d1 and d2 is made to be smaller than that when the distance d is equal to or larger than d1 or equal to or smaller than d2 so that the speed limit can be more specifically set. When the distance d is equal to or larger than d1, the speed limit Vcy_lmt has a negative value and the speed limit Vcy_lmt becomes lower as the distance d becomes larger. Specifically, when the distance d is equal to or larger than d1, as the blade edge 8*a* is farther from the target excavation landform above the target excavation landform, the speed at which the blade edge 8*a* moves downward of the target excavation landform is higher and the absolute value of the speed limit Vcy_lmt is larger. When the distance d is equal to or smaller than 0, the speed limit Vcy_lmt has a positive value, and the speed limit Vcy_lmt is larger as the distance d is smaller. Specifically, when the distance d from which the blade edge 8*a* of the bucket moves farther from the target excavation landform is equal to or smaller than 0, as the blade edge 8*a* is farther from the target excavation landform below the target excavation landform, the speed at which the blade edge 8*a* moves upward of the target excavation landform is higher and the absolute value of the speed limit Vcy_lmt is larger.

When the distance d is equal to or larger than a predetermined value dth1, the speed limit Vcy_lmt is Vmin. The predetermined value dth1 is a positive value larger than d1. Vmin is smaller than the smallest value of the target speed. Thus, when the distance d is equal to or larger than the predetermined value dth1, the operation of the work machine 2 is not limited. Thus, when the blade edge 8*a* is far from the target excavation landform above the target excavation landform, limitation of operation of the work machine 2, that is, the limited excavation control is not executed. When the distance d is smaller than the predetermined value dth1, operation of the work machine 2 is limited. When the distance d is smaller than the predetermined value dth1, operation of the boom 6 is limited.

The work machine controller 26 calculates a vertical speed component (vertical speed limit component) Vcy_bm_lmt of the speed limit of the boom 6 from the speed limit Vcy_lmt of the entire work machine 2 and the bucket target speed Vc_bkt (step SA6).

Figure 32:
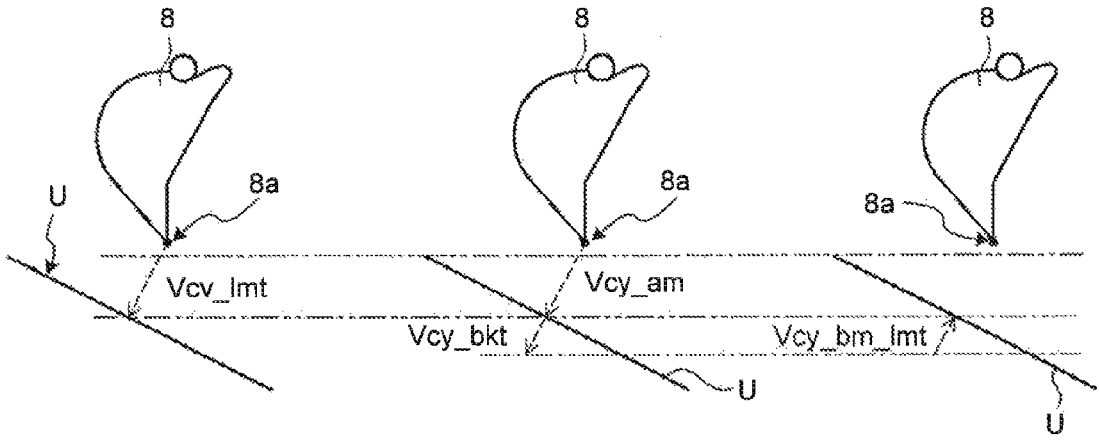
FIG. 32 is a diagram for explaining an example of limited excavation control.

As illustrated in FIG. 32, the work machine controller 26 calculates the vertical speed limit component Vcy_bm_lmt of the boom 6 by subtracting the vertical speed component Vcy_am of the arm target speed and the vertical speed component Vcy_bkt of the bucket target speed from the speed limit Vcy_lmt of the entire work machine 2.

Figure 33:
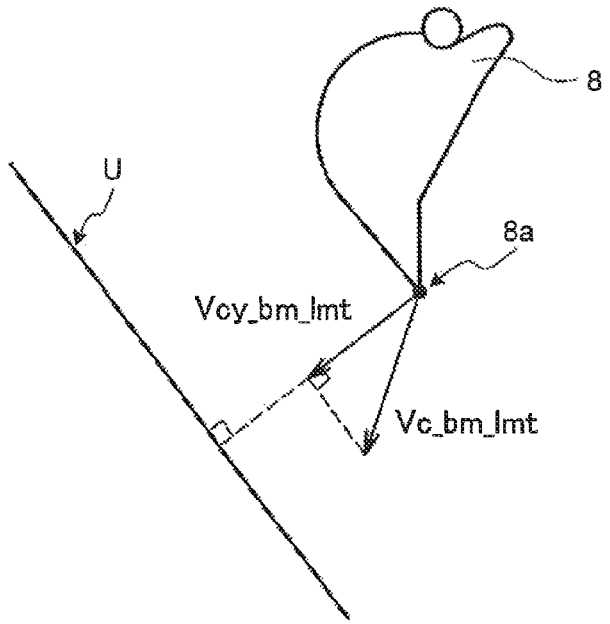
FIG. 33 is a diagram for explaining an example of limited excavation control.

As illustrated in FIG. 33, the work machine controller 26 converts the vertical speed limit component Vcy_bm_lmt of the boom 6 into the speed limit (boom speed limit) Vc_bm_lmt of the boom 6 (step SA7). The work machine controller 26 obtains the relation between the direction perpendicular to the surface of the target excavation landform and the direction of the boom speed limit Vc_bm_lmt from the turning angle α of the boom 6, the turning angle β of the arm 7, the turning angle of the bucket 8, the vehicle main body position data P, the target excavation landform, and the like, and converts the vertical speed limit component Vcy_bm_lmt of the boom 6 into the boom speed limit Vc_bm_lmt. The calculation in this case is executed in an order opposite to that of the calculation described above for obtaining the vertical speed component Vcy_bm in the direction perpendicular to the target excavation landform from the boom target speed Vc_bm. A cylinder speed corresponding to the boom intervention amount is then determined, and a release command associated with the cylinder speed is output to the control valve 27C.

A pilot pressure based on lever manipulation is applied to the oil passage 43B, and a pilot pressure based on the boom intervention is applied to the oil passage 43C. The larger of the pressures is selected by the shuttle valve 51 (step SA8).

For example, for moving the boom 6 down, the limitation condition is satisfied when the boom speed limit Vc_bm_lmt of the boom 6 in the downward direction is smaller than the boom target speed Vc_bm in the downward direction. In contrast, for moving the boom 6 up, the limitation condition is satisfied when the boom speed limit Vc_bm_lmt of the boom 6 in the upward direction is larger than the boom target speed Vc_bm in the upward direction.

The work machine controller 26 controls the work machine 2. For controlling the boom 6, the work machine controller 26 transmits a boom command signal to the control valve 27C to control the boom cylinder 10. The boom command signal has a current value corresponding to a boom command speed. Where necessary, the work machine controller 26 controls the arm 7 and the bucket 8. The work machine controller 26 transmits an arm command signal to a control valve 27 to control the arm cylinder 11. The arm command signal has a current value corresponding to an arm command speed. The work machine controller 26 transmits a bucket command signal to the control valve 27 to control the bucket cylinder 12. The bucket command signal has a current value corresponding to a bucket command speed.

If the limitation condition is not satisfied, the shuttle valve 51 selects supply of hydraulic oil from the oil passage 43B, and normal operation is executed (step SA9). The work machine controller 26 operates the boom cylinder 10, the arm cylinder 11, and the bucket cylinder 12 according to the boom manipulation amount, the arm manipulation amount, and the bucket manipulation amount. The boom cylinder 10 operates at the boom target speed Vc_bm. The arm cylinder 11 operates at the arm target speed Vc_am. The bucket cylinder 12 operates at the bucket target speed Vc_bkt.

If the limitation condition is satisfied, the shuttle valve 51 selects supply of hydraulic oil from the oil passage 43C, and the limited excavation control is executed (step SA10).

As a result of subtracting the vertical speed component Vcy_am of the arm target speed and the vertical speed component Vcy_bkt of the bucket target speed from the speed limit Vcy_lmt of the entire work machine 2, the vertical speed limit component Vcy_bm_lmt of the boom 6 is calculated. Thus, when the speed limit Vcy_lmt of the entire work machine 2 is smaller than a sum of the vertical speed component Vcy_am of the arm target speed and the vertical speed component Vcy_bkt of the bucket target speed, the vertical speed limit component Vcy_bm_lmt of the boom is a negative value at which the boom moves upward.

Thus, the boom speed limit Vc_bm_lmt has a negative value. In this case, the work machine controller 27 moves the boom 6 down but at a speed lower than the boom target speed Vc_bm. It is therefore possible to prevent the bucket 8 from entering the target excavation landform while suppressing uncomfortable feeling of the operator.

If the speed limit Vcy_lmt of the entire work machine 2 is larger than a sum of the vertical speed component Vcy_am of the arm target speed and the vertical speed component Vcy_bkt of the bucket target speed, the vertical speed limit component Vcy_bm_lmt of the boom 6 has a positive value. The boom speed limit Vc_bm_lmt thus has a positive value. In this case, the work machine controller 26 moves the boom 6 up even if the operating device 25 is manipulated to move the boom 6 down. It is therefore possible to rapidly prevent entry into the target excavation landform from being enlarged.

When the blade edge 8*a* is above the target excavation landform, as the blade edge 8*a* moves closer to the target excavation landform, the absolute value of the vertical speed limit component Vcy_bm_lmt of the boom 6 is smaller and the absolute value of the speed component (horizontal speed limit component) Vcx_bm_lmt of the speed limit of the boom 6 in a direction parallel to the surface of the target excavation landform is also smaller. Thus, when the blade edge 8*a* is above the target excavation landform, as the blade edge 8*a* moves closer to the target excavation landform, the speed of the boom 6 in the direction perpendicular to the surface of the target excavation landform and the speed of the boom 6 in the direction parallel to the surface of the target excavation landform are both lowered. As a result of manipulation of the left manipulation lever 25L and the right manipulation lever 25R at the same time by the operator of the excavator 100, the boom 6, the arm 7, and the bucket 8 operate at the same time. In this case, the control described above is explained as follows when it is assumed that target speeds Vc_bm, Vc_am, and Vc_bkt of the boom 6, the arm 7, and the bucket 8 are input.

Figure 34:
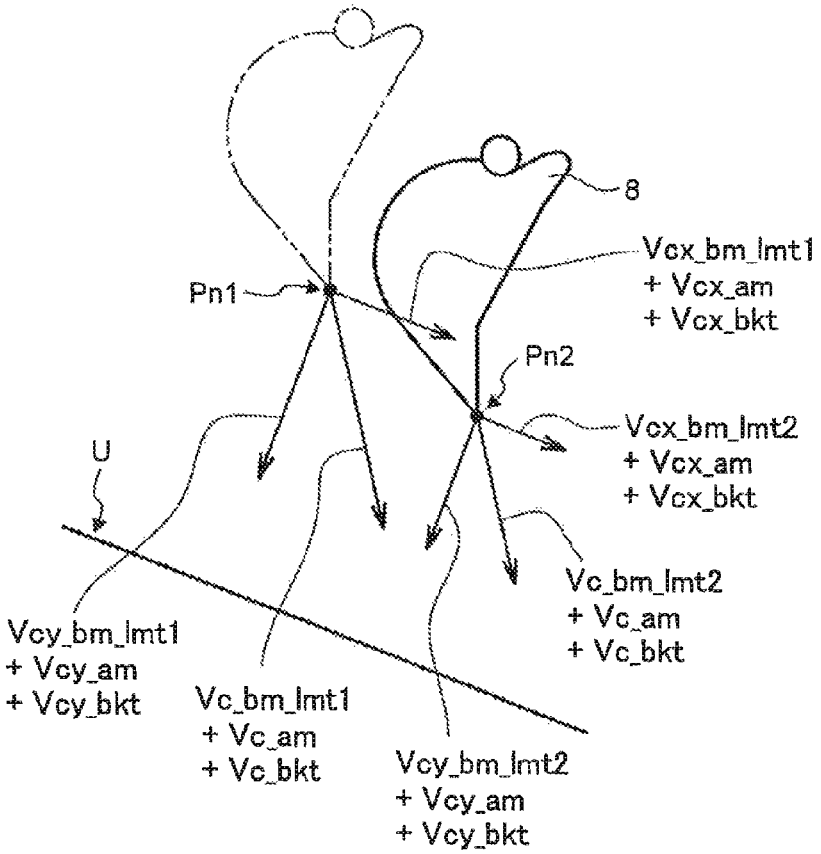
FIG. 34 is a diagram for explaining an example of limited excavation control.

FIG. 34 illustrates an example of a change in the speed limit of the boom 6 when the distance d between the target excavation landform and the blade edge 8*a* of the bucket 8 is smaller than the predetermined value dth1 and the blade edge 8*a* of the bucket 8 moves from a position Pn1 to a position Pn2. The distance between the blade edge 8*a* and the target excavation landform at the position Pn2 is smaller than the distance between the blade edge 8*a* and the target excavation landform at the position Pn1. Thus, a vertical speed limit component Vcy_bm_lmt2 of the boom 6 at the position Pn2 is smaller than a vertical speed limit component Vcy_bm_lmt1 of the boom 6 at the position Pn1. The boom speed limit Vc_bm_lmt2 at the position Pn2 is therefore smaller than the boom speed limit Vc_bm_lmt1 at the position Pn1. In addition, a horizontal speed limit component Vcx_bm_lmt2 of the boom 6 at the position Pn2 is smaller than a horizontal speed limit component Vcx_bm_lmt1 of the boom 6 at the position Pn1. In this case, however, the arm target speed Vc_am and the bucket target speed Vc_bkt are not limited. Thus, the vertical speed component Vcy_am and the horizontal speed component Vcx_am of the arm target speed and the vertical speed component Vcy_bkt and the horizontal speed component Vcx_bkt of the bucket target speed are not limited.

As described above, since the arm 7 is not limited, a change in the arm manipulation amount corresponding to the operator's intention of excavation is reflected as a change in the speed of the blade edge 8*a* of the bucket 8. Thus, in the present embodiment, it is possible to suppress the uncomfortable feeling of the operator in manipulation for excavation while preventing entry into the excavation landform from being enlarged.

As described above, in the present embodiment, the work machine controller 26 limits the speed of the boom 6 so that the relative speed of the bucket 8 moving toward the target excavation landform becomes lower depending on the distance d between the target excavation landform and the blade edge 8*a* of the bucket 8 on the basis of the target excavation landform indicating a designed landform that is a target shape of the excavation object and the blade edge position data indicating the position of the blade edge 8*a* of the bucket 8. The work machine controller 26 determines a speed limit according to the distance d between the target excavation landform and the blade edge 8*a* of the bucket 8 on the basis of the target excavation landform indicating a designed landform that is a target shape of the excavation object and the blade edge position data indicating the position of the blade edge 8*a* of the bucket 8, and controls the work machine 2 so that the speed of the work machine 2 moving toward the target excavation landform becomes lower than the speed limit. As a result, limited excavation control on the blade edge 8*a* is executed, and the position of the blade edge 8*a* relative to the target excavation landform is automatically adjusted.

In the limited excavation control (interventional control), a control signal is output to a control valve 27 connected to the boom cylinder 10 to control the position of the boom 6 so that entry of the blade edge 8*a* into the target excavation landform is suppressed. The interventional control is executed when the relative speed Wa is higher than the speed limit V. The interventional control is not executed when the relative speed Wa is lower than the speed limit V. The fact that the relative speed Wa is lower than the speed limit V includes a case in which the bucket 8 moves relative to target excavation landform so that the distance between the bucket 8 and target excavation landform becomes larger.

Figure 35:
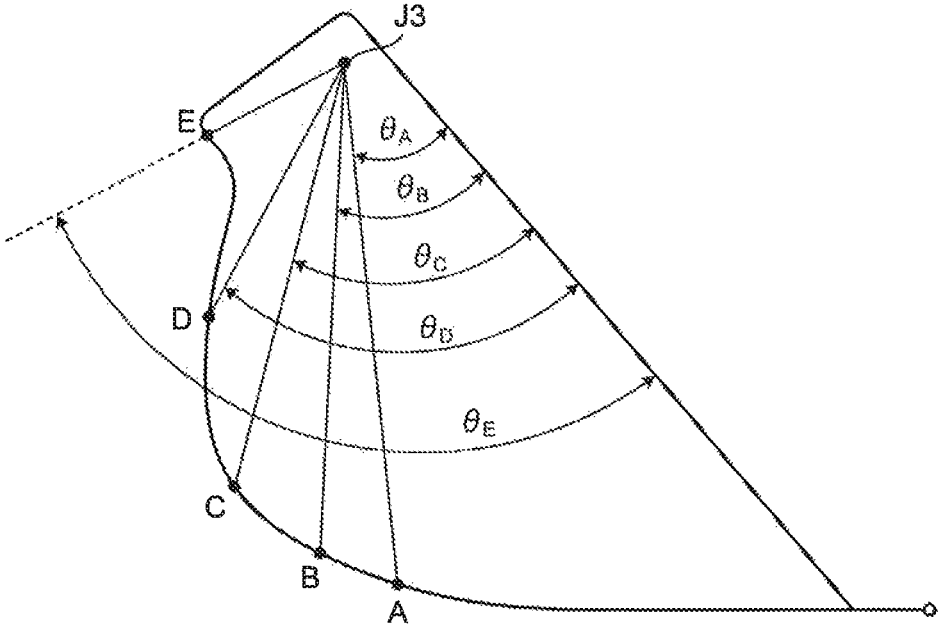
FIG. 35 is a schematic diagram for explaining a method for controlling a construction machine.

In the present embodiment, two-dimensional bucket data S may be used to derive the relative positions of the target excavation landform and the bucket 8, and two-dimensional bucket data S obtained by coordinate transformation from the local coordinate system into a polar coordinate system may be used for control of the work machine 2. For example, as illustrated in FIG. 35, the arm top (bucket axis J3) may be the origin of the polar coordinate system, and multiple contour points A, B, C, D, and E of the bucket 8 on the work machine operation plane MP may be expressed by the distances from the origin and the angles θA, θB, θC, θD, and θE with respect to a reference line. Note that the reference line may be a line connecting the bucket axis J3 and the front end portion 8*a* of the bucket 8. As a result of using the polar coordinate system, the target excavation landform when the bucket 8 is tilted, the front end portion 8*a* of the bucket 8, and the contour in a cross section of the bucket 8 on the work machine operation plane MP can be correctly calculated, the distance between the target excavation landform and the front end portion 8*a* of the bucket 8 can be correctly calculated, and the accuracy of excavation control can be ensured.

[Display Unit]

Figure 36:
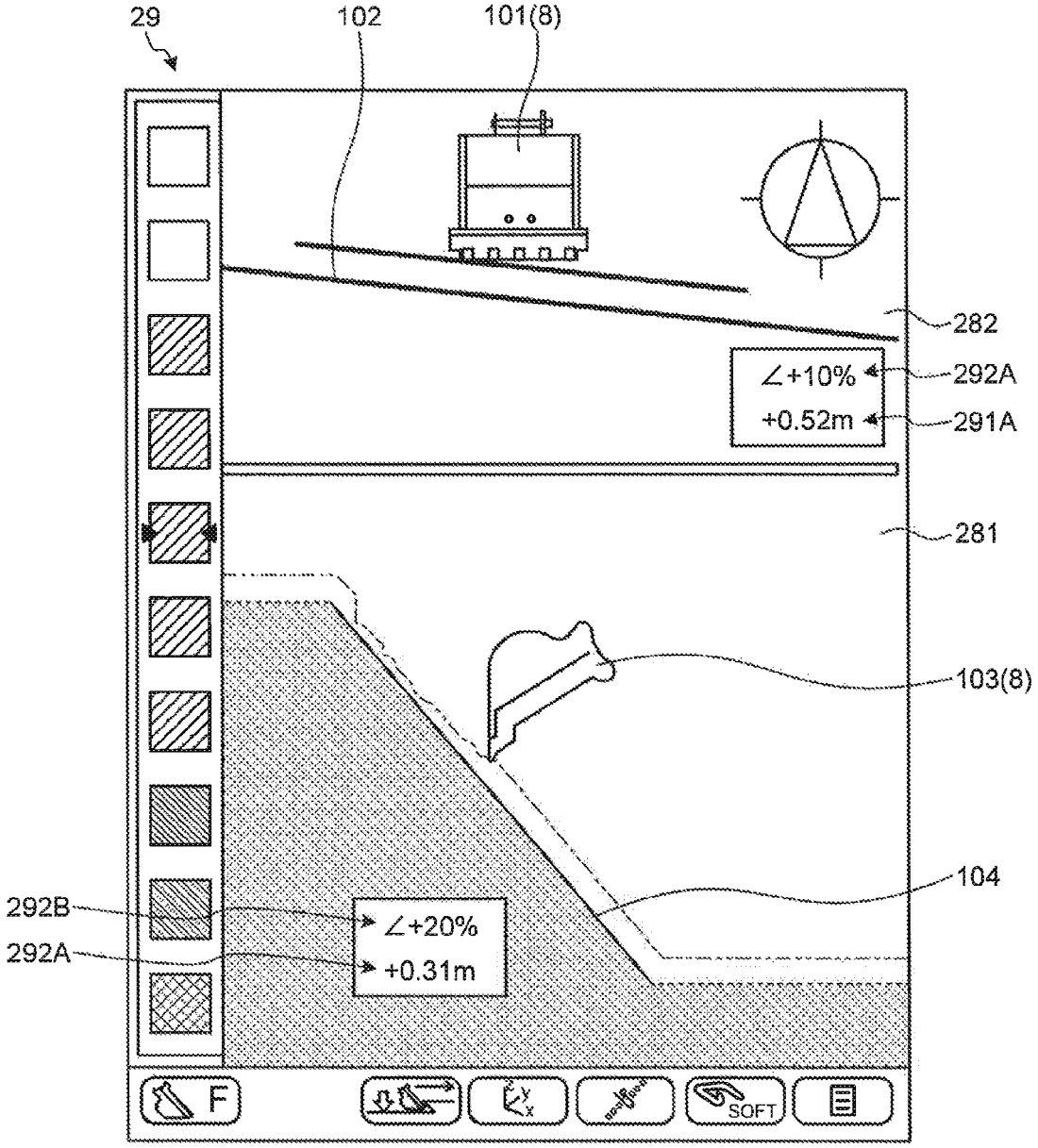
FIG. 36 is a diagram illustrating an example of a display unit.

FIG. 36 is a diagram illustrating an example of the display unit 29. In the present embodiment, the display unit 29 displays the two-dimensional bucket data S including the target excavation landform data U and the bucket position data (step SP6). The display unit 29 displays at least one of distance data indicating the distance between the target excavation landform and the bucket 8 on the work machine operation plane MP and external shape data indicating the external shape of the bucket 8 on the work machine operation plane MP.

A screen of the display unit 29 includes a front view 282 illustrating the target excavation landform and the bucket 8, and a side view 281 illustrating the target excavation landform and the bucket 8. The front view 282 includes an icon 101 representing the bucket 8, and a line 102 representing a cross section of a three-dimensional designed landform (target construction information). The front view 282 also includes distance data 291A indicating the distance (distance in the Z-axis direction) between the target excavation landform and the bucket 8, and angle data 292A indicating an angle between the target excavation landform and the blade edge 8*a*.

The side view 281 includes an icon 103 representing the bucket 8, and a line 104 representing the surface of the target excavation landform on the work machine operation plane MP. The icon 103 illustrates the external shape of the bucket 8 on the work machine operation plane MP. The side view 281 also includes distance data 292A indicating the distance (shortest distance between the target excavation landform and the bucket 8) between the target excavation landform and the bucket 8, and angle data 292B indicating an angle between the target excavation landform and the bottom face of the bucket 8.

[Effects]

As described above, according to the present embodiment, with a tilting bucket, since the external shape of the bucket 8, which is a control object of the limited excavation control, along the work machine operation plane MP and the target excavation landform are identified, it is possible to execute the limited excavation control with high accuracy so that the bucket 8 is prevented from entering the target excavation landform even when the distance between the target excavation landform and the bucket 8 bucket changes as a result of tilt of the bucket 8.

In the present embodiment, since two-dimensional bucket data indicating the external shape of the bucket 8 on the work machine operation plane MP is obtained on the basis of the dimension data of the work machine 2, the external shape data of the bucket 8, the work machine angle data, and the tilt angle data, the position of the blade edge 8*a* of the bucket 8 on the work machine operation plane MP can be obtained even when the tilt angle of the bucket 8 changes. It is therefore possible to accurately obtain the relative positions of the target excavation landform and the blade edge 8*a*, suppress degradation in excavation accuracy, and carry out expected construction.

In the present embodiment, the external shape data of the bucket 8 includes first contour data of the bucket 8 at one end in the width direction of the bucket 8 and second contour data of the bucket 8 at the other end, and the two-dimensional bucket data is obtained on the basis of the first contour data, the second contour data, and the position of the work machine operation plane MP in the direction parallel to the bucket axis. As a result, the two-dimensional bucket data can be obtained accurately and rapidly.

In the present embodiment, relative positions of the target excavation landform and the bucket 8 are obtained on the basis of the two-dimensional bucket data, the vehicle main body position data P indicating the current position of the vehicle main body 1, and the vehicle main body posture data Q indicating the posture of the vehicle main body 1. As a result, the relative positions of the target excavation landform and the bucket 8 can be obtained accurately.

In the present embodiment, the work machine 2 is controlled by the work machine control unit 26A on the basis of the two-dimensional bucket data. As a result, the work machine control unit 26A can derive the distance d between the target excavation landform and the bucket 8 on the basis of the two-dimensional bucket data S and the target excavation landform along the work machine operation plane MP to execute the limited excavation control on the work machine 2.

In the present embodiment, the work machine control unit 26A determines a speed limit according to the distance between the target excavation landform and bucket 8 on the basis of the target excavation landform data U and the bucket position data, and controls the work machine 2 so that the speed in the direction in which the work machine 2 moves closer to the target excavation landform becomes equal to or lower than the speed limit. As a result, the bucket 8 is prevented from entering the target excavation landform and degradation in excavation accuracy is prevented.

In the present embodiment, the target excavation landform data and the bucket position data are displayed on the display unit 26. As a result, the control object is located on the basis of the work machine operation plane MP, and the limited excavation control is executed with high accuracy.

Note that, in the present embodiment, the vehicle main body position data P and the vehicle main body posture data Q of the excavator CM in the global coordinate system are obtained, and the relative positions of the target excavation landform and the bucket 8 in the global coordinate system are obtained by using the position (two-dimensional bucket data S) of the bucket 8 obtained in the local coordinate system, the vehicle main body position data P, and the vehicle main body posture data Q. The target excavation landform data may be defined in the local coordinate system, and the relative positions of the target excavation landform and the bucket 8 in the local coordinate system may be obtained. The same applies to embodiments described below.

Note that, in the present embodiment, the limited excavation control (interventional control) is executed by using two-dimensional bucket data S. The limited excavation control may not be executed. For example, the operator may look at the display unit 29 and manipulate the operating device 25 so that the bucket 8 moves along the target excavation landform on the work machine operation plane MP. The same applies the embodiments described below.

[Method for Specifying Y Coordinate of Work Machine Operation Plane (Second Embodiment)]

In the embodiment described above, an example in which the Y coordinate of the work machine operation plane MP is specified by the operator is described. In the following, another example of the method for specifying the Y coordinate of the work machine operation plane MP will be described.

Similarly to the above-described embodiment, the acquisition unit 28C acquires the target construction information T including the target excavation landform and indicating three-dimensional designed landform that is a three-dimensional target shape of the excavation object.

In the present embodiment, the calculation unit 28A obtains the closest point that is closest to the surface of the target construction information from multiple measure points Pen defined on the front end portion 8*a* of the bucket and the external surface of the bucket 8 on the basis of the work machine angle data, the tilt angle data, the vehicle main body position data P, the vehicle main body posture data Q, and the external shape data of the bucket 8. The Y coordinate of the work machine operation plane MP is specified so that the work machine operation plane MP passes through the closest point.

The display controller 28 acquires bucket data. The bucket data includes the external shape data of the bucket 8 and the dimension data of the work machine 2. Similarly to the above-described embodiment, the external shape data of the bucket 8 and the dimension data of the work machine 2 are known data. The external shape data of the bucket 8 includes the external shape of a hip portion of the bucket 8. The hip portion refers to a partial area of the external surface of the bucket 8 having a shape bulging outward.

Figure 37:
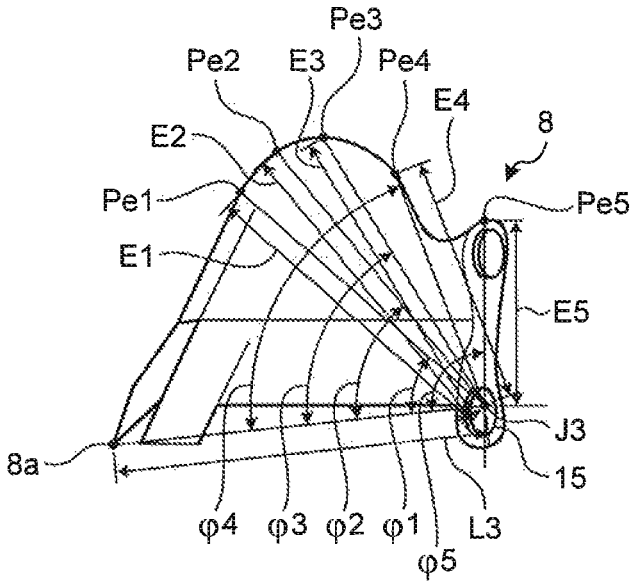
FIG. 37 is a schematic diagram for explaining an example of a method for controlling a construction machine.

As illustrated in FIG. 37, multiple measure points Pen (n=1, 2, 3, 4, 5) are set at different positions on the hip portion of the bucket 8. Multiple measure points Pen are set in a direction intersecting with the width direction of the bucket 8. The bucket data includes the distances En (n=1, 2, 3, 4, 5) between the bucket axis J3 in the radiation direction toward the bucket axis J3 and the measure points Pen. The bucket data includes angles φn (n=1, 2, 3, 4, 5) between the reference line and lines connecting the bucket axis J3 and the measure points Pen. In the example illustrated in FIG. 29, the reference line is a line connecting the bucket axis J3 and the front end portion 8*a* of the bucket 8.

The display controller 28 acquires measure point position data indicating current positions of the multiple measure points Pen of the bucket 8 in driving of the work machine 2. The display controller 28 also acquires front end portion position data indicating the current position of the front end portion 8*a* of the bucket 8. The display controller 28 can acquire the measure point position data indicating the current positions of the measure points Pen in the local coordinate system and the front end portion position data indicating the current position of the front end portion 8*a* on the basis of the work machine angle data detected by the angle detector 22, the tilt angle data detected by the tilt angle sensor 70, and the bucket data that is known data.

The display controller 28 derives target construction information and target excavation landform data U indicating the target excavation landform expressed by intersection lines (see the intersection line E in FIG. 18) intersecting with the XZ plane passing through the measure points Pen of the bucket 8 on the basis of the current positions of the measure points Pen of the bucket 8 and the acquired three-dimensional designed landform data T.

The display controller 28 obtains the current positions of the front end portion 8*a* of the bucket 8 and the multiple measure points Pen and obtains a point (the closest point) that is closest to the surface of the target construction information from the front end portion 8*a* and the measure points Pen on the basis of the vehicle main body position data P and the vehicle main body posture data Q.

Figure 38:
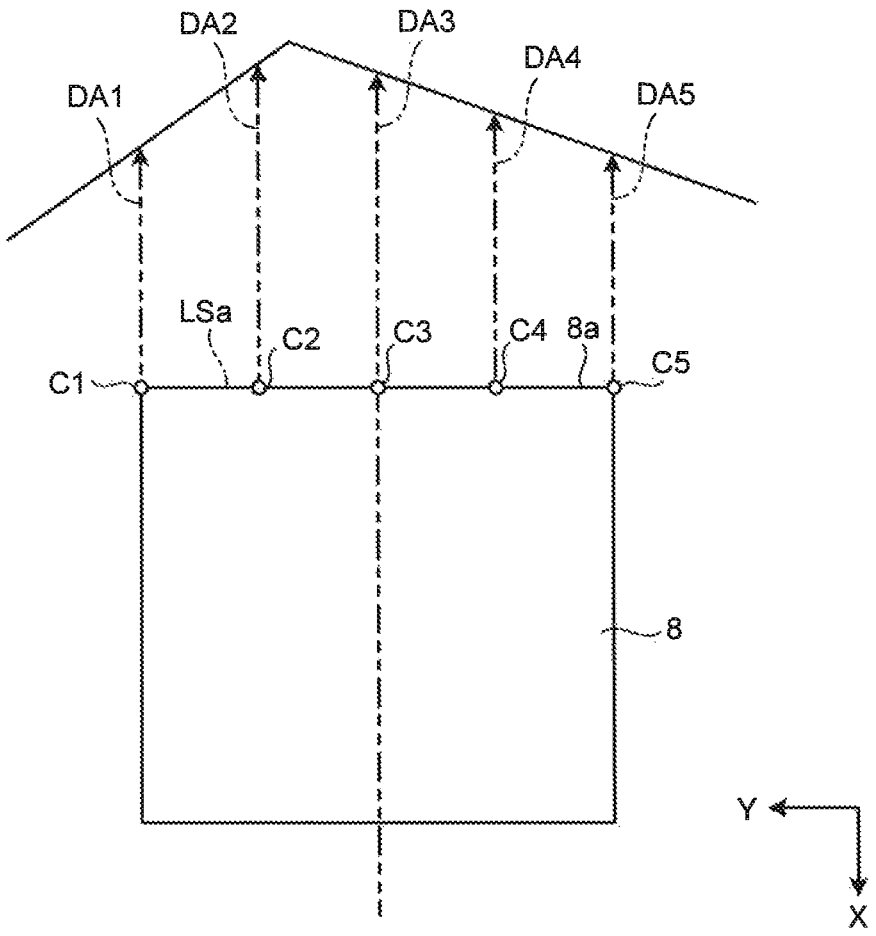
FIG. 38 is a schematic diagram for explaining an example of a method for controlling a construction machine.

Multiple measure points are set not only in the direction intersecting with the width direction of the bucket 8 but also in the width direction of the bucket 8. FIG. 38 is a diagram for explaining the shortest distance between the front end portion 8*a* of the bucket 8 and the surface of the target construction information. FIG. 38 corresponds to a view of the bucket 8 as viewed from above.

As illustrated in FIG. 38, the display controller 28 calculates a virtual line Lsa passing through the front end portion 8*a* of the bucket 8 and matching with the dimension of the bucket 8 in the width direction. The display controller 28 sets multiple measure points Ci (i=1, 2, 3, 4, 5) on the virtual line Lsa. The measure points Ci refer to multiple positions in the width direction of the bucket 8 at the front end portion 8*a*. The display controller 28 obtains the current positions of the measure points Ci on the basis of the vehicle main body position data P and the vehicle main body posture data Q.

Figure 39:
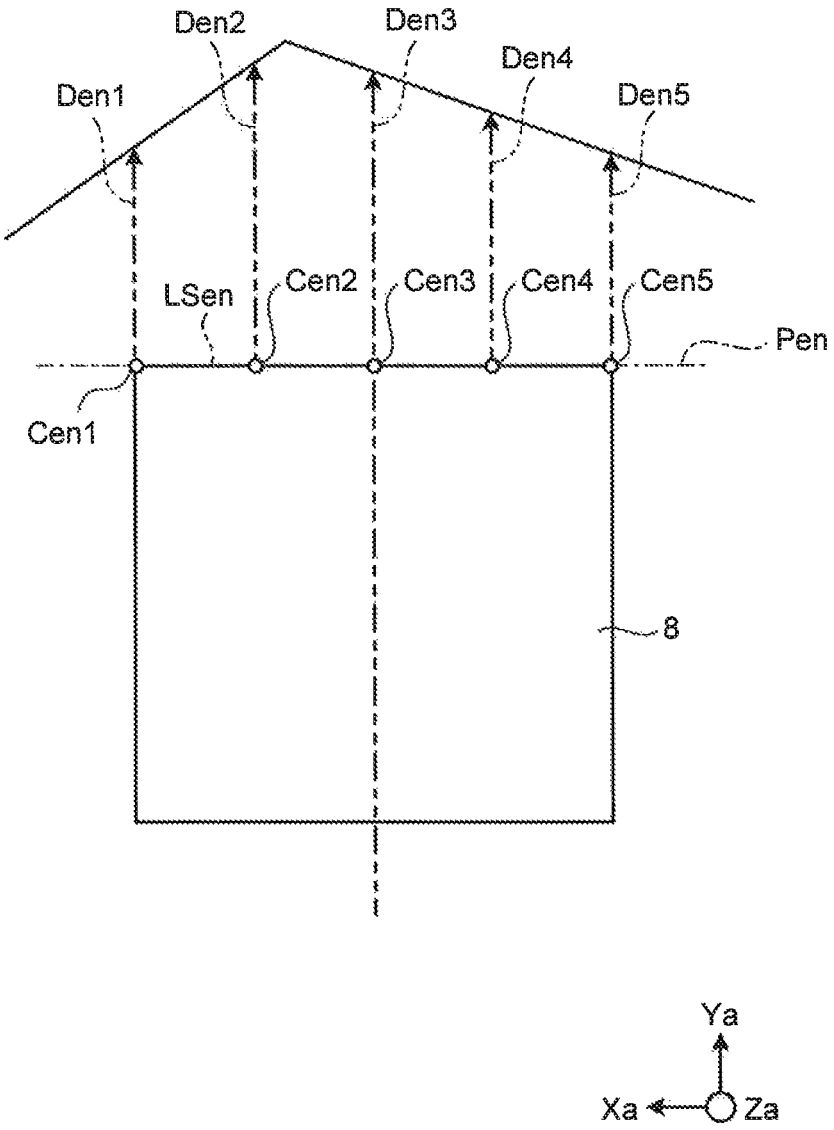
FIG. 39 is a schematic diagram for explaining an example of a method for controlling a construction machine.

FIG. 39 is a diagram for explaining the shortest distance between the hip portion of the bucket 8 and the surface of the target construction information. FIG. 39 corresponds to a view of the bucket 8 as viewed from above.

As illustrated in FIG. 39, the display controller 28 calculates a virtual line LSen passing through the measure points Pen of the bucket 8 and matching with the dimension in the width direction of the bucket 8. The display controller 28 sets multiple measure points Ceni (i=1, 2, 3, 4, 5) on the virtual line LSen. The measure points Ceni represent multiple positions in the width direction of the bucket 8 at the hip portion. The display controller 28 obtains the current positions of the measure points Ceni on the basis of the vehicle main body position data P and the vehicle main body posture data Q.

In this manner, multiple measure points are provided in the front-back direction of the bucket 8 and also in the left-right direction (width direction) of the bucket 8. Thus, multiple measure points are provided in a matrix on the external surface of the bucket 8.

Figure 40:
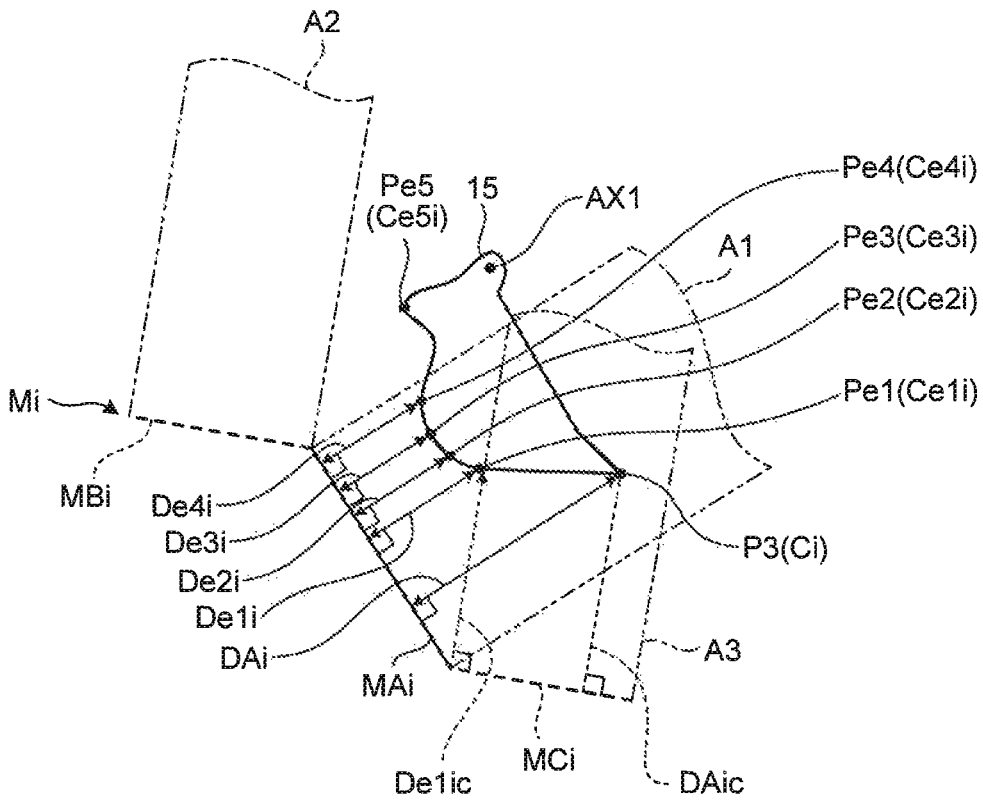
FIG. 40 is a schematic diagram for explaining an example of a method for controlling a construction machine.

FIG. 40 is a diagram for explaining the shortest distance between the target construction information and the bucket 8 in side view of the bucket 8. When intersection lines of the XZ planes passing through i-th measure points Ci, Ceni and the surface of the target construction information are represented by intersection lines Mi, the display controller 28 calculates the distances between intersection lines MAi, MBi, and MCi included in the intersection lines Mi and the i-th measure points Ci, Ceni. Here, a perpendicular line passing through the i-th measure points Ci, Ceni is calculated for each of the intersection lines MAi, MBi, and MCi included in the intersection lines Mi, to calculate the distances between the intersection lines MAi, MBi, and MCi and the i-th measure points Ci, Ceni. For example, as illustrated in FIGS. 38, 39, and 40, the i-th measure point Ci is positioned in a target area A1 of target areas A1, A2, and A3. The perpendicular line to the intersection line MAi passing through the i-th measure point Ci is calculated, and the distances Dai, Deni between the i-th measure points Ci, Ceni and the intersection line MAi are calculated. Furthermore, as illustrated in FIGS. 38, 39, and 40, the i-th measure points Ci, Ceni are positioned in the target area A3 of the target areas A1, A2, and A3. The perpendicular line to the intersection line MCi passing through the i-th measure points Ci, Ceni is calculated, and designed surface distances Daic, Denic between the i-th measure points Ci, Ceni and the intersection line MCi are calculated. In this manner, the display controller 28 obtains the shortest distance that is a minimum distance from the distances that can be calculated as illustrated in FIGS. 38, 39, and 40.

When there is the same measure point Pe1 or the same position of the blade edge 8*a* in the normal direction of multiple intersection lines MAi and MCi, the display controller 28 obtains multiple distances Deli, Dai for the measure points Pe1 or the blade edge 8*a*.

In this manner, the closest measure point closest to the surface of the target construction information among multiple measure points (including measure points for the front end portion 8*a* of the bucket 8) set in a matrix on the external surface of the bucket 8 is obtained on the basis of the vehicle main body position data P and the vehicle main body posture data Q. The work machine operation plane MP is specified to pass through the closest measure point.

While embodiments of the present invention have been described above, the present invention is not limited to the embodiments but various modifications can be made without departing from the scope of the invention.

Although an excavator is used as an example of the construction machine in the embodiments described above, the present invention is not limited to excavators but may be applied to any other type of construction machine.

Acquisition of the position of the excavator CM in the global coordinate system is not limited to the GNSS but may be conducted by using any other measuring means. Thus, acquisition of the distance d between the bucket 8 and the target excavation landform is not limited to the GNSS but may be conducted by using any other measuring means.

For the boom manipulation amount, the arm manipulation amount, and the bucket manipulation amount, operation signals from the manipulation levers may be input to the work machine controller 26 as a method of outputting electrical signals indicating manipulation of the manipulation levers (25R, 25L) instead of the method using the pilot oil pressure. The processes executed by the controllers may be executed by other controllers.

REFERENCE SIGNS LIST

1 vehicle main body
2 work machine
3 swing body
4 cab
5 running device
5Cr crawler track
6 boom
7 arm
8 bucket
9 engine compartment
10 boom cylinder
11 arm cylinder
12 bucket cylinder
13 boom pin
14 arm pin
15 bucket pin
16 first stroke sensor
17 second stroke sensor
18 third stroke sensor
19 handrail
20 position detector
21 antenna
22 angle detector
23 position sensor
24 inclination sensor
25 operating device
25F manipulation pedal
25L second manipulation lever
25R first manipulation lever
25P third manipulation lever
26 work machine controller
27 control valve
28 display controller
29 display unit
30 tilt cylinder
32 sensor controller
36 input unit
40A cap side oil chamber
40B rod side oil chamber
41 main hydraulic pump
42 pilot hydraulic pump
43 main valve
51 shuttle valve
70 tilt angle sensor
80 tilt pin
81 bottom plate
82 back plate
83 top plate
84 side plate
85 side plate
86 opening
87 bracket
88 bracket
90 connecting member
91 plate member
92 bracket
93 bracket
94 first link member
94P first link pin
95 second link member
95P second link pin
96 bucket cylinder top pin

97 bracket
161 rotary roller
162 rotation center shaft
163 rotation sensor unit
164 case
200 control system
300 hydraulic system
AX swing axis
CM construction machine (excavator)
J1 boom axis
J2 arm axis
J3 bucket axis
J4 tilt axis
L1 boom length
L2 arm length
L3 bucket length
L4 tilt length
L5 bucket width dimension
P vehicle main body position data
Q vehicle main body posture data (swing body orientation data)
S two-dimensional bucket data
T target construction information
U target excavation landform data
$\alpha$ boom turning angle
$\beta$ arm turning angle
$\gamma$ bucket turning angle
$\delta$ tilt angle
$\epsilon$ tilt axis angle

The invention claimed is:

1. A control system for a construction machine including a work machine including: a boom rotatable about a boom axis relative to a vehicle main body, an arm rotatable about an arm axis parallel to the boom axis relative to the boom, and a bucket rotatable about a bucket axis parallel to the arm axis and about a tilt axis perpendicular to the bucket axis relative to the arm, the control system comprising:

a first acquisition unit configured to acquire dimension data including a dimension of the boom, a dimension of the arm, and a dimension of the bucket;

a second acquisition unit configured to acquire external shape data of the bucket including contour dimensions of an external surface of the bucket and width dimensions of the bucket;

a third acquisition unit configured to acquire target excavation landform data indicating a target excavation landform that is a two-dimensional target shape of an excavation object on a work machine operation plane perpendicular to the bucket axis;

a fourth acquisition unit configured to acquire work machine angle data including a boom angle data indicating a turning angle of the boom about the boom axis, arm angle data indicating a turning angle of the arm about the arm axis, and a bucket angle data indicating a turning angle of the bucket about the bucket axis;

a fifth acquisition unit configured to acquire tilt angle data indicating a turning angle of the bucket about the tilt axis;

a calculation unit configured to obtain two-dimensional bucket data indicating an external shape of the bucket on the work machine operation plane on the basis of the dimension data, the external shape data, the work machine angle data, and the tilt angle data; and a work machine control unit configured to control the work machine on the basis of the two-dimensional bucket data.

2. The control system for a construction machine according to claim 1, wherein the external shape data of the bucket includes first contour data including contour of an external surface of the bucket at one end in a width direction of the bucket and second contour data including the contour of the external surface of the bucket at another end in the width direction of the bucket, and the calculation unit obtains the two-dimensional bucket data on the basis of the first contour data, a position of the work machine operation plane, and a position of a bucket blade edge.

3. The control system for a construction machine according to claim 1, wherein the two-dimensional bucket data includes bucket position data indicating a current position of the bucket on the work machine operation plane, and the work machine control unit determines a speed limit according to a distance between the target excavation landform and the bucket on the basis of the target excavation landform data and the bucket position data, and limits a speed of the boom to be equal to or lower than the speed limit in a direction in which the work machine moves toward the target excavation landform.

4. The control system for a construction machine according to claim 1, wherein the two-dimensional bucket data includes bucket position data indicating a current position of the bucket on the work machine operation plane, and the control system further comprises a display unit configured to display the target excavation landform data and the bucket position data.

5. A construction machine comprising:

a lower running body;

an upper swing body supported by the lower running body;

a work machine including a boom, an arm, and a bucket, and supported by the upper swing body; and the control system according to claim 1.

6. A method for controlling a construction machine including a work machine including: a boom rotatable about a boom axis relative to a vehicle main body, an arm rotatable about an arm axis parallel to the boom axis relative to the boom, and a bucket rotatable about a bucket axis parallel to the arm axis and about a tilt axis perpendicular to the bucket axis relative to the arm, the method comprising:

acquiring dimension data including a dimension of the boom, a dimension of the arm, and a dimension of the bucket;

acquiring external shape data of the bucket including contour dimensions of an external surface of the bucket and width dimensions of the bucket;

acquiring work machine angle data including a boom angle data indicating a turning angle of the boom about the boom axis, arm angle data indicating a turning angle of the arm about the arm axis, and a bucket angle data indicating a turning angle of the bucket about the bucket axis;

acquiring tilt angle data indicating a turning angle of the bucket about the tilt axis;

specifying target excavation landform data indicating a target excavation landform that is a two-dimensional target shape of an excavation object on a work machine operation plane perpendicular to the bucket axis;

obtaining two-dimensional bucket data indicating an external shape of the bucket on the work machine operation plane on the basis of the dimension data, the external shape data, the work machine angle data, and the tilt angle data; and controlling the work machine on the basis of the two-dimensional bucket data.

* * * * *